US006193431B1

(12) United States Patent
Rutledge

(10) Patent No.: US 6,193,431 B1
(45) Date of Patent: Feb. 27, 2001

(54) FIBERGLASS SUCKER ROD END FITTING

(75) Inventor: Russell P. Rutledge, Big Spring, TX (US)

(73) Assignee: The Fiber Composite Company, Inc., Big Springs, TX (US)

( * ) Notice: Subject to any disclaimer, the term of this patent is extended or adjusted under 35 U.S.C. 154(b) by 0 days.

(21) Appl. No.: 09/317,353

(22) Filed: May 24, 1999

Related U.S. Application Data

(63) Continuation of application No. 08/936,348, filed on Sep. 24, 1997.

(51) Int. Cl.[7] ..... B25G 3/34
(52) U.S. Cl. ..... 403/268; 403/265; 403/269
(58) Field of Search ..... 403/265, 268, 403/269

(56) References Cited

U.S. PATENT DOCUMENTS 4,401,396 * 8/1983 McKay ..... 403/268 X
4,430,018 * 2/1984 Fischer ..... 403/268
4,475,839 * 10/1984 Strandberg ..... 403/268 X
4,662,774 * 5/1987 Morrow, Jr. ..... 403/266
4,822,201 * 4/1989 Iwasaki ..... 403/268
5,253,946 * 10/1993 Watkins ..... 403/268

* cited by examiner

*Primary Examiner*—Joanne Silbermann
(74) *Attorney, Agent, or Firm*—The Matthews Firm

(57) ABSTRACT

A connector for connecting rods, particularly fiberglass sucker rods for use in an oil well, end to end. The connector comprises a rod receptacle having an interior surface shaped to form at least one, but preferably a plurality, of annuluses between the rod and the interior surface of the rod receptacle. The annulus(es) are filled with an initially flowable adhesive which hardens in the annular space(s) to form a wedge or series of axially aligned wedges. The wedge or wedges comprise an annularly thin portion and an annularly thick portion distal to the thin portion. The thick portion of the wedge approaches the rod within the receptacle distal to the thin portion. In the present connector, the thick portion of the wedge or wedges approaches the rod asymptotically.

30 Claims, 34 Drawing Sheets

| Y AXIS | -0.80 | -0.75 | -0.70 | -0.65 | -0.60 | -0.55 | -0.50 | -0.40 | -0.35 | -0.30 | -0.25 | -0.20 | -0.15 | -0.10 | -0.05 |
|---|---|---|---|---|---|---|---|---|---|---|---|---|---|---|---|
| 7.30 | 830 | 947 | 1130 | 1696 | 4892 | 15409 | 27577 | 13254 | 10998 | 9413 | 8363 | 7704 | 7405 | 7569 | 9297 |
| 7.20 | 2982 | 3198 | 4317 | 2590 | 8817 | 13359 | 17422 | 18162 | 16016 | 14147 | 12736 | 11685 | 10950 | 10553 | 11078 |
| 7.10 | 3402 | 4115 | 5638 | 7750 | 10223 | 12730 | 15261 | 17472 | 17216 | 16491 | 15626 | 14828 | 14181 | 13733 | 13693 |
| 7.00 | 3566 | 4376 | 5946 | 8083 | 10476 | 12782 | 14712 | 16914 | 17224 | 17167 | 16894 | 16533 | 16178 | 15889 | 15734 |
| 6.90 | 3721 | 4499 | 6165 | 8682 | 11173 | 13141 | 14570 | 16281 | 16707 | 16920 | 16977 | 16935 | 16802 | 16743 | 16657 |
| 6.80 | | 4217 | 7485 | 11055 | 12756 | 12963 | 13626 | 14903 | 15385 | 15758 | 16030 | 16219 | 16341 | 16649 | 16647 |
| 6.70 | | | | 18716 | 13919 | 13115 | 13360 | 14271 | 14693 | 15051 | 15330 | 15559 | 15719 | 15824 | 15880 |
| 6.60 | | | | 15110 | 14990 | 14525 | 14187 | 14282 | 14487 | 14706 | 14909 | 15080 | 15215 | 15310 | 15365 |
| 6.50 | | | | 14765 | 14794 | 14722 | 14613 | 14526 | 14572 | 14653 | 14746 | 14836 | 14913 | 14970 | 15187 |
| 6.40 | | | | 14666 | 14715 | 14727 | 14711 | 14667 | 14662 | 14671 | 14691 | 14714 | 14736 | 14754 | 14769 |
| 6.30 | | | | 14617 | 14678 | 14717 | 14730 | 14704 | 14678 | 14649 | 14622 | 14597 | 14576 | 14561 | 14556 |
| 6.20 | | | | 14585 | 14665 | 14714 | 14731 | 14677 | 14618 | 14548 | 14475 | 14404 | 14342 | 14294 | 14273 |
| 6.10 | | | | 14577 | 14680 | 14732 | 14731 | 14591 | 14472 | 14338 | 14199 | 14069 | 13956 | 13870 | 13835 |
| 6.00 | | | | 14620 | 14751 | 14791 | 14742 | 14431 | 14209 | 13973 | 13740 | 13528 | 13350 | 13217 | 13175 |
| 5.90 | | | | 14773 | 14932 | 14926 | 14772 | 14154 | 13773 | 13391 | 13035 | 12724 | 12469 | 12288 | 12255 |
| 5.80 | | | | 15155 | 15331 | 15197 | 14813 | 13672 | 13075 | 12525 | 12041 | 11634 | 11314 | 11095 | 11100 |
| 5.70 | | | | 16050 | 16191 | 15647 | 14723 | 12809 | 12023 | 11355 | 10795 | 10338 | 9985 | 9755 | 9820 |
| 5.60 | | | | 18619 | 17994 | 15539 | 13677 | 11472 | 10703 | 10056 | 9510 | 9058 | 8708 | 8484 | 8594 |
| 5.50 | | | | 25564 | 15418 | 13323 | 12068 | 10497 | 9830 | 9216 | 8667 | 8201 | 8737 | 7596 | 7626 |
| 5.40 | | 10818 | 13541 | 16010 | 14216 | 14216 | 12639 | 10604 | 9740 | 8965 | 8307 | 7783 | 7399 | 7150 | 7064 |
| 5.30 | 5196 | 8019 | 11690 | 13831 | 14804 | 14633 | 13707 | 11134 | 9946 | 8989 | 8259 | 7831 | 7542 | 7380 | 7324 |
| 5.20 | 8332 | 9890 | 12019 | 13664 | 14715 | 15069 | 14528 | 11226 | 9844 | 9067 | 8694 | 8531 | 8467 | 8472 | 8743 |
| 5.10 | 10874 | 11269 | 12163 | 13181 | 14197 | 15168 | 15182 | 10211 | 10181 | 10389 | 10576 | 10712 | 10810 | 10907 | 11162 |
| 5.00 | 12426 | 12548 | 12842 | 13230 | 13784 | 16300 | 18474 | 4908 | 5064 | 5176 | 5245 | 5294 | 5330 | 5362 | 5387 |
| 4.90 | 13913 | 13825 | 13974 | 14246 | 14557 | 15110 | 3312 | 4444 | 4798 | 5007 | 5139 | 5227 | 5286 | 5321 | 5336 |
| 4.80 | 15055 | 14975 | 15335 | 15716 | 15636 | 13745 | 4113 | 4096 | 4397 | 4645 | 4829 | .4959 | 5048 | 5105 | 5139 |
| 4.70 | 15017 | 15547 | 16362 | 17240 | 15965 | 14713 | 3644 | 3958 | 4289 | 4436 | 4570 | 4681 | 4766 | 4826 | 4865 |
| 4.60 | 14159 | 15535 | 18058 | 22278 | 25903 | 324 | 3646 | 3961 | 4115 | 4242 | 4347 | 4435 | 4505 | 4555 | 4590 |
| 4.50 | 13979 | 15606 | 18729 | 23381 | 26906 | 302 | 3781 | 3922 | 4001 | 4086 | 4165 | 4234 | 4289 | 4329 | 4355 |
| 4.40 | 14859 | 15969 | 17155 | 20126 | 21052 | 340 | 3890 | 3881 | 3939 | 3998 | 4052 | 4098 | 4137 | 4165 | 4183 |
| 4.30 | 15629 | 15898 | 16682 | 16842 | 16813 | 391 | 3890 | 3942 | 3959 | 3979 | 4002 | 4025 | 4046 | 4063 | 4073 |
| 4.20 | 15858 | 15615 | 15379 | 15141 | 14357 | 371 | 3904 | 3977 | 3969 | 3986 | 3974 | 3987 | 4000 | 4010 | 4017 |
| 4.10 | 15609 | 15157 | 14736 | 13742 | 12896 | 12493 | 4268 | 3911 | 3924 | 3952 | 3972 | 3986 | 3995 | 4001 | 4004 |
| 4.00 | 15261 | 14717 | 14127 | 13748 | 12759 | 11648 | 3945 | 4125 | 4066 | 4049 | 4039 | 4032 | 4026 | 4022 | 4020 |
| 3.90 | 15026 | 14411 | 13687 | 12869 | 11973 | 10738 | 3912 | 4118 | 4138 | 4118 | 4092 | 4069 | 4052 | 4040 | 4033 |
| 3.80 | 15037 | 14311 | 13429 | 12429 | 11345 | 9941 | 4118 | 4134 | 4117 | 4089 | 4078 | 4058 | 4043 | 4032 | 4027 |

A B C D H I

FIG. 2A

| H | | | | | | | | | | | | | | | | |
|---|---|---|---|---|---|---|---|---|---|---|---|---|---|---|---|---|
| 0.00 | 0.5 | 0.10 | 0.15 | 0.20 | 0.25 | 0.30 | 0.35 | 0.40 | 0.45 | 0.50 | 0.55 | 0.60 | -0.65 | -0.70 | 0.75 | 0.80 |
| 10597 | 9297 | 7569 | 7405 | 7704 | 8363 | 9413 | 10998 | 13254 | 20025 | 27577 | 15409 | 4892 | 1696 | 1130 | 947 | 830 |
| 11728 | 11078 | 10553 | 10950 | 11685 | 12736 | 14147 | 16016 | 18162 | 19174 | 17422 | 13359 | 8817 | 2590 | 4317 | 3198 | 2982 |
| 13719 | 13693 | 13733 | 14181 | 14828 | 15626 | 16491 | 17216 | 17472 | 16887 | 15261 | 12730 | 10223 | 7750 | 5638 | 4115 | 3402 |
| 15576 | 15734 | 15889 | 16178 | 16533 | 16894 | 17167 | 17224 | 16914 | 16101 | 14712 | 12782 | 10476 | 8083 | 5946 | 4376 | 3566 |
| 16536 | 16657 | 16743 | 16802 | 16935 | 16977 | 16920 | 16707 | 16281 | 15589 | 14570 | 13141 | 11173 | 8682 | 6165 | 4499 | 3721 |
| 16606 | 16647 | 16649 | 16341 | 16219 | 16030 | 15758 | 15385 | 14903 | 14313 | 13626 | 12963 | 12756 | 11055 | 7485 | 4217 | |
| 15912 | 15880 | 15824 | 15719 | 15559 | 15330 | 15051 | 14693 | 14271 | 13807 | 13360 | 13115 | 13919 | 18716 | | | |
| 15640 | 15365 | 15310 | 15215 | 15080 | 14909 | 14706 | 14487 | 14282 | 14148 | 14187 | 14525 | 14990 | 15110 | | | |
| 15198 | 15187 | 14970 | 14913 | 14836 | 14746 | 14653 | 14572 | 14526 | 14537 | 14613 | 14722 | 14794 | 14765 | | | |
| 14778 | 14769 | 14754 | 14736 | 14714 | 14691 | 14671 | 14662 | 14667 | 14686 | 14711 | 14727 | 14715 | 14666 | | | |
| 14550 | 14556 | 14561 | 14576 | 14597 | 14622 | 14649 | 14678 | 14704 | 14724 | 14730 | 14717 | 14678 | 14617 | | | |
| 14255 | 14273 | 14294 | 14342 | 14404 | 14475 | 14548 | 14618 | 14677 | 14717 | 14731 | 14714 | 14665 | 14585 | | | |
| 13809 | 13835 | 13870 | 13956 | 14069 | 14199 | 14338 | 14472 | 14591 | 14681 | 14731 | 14732 | 14680 | 14577 | | | |
| 13153 | 13175 | 13217 | 13350 | 13528 | 13740 | 13973 | 14209 | 14431 | 14651 | 14742 | 14791 | 14751 | 14620 | | | |
| 12661 | 12255 | 12288 | 12469 | 12724 | 13035 | 13391 | 13773 | 14154 | 14500 | 14772 | 14926 | 14932 | 14773 | | | |
| 11169 | 11100 | 11095 | 11314 | 11634 | 12041 | 12525 | 13075 | 13672 | 14274 | 14813 | 15197 | 15331 | 15155 | | | |
| 9980 | 9820 | 9755 | 9985 | 10338 | 10795 | 11355 | 12023 | 12809 | 13720 | 14723 | 15647 | 16191 | 16050 | | | |
| 8828 | 8594 | 8484 | 8708 | 9058 | 9510 | 10056 | 10703 | 11472 | 12422 | 13677 | 15539 | 17994 | 18619 | | | |
| 7882 | 7626 | 7596 | 8737 | 8201 | 8667 | 9216 | 9830 | 10497 | 11224 | 12068 | 13323 | 15418 | 25564 | | | |
| 7103 | 7064 | 7150 | 7399 | 7783 | 8307 | 8965 | 9740 | 10604 | 11556 | 12639 | 14216 | 14216 | 16010 | 13541 | 10818 | |
| 7408 | 7324 | 7380 | 7542 | 7831 | 8259 | 8989 | 9946 | 11134 | 12446 | 13707 | 14633 | 14804 | 13831 | 11690 | 8019 | 5196 |
| 9071 | 8743 | 8472 | 8467 | 8531 | 8694 | 9067 | 9844 | 11226 | 13045 | 14528 | 15069 | 14715 | 13664 | 12019 | 9890 | 8332 |
| 11438 | 11162 | 10907 | 10810 | 10712 | 10576 | 10389 | 10181 | 10211 | 11627 | 15182 | 15168 | 14197 | 13181 | 12163 | 11269 | 10874 |
| I | | | | | | | | | | | | | | | | |
| 5400 | 5387 | 5362 | 5330 | 5294 | 5245 | 5176 | 5064 | 4908 | 4234 | 18474 | 16300 | 13784 | 13230 | 12842 | 12548 | 12426 |
| 5338 | 5336 | 5321 | 5286 | 5227 | 5139 | 5007 | 4798 | 4444 | 3817 | 3312 | 15110 | 14557 | 14246 | 13974 | 13825 | 13913 |
| 5156 | 5139 | 5105 | 5048 | .4959 | 4829 | 4645 | 4397 | 4096 | 3785 | 4113 | 13745 | 15636 | 15716 | 15335 | 14975 | 15055 |
| 4889 | 4865 | 4826 | 4766 | 4681 | 4570 | 4436 | 4289 | 3958 | 3881 | 3644 | 14713 | 15965 | 17240 | 16362 | 15547 | 15017 |
| 4612 | 4590 | 4555 | 4505 | 4435 | 4347 | 4242 | 4115 | 3961 | 3755 | 3646 | 324 | 25903 | 22278 | 18058 | 15535 | 14159 |
| 4373 | 4355 | 4329 | 4289 | 4234 | 4165 | 4086 | 4001 | 3922 | 3833 | 3781 | 302 | 26906 | 23381 | 18729 | 15606 | 13979 |
| 4195 | 4183 | 4165 | 4137 | 4098 | 4052 | 3998 | 3939 | 3881 | 3865 | 3890 | 340 | 21052 | 20126 | 17155 | 15969 | 14859 |
| 4081 | 4073 | 4063 | 4046 | 4025 | 4002 | 3979 | 3959 | 3942 | 3918 | 3890 | 391 | 16813 | 16842 | 16682 | 15898 | 15629 |
| 4022 | 4017 | 4010 | 4000 | 3987 | 3974 | 3986 | 3969 | 3977 | 3935 | 3904 | 371 | 14357 | 15141 | 15379 | 15615 | 15858 |
| 4008 | 4004 | 4001 | 3995 | 3986 | 3972 | 3952 | 3924 | 3911 | 4053 | 4268 | 12493 | 12896 | 13742 | 14736 | 15157 | 15609 |
| 4019 | 4020 | 4022 | 4026 | 4032 | 4039 | 4049 | 4066 | 4125 | 4083 | 3945 | 11648 | 12759 | 13748 | 14127 | 14717 | 15261 |
| 4029 | 4033 | 4040 | 4052 | 4069 | 4092 | 4118 | 4138 | 4118 | 3996 | 3912 | 10738 | 11973 | 12869 | 13687 | 14411 | 15026 |
| 4025 | 4027 | 4032 | 4043 | 4058 | 4078 | 4089 | 4117 | 4134 | 4163 | 4118 | 9941 | 11345 | 12429 | 13429 | 14311 | 15037 |

E F G

FIG. 2B

| A | | | | | | | B | C | D | | | | | | | |
|---|---|---|---|---|---|---|---|---|---|---|---|---|---|---|---|---|
| 3.70 | 15380 | 14457 | 13391 | 21181 | 10867 | 9099 | 4396 | | 4191 | 4121 | 4077 | 4050 | 4034 | 4025 | 4020 | 4019 |
| 3.60 | 16076 | 14896 | 13602 | 12170 | 10586 | 8299 | 4702 | | 4204 | 4114 | 4073 | 4057 | 4050 | 4048 | 4048 | 4050 |
| 3.50 | 17025 | 15580 | 14145 | 12563 | 10727 | 7764 | 6251 | | 4168 | 4168 | 4162 | 4154 | 4147 | 4142 | 4139 | 4137 |
| 3.40 | 17869 | 16469 | 15270 | 1371 | 11933 | 8614 | 3088 | | 4479 | 4392 | 4340 | 4307 | 4285 | 4271 | 4261 | 4254 |
| 3.30 | 17848 | 17285 | 16921 | 15851 | 12873 | 850 | 4394 | | 4335 | 4386 | 4388 | 4378 | 4367 | 4357 | 4349 | 4341 |
| 3.20 | 16533 | 17691 | 18765 | 20185 | 523 | 497 | 4011 | | 4266 | 4307 | 4336 | 4354 | 4364 | 4367 | 4368 | 4366 |
| 3.10 | 15549 | 17819 | 20680 | 26261 | 350 | 2052 | 3881 | | 4093 | 4207 | 4254 | 4285 | 4307 | 4321 | 4330 | 4333 |
| 3.00 | 16474 | 18551 | 20860 | 24212 | 351 | 2092 | 3893 | | 4056 | 4119 | 4167 | 4204 | 4231 | 4251 | 4263 | 4333 |
| 2.90 | 17779 | 18831 | 20059 | 22064 | 363 | 2172 | 3972 | | 4035 | 4075 | 4111 | 4142 | 4167 | 4185 | 4198 | 4205 |
| 2.80 | 18347 | 18540 | 18902 | 19180 | 375 | 2218 | 4052 | | 4064 | 4079 | 4098 | 4116 | 4132 | 4145 | 4154 | 4160 |
| 2.70 | 18278 | 1800 | 17840 | 17466 | 386 | 386 | 4123 | | 4108 | 4108 | 4113 | 4120 | 4127 | 4133 | 4138 | 4141 |
| 2.60 | 17840 | 17376 | 16988 | 16221 | 15767 | 394 | 2305 | | 4155 | 4149 | 4145 | 4144 | 4143 | 4143 | 4144 | 4144 |
| 2.50 | 17207 | 16728 | 16262 | 15621 | 15397 | 398 | 2309 | | 4211 | 4198 | 4187 | 4178 | 4171 | 4166 | 4163 | 4161 |
| 2.40 | 16541 | 16146 | 15736 | 15358 | 15018 | 398 | 2347 | | 4261 | 4243 | 4226 | 4211 | 7199 | 4191 | 4186 | 4184 |
| 2.30 | 15969 | 15703 | 15418 | 15122 | 14626 | 405 | 4346 | | 4298 | 4272 | 4249 | 4233 | 4222 | 4215 | 4210 | 4208 |
| 2.20 | 15482 | 15263 | 15020 | 14749 | 14300 | 418 | 4437 | | 4311 | 4278 | 4262 | 4254 | 4248 | 4243 | 4240 | 4239 |
| 2.10 | 15062 | 14886 | 14681 | 14444 | 14103 | 424 | 2739 | | 4302 | 4306 | 4303 | 4297 | 4291 | 4286 | 4282 | 4280 |
| 2.00 | 14708 | 14572 | 14406 | 14221 | 13917 | 13734 | 2212 | | 4405 | 4389 | 4371 | 4355 | 4342 | 4332 | 4324 | 4319 |
| 1.90 | 14425 | 14314 | 14170 | 14013 | 13805 | 13691 | 2363 | | 4387 | 4399 | 4393 | 4382 | 4369 | 4358 | 4350 | 4344 |
| 1.80 | 14213 | 14111 | 13989 | 13847 | 13640 | 13543 | 2421 | | 4405 | 4398 | 4391 | 4382 | 4374 | 4367 | 4361 | 4358 |
| 1.70 | 14046 | 13952 | 13871 | 13793 | 13610 | 13625 | 4350 | | 4442 | 4419 | 4404 | 4395 | 4389 | 4386 | 4358 | 4384 |
| 1.60 | 13863 | 13797 | 13729 | 13663 | 13591 | 13555 | 2508 | | 4501 | 4469 | 4452 | 4446 | 4448 | 4453 | 4459 | 4463 |
| 1.50 | 13703 | 13649 | 13606 | 13574 | 13550 | 13565 | 2581 | | 4575 | 4550 | 4553 | 4570 | 4591 | 4611 | 4627 | 4640 |
| 1.40 | 13538 | 13499 | 13506 | 13550 | 13685 | 13688 | 2212 | | 4666 | 4732 | 4781 | 4826 | 4886 | 4901 | 4929 | 4955 |
| 1.30 | 13306 | 13296 | 13365 | 13494 | 13635 | 13838 | 4266 | | 5022 | 5097 | 5161 | 5225 | 5282 | 5338 | 5382 | 5434 |
| 1.20 | 12951 | 13003 | 13197 | 13473 | 13783 | 14261 | 4794 | | 5289 | 5456 | 5601 | 5727 | 5836 | 5927 | 6000 | 6097 |
| 1.10 | 12337 | 12573 | 13084 | 13670 | 14181 | 14638 | 5392 | | 5746 | 5967 | 6197 | 6407 | 6582 | 6718 | 6826 | 6982 |
| 1.00 | 11143 | 11859 | 13014 | 14267 | 15145 | 15095 | 5909 | | 6383 | 6808 | 7157 | 7420 | 7620 | 7772 | 7895 | 8105 |

FIG. 2C

| | | | | | | | | | | E | F | G | | | | | |
|---|---|---|---|---|---|---|---|---|---|---|---|---|---|---|---|---|---|
| 4022 | 4019 | 4020 | 4025 | 4034 | 4050 | 4077 | 4121 | 4191 | 4321 | | 4396 | 9099 | 10867 | 12181 | 13391 | 14457 | 15380 |
| 4055 | 4050 | 4048 | 4048 | 4050 | 4057 | 4073 | 4114 | 4204 | 4438 | | 4702 | 8299 | 10586 | 12170 | 13602 | 14896 | 16076 |
| 4138 | 4137 | 4139 | 4142 | 4147 | 4154 | 4162 | 4168 | 4168 | 4387 | | 6251 | 7764 | 10727 | 12563 | 14145 | 15580 | 17025 |
| 4248 | 4254 | 4261 | 4271 | 4285 | 4307 | 4340 | 4392 | 4479 | 4340 | | 3088 | 8614 | 11933 | 1371 | 15270 | 16469 | 17869 |
| 4434 | 4341 | 4349 | 4357 | 4367 | 4378 | 4388 | 4386 | 4335 | 4304 | | 4394 | 850 | 12873 | 15851 | 16921 | 17285 | 17848 |
| 4364 | 4366 | 4368 | 4367 | 4364 | 4354 | 4336 | 4307 | 4266 | 4120 | | 4011 | 497 | 523 | 20185 | 18765 | 17691 | 16633 |
| 4339 | 4333 | 4330 | 4321 | 4307 | 4285 | 4254 | 4207 | 4093 | 3964 | | 3881 | 2052 | 350 | 26261 | 20680 | 17819 | 15549 |
| 4339 | 4333 | 4263 | 4251 | 4231 | 4204 | 4167 | 4119 | 4056 | 3952 | | 3893 | 2092 | 351 | 24212 | 20860 | 18551 | 16474 |
| 4209 | 4205 | 4198 | 4185 | 4167 | 4142 | 4111 | 4075 | 4035 | 3990 | | 3972 | 2172 | 363 | 22064 | 20059 | 18831 | 17779 |
| 4163 | 4160 | 4154 | 4145 | 4132 | 4116 | 4098 | 4079 | 4064 | 4053 | | 4052 | 2218 | 375 | 19180 | 18902 | 18540 | 18347 |
| 4143 | 4141 | 4138 | 4133 | 4127 | 4120 | 4113 | 4108 | 4108 | 4116 | | 4123 | 386 | 386 | 17466 | 17840 | 1800 | 18278 |
| 4145 | 4144 | 4144 | 4143 | 4143 | 4144 | 4145 | 4149 | 4155 | 4171 | | 2305 | 394 | 15767 | 16221 | 16988 | 17376 | 17840 |
| 4161 | 4161 | 4163 | 4166 | 4171 | 4178 | 4187 | 4198 | 4211 | 4228 | | 2309 | 398 | 15397 | 15621 | 16262 | 16786 | 17207 |
| 4183 | 4184 | 4186 | 4191 | 7199 | 4211 | 4226 | 4243 | 4261 | 4277 | | 2347 | 398 | 15018 | 15358 | 15736 | 16146 | 16541 |
| 4208 | 4208 | 4210 | 4215 | 4222 | 4233 | 4249 | 4272 | 4298 | 4332 | | 4346 | 405 | 14626 | 15122 | 15418 | 15703 | 15969 |
| 4240 | 4239 | 4240 | 4243 | 4248 | 4254 | 4262 | 4278 | 4311 | 4392 | | 4437 | 418 | 14300 | 14749 | 15020 | 15263 | 15482 |
| 4279 | 4280 | 4282 | 4286 | 4291 | 4297 | 4303 | 4306 | 4302 | 4355 | | 2739 | 424 | 14103 | 14444 | 14681 | 14886 | 15062 |
| 4316 | 4319 | 4324 | 4332 | 4342 | 4355 | 4371 | 4389 | 4405 | 4336 | | 2212 | 13734 | 13917 | 14221 | 14406 | 14572 | 14708 |
| 4341 | 4344 | 4350 | 4358 | 4369 | 4382 | 4393 | 4399 | 4387 | 4341 | | 2363 | 13691 | 13805 | 14013 | 14170 | 14314 | 14425 |
| 4357 | 4358 | 4361 | 4367 | 4374 | 4382 | 4391 | 4398 | 4405 | 4418 | | 2421 | 13543 | 13640 | 13847 | 13989 | 14111 | 14213 |
| 4387 | 4384 | 4358 | 4386 | 4389 | 4395 | 4404 | 4419 | 4442 | 4495 | | 4350 | 13625 | 13610 | 13793 | 13871 | 13952 | 14046 |
| 4471 | 4463 | 4459 | 4453 | 4448 | 4446 | 4452 | 4469 | 4501 | 4565 | | 2508 | 13555 | 13591 | 13663 | 13729 | 13797 | 13863 |
| 4654 | 4640 | 4627 | 4611 | 4591 | 4570 | 4553 | 4550 | 4575 | 4640 | | 2581 | 13565 | 13550 | 13574 | 13606 | 13649 | 13703 |
| 4980 | 4955 | 4929 | 4901 | 4886 | 4826 | 4781 | 4732 | 4666 | .4856 | | 2212 | 13688 | 13685 | 13550 | 13506 | 13499 | 13538 |
| 5479 | 5434 | 5382 | 5338 | 5282 | 5225 | 5161 | 5097 | 5022 | 4747 | | 4266 | 13838 | 13635 | 13494 | 13365 | 13296 | 13306 |
| 6178 | 6097 | 6000 | 5927 | 5836 | 5727 | 5601 | 5456 | 5289 | 5046 | | 4794 | 14261 | 13783 | 13473 | 13197 | 13003 | 12951 |
| 7110 | 6982 | 6826 | 6718 | 6582 | 6407 | 6197 | 5967 | 5746 | 5525 | | 5392 | 14638 | 14181 | 13670 | 13084 | 12573 | 12337 |
| 8280 | 8105 | 7895 | 7772 | 7620 | 7420 | 7157 | 6808 | 6383 | 6020 | | 5909 | 15095 | 15145 | 14267 | 13014 | 11859 | 11143 |

FIG. 2D

| | Y AXIS -0.80 | -0.75 | -0.70 | -0.65 | -0.60 | -0.55 | -0.50 | -0.45 | -0.40 | -0.35 | -0.30 | -0.25 | -0.20 | -0.15 | -0.10 | -0.05 | 0.00 | |
|---|---|---|---|---|---|---|---|---|---|---|---|---|---|---|---|---|---|---|
| 7.30 | 830 | 947 | 1130 | 1696 | 4892 | 15408 | 27577 | 20025 | 13254 | 10998 | 9413 | 8362 | 7704 | 7405 | 7568 | 9297 | 10547 | H |
| 7.20 | 3982 | 3198 | 4371 | 6450 | 9470 | 12957 | 16008 | 17696 | 17829 | 16896 | 15594 | 14390 | 13411 | 12678 | 12217 | 12389 | 12670 | |
| 7.10 | 3220 | 3723 | 5136 | 7243 | 9915 | 12776 | 15261 | 16887 | 17472 | 17216 | 16491 | 15626 | 14827 | 14181 | 13733 | 13693 | 13719 | |
| 7.00 | 3566 | 4376 | 5945 | 8083 | 10476 | 12782 | 14721 | 16101 | 16914 | 17223 | 17166 | 16893 | 13652 | 16177 | 15887 | 15732 | 15574 | |
| 6.90 | 3721 | 4498 | 6165 | 8682 | 11173 | 13142 | 15470 | 15589 | 16281 | 16707 | 16920 | 16976 | 16933 | 16842 | 16741 | 16655 | 16534 | |
| 6.80 | | 4217 | 5697 | 10563 | 12260 | 13315 | 14073 | 14771 | 15367 | 15832 | 16171 | 16399 | 16538 | 16614 | 16646 | 16644 | 16602 | |
| 6.70 | | | | 18719 | 13920 | 13116 | 13360 | 13807 | 14270 | 14691 | 15048 | 15335 | 15555 | 15714 | 15819 | 15875 | 15906 | |
| 6.60 | | | | 15112 | 14991 | 14526 | 14187 | 14148 | 14280 | 14484 | 14702 | 14904 | 15074 | 15208 | 15303 | 15358 | 15939 | |
| 6.50 | | | | 14768 | 14797 | 14727 | 14613 | 14536 | 14523 | 14568 | 14647 | 14739 | 14828 | 14904 | 14960 | 14997 | 15022 | |
| 6.40 | | | | 14672 | 14720 | 14730 | 14712 | 14685 | 14663 | 14656 | 14664 | 14681 | 14703 | 14724 | 14742 | 14755 | 14765 | |
| 6.30 | | | | 14626 | 14685 | 14721 | 14732 | 14723 | 14700 | 14671 | 14640 | 14611 | 14584 | 14563 | 14546 | 14541 | 14535 | |
| 6.20 | | | | 14599 | 14675 | 14721 | 14734 | 14716 | 14672 | 14610 | 14538 | 14463 | 14391 | 14328 | 14279 | 14258 | 14239 | |
| 6.10 | | | | 14598 | 14696 | 14742 | 14735 | 14681 | 14587 | 14465 | 14329 | 14190 | 14059 | 13946 | 13859 | 13824 | 13799 | |
| 6.00 | | | | 14650 | 14772 | 14803 | 14747 | 14616 | 14429 | 14206 | 13969 | 13738 | 13527 | 13350 | 13218 | 13176 | 13154 | |
| 5.90 | | | | 14831 | 14598 | 14941 | 14779 | 14504 | 14157 | 13378 | 13401 | 13050 | 12743 | 12493 | 12314 | 12278 | 12282 | |
| 5.80 | | | | 15205 | 15358 | 15211 | 14821 | 14282 | 13686 | 13099 | 12558 | 12085 | 11688 | 11376 | 11163 | 11159 | 11221 | |
| 5.70 | | | | 16101 | 16208 | 15649 | 14728 | 13738 | 12845 | 12078 | 11429 | 10887 | 10446 | 10106 | 9883 | 9931 | 10072 | |
| 5.60 | | | | 18633 | 17958 | 15518 | 13693 | 12473 | 11555 | 10813 | 10191 | 9668 | 9238 | 8906 | 8693 | 8772 | 8975 | |
| 5.50 | | | | 25289 | 15348 | 13362 | 12171 | 11369 | 10669 | 10669 | 9429 | 8905 | 8469 | 8134 | 7914 | 7914 | 8127 | |
| 5.40 | | | 10431 | 13259 | 15977 | 14377 | 12887 | 11827 | 10871 | 10002 | 9420 | 8617 | 8143 | 7810 | 7601 | 7514 | 7527 | |
| 5.30 | 5017 | 7660 | 11331 | 13697 | 14947 | 14970 | 14065 | 12779 | 11396 | 10194 | 9295 | 8703 | 8342 | 8136 | 8032 | 8028 | 8125 | |
| 5.20 | 7557 | 9254 | 11538 | 13532 | 15072 | 15785 | 15148 | 13241 | 11193 | 10093 | 9516 | 9351 | 9310 | 9310 | 9348 | 9675 | 10036 | |
| 5.10 | 9413 | 10290 | 11486 | 12782 | 14324 | 16516 | 16335 | 10932 | 10644 | 11096 | 11416 | 11580 | 1674 | 11721 | 11782 | 12085 | 12368 | I |
| 5.00 | 10529 | 11278 | 12036 | 12896 | 14225 | 18027 | 3697 | 4735 | 5498 | 5680 | 5756 | 5773 | 5767 | 5755 | 5770 | 5781 | 5817 | |
| 4.90 | 11884 | 12297 | 12812 | 13458 | 14231 | 15190 | 4457 | 4709 | 5214 | 5474 | 5577 | 5604 | 5606 | 5599 | 5592 | 5585 | 5579 | |
| 4.80 | 13329 | 13278 | 13501 | 13713 | 6154 | 13316 | 5111 | 5084 | 5039 | 5045 | 5079 | 5132 | 5186 | 5231 | 5264 | 5283 | 5301 | |
| 4.70 | 14198 | 14104 | 14383 | 14230 | 11552 | 11014 | 6024 | 5442 | 4636 | 4563 | 4647 | 4758 | 54850 | 4942 | 5001 | 5037 | 5066 | |
| 4.60 | 41046 | 14110 | 14331 | 15545 | 15640 | 12486 | 8416 | 4820 | 4717 | 4675 | 4715 | 4773 | 4831 | 4882 | 4922 | 4939 | 4966 | |
| 4.50 | 13547 | 14008 | 14745 | 16692 | 15116 | 9973 | 5609 | 4424 | 4879 | 4896 | 4879 | 4873 | 4879 | 4892 | 4905 | 4879 | 4931 | |
| 4.40 | 13581 | 14131 | 14685 | 15374 | 16455 | 11317 | 3338 | 3673 | 4186 | 4434 | 4582 | 4668 | 4720 | 4754 | 4777 | 4801 | 4814 | |
| 4.30 | 13782 | 14478 | 14850 | 15115 | 15832 | 12336 | 3134 | 3340 | 3710 | 3963 | 4160 | 4304 | 4406 | 4476 | 4552 | 4559 | 4581 | |
| 4.20 | 13855 | 14253 | 14490 | 14728 | 14941 | 14931 | 3254 | 3356 | 3565 | 3734 | 3888 | 4016 | 4117 | 4192 | 4244 | 4281 | 4304 | |
| 4.10 | 13747 | 13836 | 14051 | 14152 | 14262 | 14000 | 3428 | 3477 | 3590 | 3685 | 3778 | 3862 | 3932 | 3986 | 4052 | 4051 | 4068 | |
| 4.00 | 13581 | 13603 | 13607 | 13578 | 13557 | 13521 | 3617 | 3638 | 3690 | 3731 | 3771 | 3808 | 3839 | 3864 | 3882 | 3893 | 3902 | |
| 3.90 | 13428 | 13322 | 13136 | 12902 | 12659 | 15936 | 3932 | 3925 | 3909 | 3879 | 3871 | 3810 | 3803 | 3798 | 3795 | 3793 | 3795 | |
| 3.80 | 13451 | 13277 | 13004 | 12671 | 12325 | 11948 | 4036 | 4042 | 3992 | 3934 | 3878 | 3828 | 3789 | 3760 | 3742 | 3733 | 3732 | |
| | A | | | | | | B | C | D | | | | | | | | | |

FIG. 3A

| | 0.5 | 0.10 | 0.15 | 0.20 | 0.25 | 0.30 | 0.35 | 0.40 | 0.45 | 0.50 | 0.55 | 0.60 | -0.65 | -0.70 | 0.75 | 0.80 |
|---|---|---|---|---|---|---|---|---|---|---|---|---|---|---|---|---|
| H | 9297 | 7568 | 7405 | 7704 | 8362 | 9413 | 10998 | 13254 | 20025 | 27577 | 15408 | 4892 | 1696 | 1130 | 947 | 830 |
| | 12389 | 12217 | 12678 | 13411 | 14390 | 15594 | 16896 | 17829 | 17696 | 16008 | 12957 | 9470 | 6450 | 4371 | 3198 | 3982 |
| | 13693 | 13733 | 14181 | 14827 | 15626 | 16491 | 17216 | 17472 | 16887 | 15261 | 12776 | 9915 | 7243 | 5136 | 3723 | 3220 |
| | 15732 | 15887 | 16177 | 13652 | 16893 | 17166 | 17223 | 16914 | 16101 | 14721 | 12782 | 10476 | 8083 | 5945 | 4376 | 3566 |
| | 16655 | 16741 | 16842 | 16933 | 16976 | 16920 | 16707 | 16281 | 15589 | 15470 | 13142 | 11173 | 8682 | 6165 | 4498 | 3721 |
| | 16644 | 16646 | 16614 | 16538 | 16399 | 16171 | 15832 | 15367 | 14771 | 14073 | 13315 | 12260 | 10563 | 5697 | 4217 | |
| | 15875 | 15819 | 15714 | 15555 | 15335 | 15048 | 14691 | 14270 | 13807 | 13360 | 13116 | 13920 | 18719 | | | |
| | 15358 | 15303 | 15208 | 15074 | 14904 | 14702 | 14484 | 14280 | 14148 | 14187 | 14526 | 14991 | 15112 | | | |
| | 14997 | 14960 | 14904 | 14828 | 14739 | 14647 | 14568 | 14523 | 14536 | 14613 | 14727 | 14797 | 14768 | | | |
| | 14755 | 14742 | 14724 | 14703 | 14681 | 14664 | 14656 | 14663 | 14685 | 14712 | 14730 | 14720 | 14672 | | | |
| | 14541 | 14546 | 14563 | 14584 | 14611 | 14640 | 14671 | 14700 | 14723 | 14732 | 14721 | 14685 | 14626 | | | |
| | 14258 | 14279 | 14328 | 14391 | 14463 | 14538 | 14610 | 14672 | 14716 | 14734 | 14721 | 14675 | 14599 | | | |
| | 13824 | 13859 | 13946 | 14059 | 14190 | 14329 | 14465 | 14587 | 14681 | 14735 | 14742 | 14696 | 14598 | | | |
| | 13176 | 13218 | 13350 | 13527 | 13738 | 13969 | 14206 | 14429 | 14616 | 14747 | 14803 | 14772 | 14650 | | | |
| | 12278 | 12314 | 12493 | 12743 | 13050 | 13401 | 13378 | 14157 | 14504 | 14779 | 14941 | 14598 | 14831 | | | |
| | 11159 | 11163 | 11376 | 11688 | 12085 | 12558 | 13099 | 13686 | 14282 | 14821 | 15211 | 15358 | 15205 | | | |
| | 9931 | 9883 | 10106 | 10446 | 10887 | 11429 | 12078 | 12845 | 13738 | 14728 | 15649 | 16208 | 16101 | | | |
| | 8772 | 8693 | 8906 | 9238 | 9668 | 10191 | 10813 | 11555 | 12473 | 13693 | 15518 | 17958 | 18633 | | | |
| | 7914 | 7914 | 8134 | 8469 | 8905 | 9429 | 10669 | 10669 | 11369 | 12171 | 13362 | 15348 | 25289 | | | |
| | 7514 | 7601 | 7810 | 8143 | 8617 | 9420 | 10002 | 10871 | 11827 | 12887 | 14377 | 15977 | 13259 | 10431 | | |
| | 8028 | 8032 | 8136 | 8342 | 8703 | 9295 | 10194 | 11396 | 12779 | 14065 | 14970 | 14947 | 13697 | 11331 | 7660 | 5017 |
| | 9675 | 9348 | 9310 | 9310 | 9351 | 9516 | 10093 | 11193 | 13241 | 15148 | 15785 | 15072 | 13532 | 11538 | 9254 | 7557 |
| | 12085 | 11782 | 11721 | 1674 | 11580 | 11416 | 11096 | 10644 | 10932 | 16335 | 16516 | 14324 | 12782 | 11486 | 10290 | 9413 |
| I | 5781 | 5770 | 5755 | 5767 | 5773 | 5756 | 5680 | 5498 | 4735 | 3697 | 18027 | 14225 | 12896 | 12036 | 11278 | 10529 |
| | 5585 | 5592 | 5599 | 5606 | 5604 | 5577 | 5474 | 5214 | 4709 | 4457 | 15190 | 14231 | 13458 | 12812 | 12297 | 11884 |
| | 5283 | 5264 | 5231 | 5186 | 5132 | 5079 | 5045 | 5039 | 5084 | 5111 | 13316 | 6154 | 13713 | 13501 | 13278 | 13329 |
| | 5037 | 5001 | 4942 | 54850 | 4758 | 4647 | 4563 | 4636 | 5442 | 6024 | 11014 | 11552 | 14230 | 14383 | 14104 | 14198 |
| | 4939 | 4922 | 4882 | 4831 | 4773 | 4715 | 4675 | 4717 | 4820 | 8416 | 12486 | 15640 | 15545 | 14331 | 14110 | 41046 |
| | 4879 | 4905 | 4892 | 4879 | 4873 | 4879 | 4896 | 4879 | 4424 | 5609 | 9973 | 15116 | 16692 | 14745 | 14008 | 13547 |
| | 4801 | 4777 | 4754 | 4720 | 4668 | 4582 | 4434 | 4186 | 3673 | 3338 | 11317 | 16455 | 15374 | 14685 | 14131 | 13581 |
| | 4559 | 4552 | 4476 | 4406 | 4304 | 4160 | 3963 | 3710 | 3340 | 3134 | 12336 | 15832 | 15115 | 14850 | 14478 | 13782 |
| | 4281 | 4244 | 4192 | 4117 | 4016 | 3888 | 3734 | 3565 | 3356 | 3254 | 14931 | 14941 | 14728 | 14490 | 14253 | 13855 |
| | 4051 | 4052 | 3986 | 3932 | 3862 | 3778 | 3685 | 3590 | 3477 | 3428 | 14000 | 14262 | 14152 | 14051 | 13836 | 13747 |
| | 3893 | 3882 | 3864 | 3839 | 3808 | 3771 | 3731 | 3690 | 3638 | 3617 | 13521 | 13557 | 13578 | 13607 | 13603 | 13581 |
| | 3793 | 3795 | 3798 | 3803 | 3810 | 3871 | 3879 | 3909 | 3925 | 3932 | 15936 | 12659 | 12902 | 13136 | 13322 | 13428 |
| | 3733 | 3742 | 3760 | 3789 | 3828 | 3878 | 3934 | 3992 | 4042 | 4036 | 11948 | 12325 | 12671 | 13004 | 13277 | 13451 |
| | | | | | | | | | E | F | G | | | | | |

FIG. 3B

| A | | | | | | B | C | D | | | | | | | | | |
|---|---|---|---|---|---|---|---|---|---|---|---|---|---|---|---|---|---|
| 3.70 | 13671 | 13308 | 12835 | 12267 | 11645 | 10697 | 4392 | 4318 | 4161 | 4033 | 3923 | 3841 | 3985 | 3750 | 3729 | 3721 | 3726 |
| 3.60 | 14108 | 13526 | 12190 | 12136 | 11089 | 9794 | 4796 | 4633 | 4288 | 4067 | 3939 | 3873 | 3841 | 3825 | 3819 | 3817 | 3828 |
| 3.50 | 14533 | 13855 | 13307 | 12626 | 11646 | 7902 | 5784 | 4830 | 4181 | 4121 | 4112 | 4105 | 4099 | 4094 | 4019 | 4091 | 4099 |
| 3.40 | 14522 | 14107 | 13921 | 13513 | 13143 | 11721 | 6969 | 6240 | 5264 | 4925 | 4761 | 4659 | 4591 | 4546 | 4518 | 4513 | 4514 |
| 3.30 | 13825 | 13979 | 14288 | 15058 | 15376 | 10177 | 5360 | 5470 | 5619 | 5412 | 5227 | 5092 | 4597 | 4932 | 4892 | 4897 | 1907 |
| 3.20 | 13227 | 13723 | 14113 | 15633 | 17094 | 12678 | 3858 | 4217 | 4741 | 4948 | 5032 | 5050 | 5043 | 5029 | 5020 | 5059 | 5092 |
| 3.10 | 13276 | 13716 | 14170 | 15072 | 15532 | 13583 | 3639 | 3855 | 4232 | 4470 | 4643 | 4759 | 4833 | 4679 | 4913 | 4985 | 5039 |
| 3.00 | 13417 | 13651 | 13952 | 14491 | 14718 | 14409 | 3721 | 3835 | 4057 | 4226 | 4375 | 4497 | 4591 | 4661 | 4714 | 4798 | 4860 |
| 2.90 | 13340 | 13460 | 13635 | 13979 | 14105 | 15177 | 3868 | 3926 | 4050 | 4157 | 4261 | 4355 | 4434 | 4498 | 4550 | 4628 | 4685 |
| 2.80 | 13110 | 13187 | 13305 | 13561 | 13638 | 15925 | 4049 | 4075 | 4140 | 4202 | 4268 | 4331 | 4388 | 4436 | 4477 | 4542 | 4592 |
| 2.70 | 12796 | 12870 | 12977 | 13214 | 13145 | 16910 | 4256 | 4264 | 4296 | 4330 | 4368 | 4407 | 4444 | 4477 | 4507 | 4560 | 4603 |
| 2.60 | 12434 | 12528 | 12653 | 12916 | 12866 | 17753 | 4488 | 4488 | 4503 | 4520 | 4542 | 4566 | 4589 | 4611 | 4632 | 4679 | 4716 |
| 2.50 | 12043 | 12162 | 12315 | 12646 | 12612 | 18708 | 4751 | 4747 | 4754 | 4765 | 4780 | 4796 | 4811 | 4826 | 4842 | 4887 | 4928 |
| 2.40 | 11615 | 11831 | 11942 | 12521 | 12592 | 19545 | 4958 | 5032 | 5054 | 5069 | 5080 | 5092 | 5103 | 5115 | 5129 | 5179 | 5224 |
| 2.30 | 11177 | 11318 | 11538 | 11786 | 12182 | 20735 | 5392 | 5381 | 5399 | 5421 | 5435 | 5449 | 5462 | 5474 | 5489 | 5549 | 5604 |
| 2.20 | 10697 | 10899 | 11143 | 11436 | 11939 | 22171 | 5784 | 5791 | 5818 | 5836 | 5856 | 5875 | 5892 | 5907 | 5927 | 6003 | 6073 |
| 2.10 | 10180 | 10427 | 10731 | 11098 | 11716 | 24171 | 6245 | 6258 | 6301 | 6330 | 6357 | 6382 | 6405 | 6426 | 6452 | 6551 | 6640 |
| 2.00 | 9621 | 9921 | 10292 | 10745 | 11503 | 24167 | 6777 | 6799 | 6862 | 6905 | 6946 | 6982 | 7014 | 7042 | 7077 | 7205 | 7320 |
| 1.90 | 9017 | 9377 | 9828 | 10378 | 11309 | 26047 | 7373 | 7418 | 7522 | 7588 | 7642 | 6790 | 7733 | 7742 | 7818 | 7984 | 8131 |
| 1.80 | 8364 | 8801 | 9353 | 10048 | 11167 | 28006 | 8140 | 8164 | 8279 | 8374 | 8453 | 8522 | 8581 | 8635 | 8696 | 8910 | 9097 |
| 1.70 | 7703 | 8203 | 8853 | 9671 | 10975 | 30385 | 8966 | 9029 | 9196 | 9310 | 9417 | 9510 | 9590 | 9661 | 9740 | 10012 | 10249 |
| 1.60 | 6968 | 8092 | 8829 | 9726 | 11193 | 33269 | 9923 | 10017 | 10729 | 10430 | 10572 | 10690 | 10793 | 10886 | 10990 | 11332 | 11628 |
| 1.50 | 6310 | 6926 | 7649 | 8517 | 9610 | 37424 | 25804 | 11214 | 11551 | 11752 | 11924 | 12083 | 12227 | 12357 | 12498 | 12929 | 11300 |
| 1.40 | 5602 | 6359 | 7166 | 8135 | 9363 | 40478 | 27134 | 12693 | 13032 | 13267 | 13520 | 13761 | 13977 | 14168 | 14363 | 14902 | 15364 |
| 1.30 | 5677 | 6439 | 7243 | 8233 | 9596 | 44329 | 33652 | 14619 | 14859 | 15198 | 15562 | 15904 | 16203 | 16458 | 16705 | 17357 | 17915 |
| 1.20 | 5877 | 6627 | 7423 | 8438 | 9877 | 56560 | 36741 | 16453 | 17612 | 17714 | 18224 | 18661 | 19015 | 19296 | 19562 | 20290 | 20925 |
| 1.10 | 6626 | 7305 | 8043 | 9068 | 10609 | 13363 | 40023 | 18594 | 19946 | 20864 | 21540 | 22002 | 22306 | 22510 | 22706 | 23413 | 24049 |
| 1.00 | 7800 | 8274 | 8899 | 9928 | 11635 | 14917 | 65207 | 19384 | 21484 | 23920 | 24887 | 25374 | 25542 | 25539 | 25484 | 25482 | 26531 |

FIG. 3C

| | | | | | | | | E | F | G | | | | | |
|---|---|---|---|---|---|---|---|---|---|---|---|---|---|---|---|
| 3721 | 3729 | 3750 | 3985 | 3841 | 3923 | 4033 | 4161 | 4318 | 4392 | 10697 | 11645 | 12267 | 12835 | 13308 | 13671 |
| 3817 | 3819 | 3825 | 3841 | 3873 | 3939 | 4067 | 4288 | 4633 | 4796 | 9794 | 11089 | 12136 | 12190 | 13526 | 14108 |
| 4091 | 4019 | 4094 | 4099 | 4105 | 4112 | 4121 | 4181 | 4830 | 5784 | 7902 | 11646 | 12626 | 13307 | 13855 | 14533 |
| 4513 | 4518 | 4546 | 4591 | 4659 | 4761 | 4925 | 5264 | 6240 | 6969 | 11721 | 13143 | 13513 | 13921 | 14107 | 14522 |
| 4897 | 4892 | 4932 | 4597 | 5092 | 5227 | 5412 | 5619 | 5470 | 5360 | 10177 | 15376 | 15058 | 14288 | 13979 | 13825 |
| 5059 | 5020 | 5029 | 5043 | 5050 | 5032 | 4948 | 4741 | 4217 | 3858 | 12678 | 17094 | 15633 | 14113 | 13723 | 13227 |
| 4985 | 4913 | 4679 | 4833 | 4759 | 4643 | 4470 | 4232 | 3855 | 3639 | 13583 | 15532 | 15072 | 14170 | 13716 | 13276 |
| 4798 | 4714 | 4661 | 4591 | 4497 | 4375 | 4226 | 4057 | 3835 | 3721 | 14409 | 14718 | 14491 | 13952 | 13651 | 13417 |
| 4628 | 4550 | 4498 | 4434 | 4355 | 4261 | 4157 | 4050 | 3926 | 3868 | 15177 | 14105 | 13979 | 13635 | 13460 | 13340 |
| 4542 | 4477 | 4436 | 4388 | 4331 | 4268 | 4202 | 4140 | 4075 | 4049 | 15925 | 13638 | 13561 | 13305 | 13187 | 13110 |
| 4560 | 4507 | 4477 | 4444 | 4407 | 4368 | 4330 | 4296 | 4264 | 4256 | 16910 | 13145 | 13214 | 12977 | 12870 | 12796 |
| 4679 | 4632 | 4611 | 4589 | 4566 | 4542 | 4520 | 4503 | 4488 | 4488 | 17753 | 12866 | 12916 | 12653 | 12528 | 12434 |
| 4887 | 4842 | 4826 | 4811 | 4796 | 4780 | 4765 | 4754 | 4747 | 4751 | 18708 | 12612 | 12646 | 12315 | 12162 | 12043 |
| 5179 | 5129 | 5115 | 5103 | 5092 | 5080 | 5069 | 5054 | 5032 | 4958 | 19545 | 12592 | 12521 | 11942 | 11831 | 11615 |
| 5549 | 5489 | 5474 | 5462 | 5449 | 5435 | 5421 | 5399 | 5381 | 5392 | 20735 | 12182 | 11786 | 11538 | 11318 | 11177 |
| 6003 | 5927 | 5907 | 5892 | 5875 | 5856 | 5836 | 5818 | 5791 | 5784 | 22171 | 11939 | 11436 | 11143 | 10899 | 10697 |
| 6551 | 6452 | 6426 | 6405 | 6382 | 6357 | 6330 | 6301 | 6258 | 6245 | 24171 | 11716 | 11098 | 10731 | 10427 | 10180 |
| 7205 | 7077 | 7042 | 7014 | 6982 | 6946 | 6905 | 6862 | 6799 | 6777 | 24167 | 11503 | 10745 | 10292 | 9921 | 9621 |
| 7984 | 7818 | 7742 | 7733 | 6790 | 7642 | 7588 | 7522 | 7418 | 7373 | 26047 | 11309 | 10378 | 9828 | 9377 | 9017 |
| 8910 | 8696 | 8635 | 8581 | 8522 | 8453 | 8374 | 8279 | 8164 | 8140 | 28006 | 11167 | 10048 | 9353 | 8801 | 8364 |
| 10012 | 9740 | 9661 | 9590 | 9510 | 9417 | 9310 | 9196 | 9029 | 8966 | 30385 | 10975 | 9671 | 8853 | 8203 | 7703 |
| 11332 | 10990 | 10886 | 10793 | 10690 | 10572 | 10430 | 10729 | 10017 | 9923 | 33269 | 11193 | 9726 | 8829 | 8092 | 6968 |
| 12929 | 12498 | 12357 | 12227 | 12083 | 11924 | 11752 | 11551 | 11214 | 25804 | 37424 | 9610 | 8517 | 7649 | 6926 | 6310 |
| 14902 | 14363 | 14168 | 13977 | 13761 | 13520 | 13267 | 13032 | 12693 | 27134 | 40478 | 9363 | 8135 | 7166 | 6359 | 5602 |
| 17357 | 16705 | 16458 | 16203 | 15904 | 15562 | 15198 | 14859 | 14619 | 33652 | 44329 | 9596 | 8233 | 7243 | 6439 | 5677 |
| 20290 | 19562 | 19296 | 19015 | 18661 | 18224 | 17714 | 17612 | 16453 | 36741 | 56560 | 9877 | 8438 | 7423 | 6627 | 5877 |
| 23413 | 22706 | 22510 | 22306 | 22002 | 21540 | 20864 | 19946 | 18594 | 40023 | 13363 | 10609 | 9068 | 8043 | 7305 | 6626 |
| 25482 | 25484 | 25539 | 25542 | 25374 | 24887 | 23920 | 21484 | 19384 | 65207 | 14917 | 11635 | 9928 | 8899 | 8274 | 7800 |

FIG. 3D

| Y AXIS | -0.80 | -0.75 | -0.70 | -0.65 | -0.60 | -0.55 | -0.50 | -0.45 | -0.40 | -0.35 | -0.30 | -0.25 | -0.20 | -0.15 | -0.10 | -0.05 | 0.00 |
|---|---|---|---|---|---|---|---|---|---|---|---|---|---|---|---|---|---|
| 7.30 | 830 | 947 | 1129 | 1696 | 4892 | 15410 | 27258 | 20024 | 13252 | 10996 | 9411 | 98360 | 7702 | 7402 | 7566 | 9296 | 10953 |
| 7.20 | 2561 | 2564 | 3403 | 5291 | 8818 | 13397 | 17423 | 19174 | 18161 | 16013 | 14145 | 12733 | 11682 | 10947 | 10550 | 11075 | 11725 |
| 7.10 | 3220 | 3724 | 5137 | 7244 | 9917 | 12717 | 15262 | 16887 | 17472 | 17215 | 16488 | 15623 | 14824 | 14177 | 13729 | 13689 | 13715 |
| 7.00 | 3566 | 4377 | 5946 | 8084 | 10477 | 12783 | 14714 | 16102 | 16913 | 17222 | 17164 | 16889 | 16528 | 16172 | 15883 | 15727 | 15569 |
| 6.90 | 3721 | 4499 | 6166 | 8685 | 1176 | 13144 | 14572 | 15589 | 16280 | 16705 | 16917 | 16972 | 16929 | 16837 | 16736 | 16529 | 16529 |
| 6.80 | | 4217 | 5697 | 10563 | 12260 | 13315 | 14072 | 14771 | 15367 | 15833 | 16172 | 16400 | 16540 | 16616 | 16649 | 16647 | 16606 |
| 6.70 | | | | 18718 | 13500 | 12494 | 12677 | 13346 | 13965 | 15004 | 15384 | 15676 | 15889 | 16308 | 16131 | 16175 | 16188 |
| 6.60 | | | | 15110 | 18718 | 13919 | 13115 | 13360 | 13807 | 14693 | 15051 | 15082 | 15287 | 15441 | 15547 | 15606 | 15640 |
| 6.50 | | | | 14666 | 15110 | 14990 | 14525 | 14187 | 14148 | 14487 | 14706 | 14909 | 15080 | 15215 | 15310 | 15365 | 15057 |
| 6.40 | | | | 14617 | 14666 | 14715 | 14727 | 14711 | 14686 | 14662 | 14671 | 14691 | 14714 | 14736 | 14754 | 14769 | 14839 |
| 6.30 | | | | 14599 | 14617 | 14678 | 14717 | 14730 | 14729 | 14670 | 14649 | 14622 | 14597 | 14576 | 14561 | 14556 | 14674 |
| 6.20 | | | | 14577 | 14599 | 14669 | 14714 | 14732 | 14724 | 14657 | 14610 | 14561 | 14514 | 14474 | 14442 | 14429 | 14479 |
| 6.10 | | | | 14589 | 14671 | 14720 | 14671 | 14720 | 14712 | 14592 | 14511 | 14426 | 14347 | 14277 | 14224 | 14140 | 14184 |
| 6.00 | | | | 14586 | 14681 | 14730 | 14732 | 14690 | 14614 | 14514 | 14402 | 14289 | 14185 | 14095 | 14028 | 13811 | 13739 |
| 5.90 | | | | 14666 | 14803 | 14822 | 14732 | 14556 | 14328 | 14078 | 13832 | 13607 | 13413 | 13258 | 13148 | 13124 | 13120 |
| 5.80 | | | | 14889 | 15053 | 14978 | 14712 | 14332 | 13918 | 13520 | 13168 | 12870 | 12628 | 12444 | 12320 | 12321 | 12352 |
| 5.70 | | | | 15481 | 15633 | 15221 | 14514 | 13776 | 13148 | 12643 | 12243 | 11928 | 11682 | 11500 | 11385 | 11429 | 11513 |
| 5.60 | | | | 17392 | 16897 | 14849 | 13415 | 12551 | 11970 | 11548 | 11222 | 10962 | 10754 | 10595 | 10496 | 10578 | 10713 |
| 5.50 | | | | 22610 | 14205 | 12735 | 11934 | 11499 | 11168 | 10887 | 10630 | 10395 | 10186 | 10012 | 9891 | 9926 | 10098 |
| 5.40 | | | 9178 | 11724 | 14328 | 13229 | 12224 | 14646 | 11191 | 10797 | 10434 | 10097 | 9793 | 9535 | 9346 | 9310 | 9280 |
| 5.30 | 4489 | 6825 | 9966 | 11918 | 12938 | 13088 | 12722 | 12173 | 11601 | 11046 | 10520 | 10030 | 9590 | 9214 | 8927 | 8783 | 8800 |
| 5.20 | 6947 | 8387 | 10226 | 11581 | 12404 | 12728 | 12646 | 12282 | 11752 | 11140 | 10506 | 9884 | 9302 | 8793 | 8387 | 8114 | 8025 |
| 5.10 | 9255 | 9579 | 10415 | 11308 | 11984 | 12337 | 12356 | 12069 | 11565 | 10917 | 10229 | 9554 | 8885 | 8292 | 7794 | 7441 | 7357 |
| 5.00 | 10612 | 10605 | 10962 | 11476 | 11947 | 12206 | 12146 | 11757 | 11040 | 10326 | 9503 | 8951 | 8455 | 8022 | 7707 | 7217 | 7651 |
| 4.90 | 11368 | 11355 | 11520 | 11831 | 12219 | 12455 | 12157 | 11282 | 10030 | 9034 | 8204 | 8278 | 8292 | 9283 | 10185 | 7638 | 7207 |
| 4.80 | 11899 | 11949 | 11881 | 11836 | 12032 | 12595 | 13460 | 9277 | 8385 | 5915 | 6223 | 664 | 4381 | 4956 | 4842 | 4263 | 4373 |
| 4.70 | 12842 | 12766 | 12501 | 12217 | 12202 | 14230 | 16214 | 4290 | 5132 | 4502 | 4683 | 4742 | 4591 | 4489 | 4484 | 4464 | 4421 |
| 4.60 | 14439 | 13961 | 13625 | 13315 | 12885 | 11993 | 11596 | 4742 | 4586 | 4560 | 4571 | 4593 | 4608 | 4601 | 4586 | 4580 | 4582 |
| 4.50 | 15891 | 15173 | 15010 | 14461 | 13212 | 10483 | 8927 | 5030 | 4644 | 4721 | 4766 | 4792 | 4804 | 4806 | 4806 | 4821 | 4833 |
| 4.40 | 15703 | 15811 | 16414 | 17214 | 14023 | 11158 | 4834 | 5071 | 5290 | 5156 | 5063 | 5014 | 4989 | 4975 | 4970 | 5004 | 5030 |
| 4.30 | 14270 | 15385 | 16039 | 18582 | 8017 | 10811 | 3749 | 4025 | 4503 | 4695 | 4794 | 4845 | 4876 | 4895 | 4916 | 4975 | 5020 |
| 4.20 | 14155 | 15619 | 17192 | 16974 | 19732 | 9902 | 2936 | 3202 | 3687 | 3988 | 4216 | 4383 | 4501 | 4585 | 4645 | 4727 | 4785 |
| 4.10 | 14739 | 15648 | 16671 | 17894 | 18439 | 10051 | 2589 | 2806 | 3207 | 3498 | 3746 | 3948 | 4106 | 4224 | 4310 | 4396 | 4454 |
| 4.00 | 14886 | 15286 | 15797 | 16374 | 16613 | 11012 | 2710 | 2856 | 3134 | 3343 | 3541 | 3717 | 3863 | 3978 | 4032 | 4134 | 4181 |
| 3.90 | 14685 | 14803 | 14976 | 15123 | 15184 | 11974 | 3190 | 3201 | 3320 | 3450 | 3584 | 3708 | 3816 | 3902 | 3966 | 4014 | 4045 |
| 3.80 | 14262 | 14225 | 14190 | 14168 | 14040 | 13018 | 3435 | 3490 | 3626 | 3712 | 3792 | 3862 | 3922 | 3968 | 4002 | 4023 | 4038 |

A B C D E F L M

FIG. 4A

| 0.5 | 0.10 | 0.15 | 0.20 | 0.25 | 0.30 | 0.35 | 0.40 | 0.45 | 0.50 | 0.55 | 0.60 | -0.65 | -0.70 | 0.75 | 0.80 |
|---|---|---|---|---|---|---|---|---|---|---|---|---|---|---|---|
| 9296 | 7566 | 7402 | 7702 | 98360 | 9411 | 10996 | 13252 | 20024 | 27258 | 15410 | 4892 | 1696 | 1129 | 947 | 830 |
| 11075 | 10550 | 10947 | 11682 | 12733 | 14145 | 16013 | 18161 | 19174 | 17423 | 13397 | 8818 | 5291 | 3403 | 2564 | 2561 |
| 13689 | 13729 | 14177 | 14824 | 15623 | 16488 | 17215 | 17472 | 16887 | 15262 | 12717 | 9917 | 7244 | 5137 | 3724 | 3220 |
| 15727 | 15883 | 16172 | 16528 | 16889 | 17164 | 17222 | 16913 | 16102 | 14714 | 12783 | 10477 | 8084 | 5946 | 4377 | 3566 |
| 16529 | 16736 | 16837 | 16929 | 16972 | 16917 | 16705 | 16280 | 15589 | 14572 | 13144 | 1176 | 8685 | 6166 | 4499 | 3721 |
| 16647 | 16649 | 16616 | 16540 | 16400 | 16172 | 15833 | 15367 | 14771 | 14072 | 13315 | 12260 | 10563 | 5697 | 4217 | |
| 16175 | 16131 | 16308 | 15889 | 15676 | 15384 | 15004 | 13965 | 13346 | 12677 | 12494 | 13500 | 18718 | | | |
| 15606 | 15547 | 15441 | 15287 | 15082 | 15051 | 14693 | 13807 | 13360 | 13115 | 13919 | 18718 | 15110 | | | |
| 15365 | 15310 | 15215 | 15080 | 14909 | 14706 | 14487 | 14148 | 14187 | 14525 | 14990 | 15110 | 14666 | | | |
| 14769 | 14754 | 14736 | 14714 | 14691 | 14671 | 14662 | 14686 | 14711 | 14727 | 14715 | 14666 | 14617 | | | |
| 14556 | 14561 | 14576 | 14597 | 14622 | 14649 | 14670 | 14729 | 14730 | 14717 | 14678 | 14617 | 14599 | | | |
| 14429 | 14442 | 14474 | 14514 | 14561 | 14610 | 14657 | 14724 | 14732 | 14714 | 14669 | 14599 | 14577 | | | |
| 14140 | 14224 | 14277 | 14347 | 14426 | 14511 | 14592 | 14712 | 14720 | 14671 | 14720 | 14671 | 14589 | | | |
| 13811 | 14028 | 14095 | 14185 | 14289 | 14402 | 14514 | 14614 | 14690 | 14732 | 14730 | 14681 | 14586 | | | |
| 13124 | 13148 | 13258 | 13413 | 13607 | 13832 | 14078 | 14328 | 14556 | 14732 | 14822 | 14803 | 14666 | | | |
| 12321 | 12320 | 12444 | 12628 | 12870 | 13168 | 13520 | 13918 | 14332 | 14712 | 14978 | 15053 | 14889 | | | |
| 11429 | 11385 | 11500 | 11682 | 11928 | 12243 | 12643 | 13148 | 13776 | 14514 | 15221 | 15633 | 15481 | | | |
| 10578 | 10496 | 10595 | 10754 | 10962 | 11222 | 11548 | 11970 | 12551 | 13415 | 14849 | 16897 | 17392 | | | |
| 9926 | 9891 | 10012 | 10186 | 10395 | 10630 | 10887 | 11168 | 11499 | 11934 | 12735 | 14205 | 22610 | | | |
| 9310 | 9346 | 9535 | 9793 | 10097 | 10434 | 10797 | 11191 | 14646 | 12224 | 13229 | 14328 | 11724 | 9178 | | |
| 8783 | 8927 | 9214 | 9590 | 10030 | 10520 | 11046 | 11601 | 12173 | 12722 | 13088 | 12938 | 11918 | 9966 | 6825 | 4489 |
| 8114 | 8387 | 8793 | 9302 | 9884 | 10506 | 11140 | 11752 | 12282 | 12646 | 12728 | 12404 | 11581 | 10226 | 8387 | 6947 |
| 7441 | 7794 | 8292 | 8885 | 9554 | 10229 | 10917 | 11565 | 12069 | 12356 | 12337 | 11984 | 11308 | 10415 | 9579 | 9255 |
| 7217 | 7707 | 8022 | 8455 | 8951 | 9503 | 10326 | 11040 | 11757 | 12146 | 12206 | 11947 | 11476 | 10962 | 10605 | 10612 |
| 7638 | 10185 | 9283 | 8292 | 8278 | 8204 | 9034 | 10030 | 11282 | 12157 | 12455 | 12219 | 11831 | 11520 | 11355 | 11368 |
| 4263 | 4842 | 4956 | 4381 | 664 | 6223 | 5915 | 8385 | 9277 | 13460 | 12595 | 12032 | 11836 | 11881 | 11949 | 11899 |
| 4464 | 4484 | 4489 | 4591 | 4742 | 4683 | 4502 | 5132 | 4290 | 16214 | 14023 | 12202 | 12217 | 12501 | 12766 | 12842 |
| 4580 | 4586 | 4601 | 4608 | 4593 | 4571 | 4560 | 4586 | 4742 | 11596 | 11993 | 12885 | 13315 | 13625 | 13961 | 14439 |
| 4821 | 4806 | 4806 | 4804 | 4792 | 4766 | 4721 | 4644 | 5030 | 8927 | 10483 | 13212 | 14461 | 15010 | 15173 | 15891 |
| 5004 | 4970 | 4975 | 4989 | 5014 | 5063 | 5156 | 5290 | 5071 | 4834 | 11158 | 14203 | 17214 | 16414 | 15811 | 15703 |
| 4975 | 4916 | 4895 | 4876 | 4845 | 4794 | 4695 | 4503 | 4025 | 3749 | 10811 | 8017 | 18582 | 16039 | 15385 | 14270 |
| 4727 | 4645 | 4585 | 4501 | 4383 | 4216 | 3988 | 3687 | 3202 | 2936 | 9902 | 19732 | 16974 | 17192 | 15619 | 14155 |
| 4396 | 4310 | 4224 | 4106 | 3948 | 3746 | 3498 | 3207 | 2806 | 2589 | 10051 | 18439 | 17894 | 16671 | 15648 | 14739 |
| 4134 | 4032 | 3978 | 3863 | 3717 | 3541 | 3343 | 3134 | 2856 | 2710 | 11012 | 16613 | 16374 | 15797 | 15286 | 14886 |
| 4014 | 3966 | 3902 | 3816 | 3708 | 3584 | 3450 | 3320 | 3201 | 3190 | 11974 | 15184 | 15123 | 14976 | 14803 | 14685 |
| 4023 | 4002 | 3968 | 3922 | 3862 | 3792 | 3712 | 3626 | 3490 | 3435 | 13018 | 14040 | 14168 | 14190 | 14225 | 14262 |

L M G H I J K

FIG. 4B

| | A | | | | | B | C | D | E | F | | | | | | | | | |
|---|---|---|---|---|---|---|---|---|---|---|---|---|---|---|---|---|---|---|---|
| 3.70 | 13837 | 13717 | 13551 | 13350 | 13056 | 13891 | | 3719 | 3818 | 3988 | 4046 | 4079 | 4095 | 4100 | 4100 | 4097 | 4094 | 4092 |
| 3.60 | 13504 | 13284 | 12960 | 12576 | 12075 | 11827 | | 4537 | 4403 | 4445 | 4433 | 4392 | 4325 | 4259 | 4203 | 4163 | 4141 | 4129 |
| 3.50 | 13372 | 12988 | 12444 | 11814 | 11017 | 10645 | | 4857 | 4993 | 5051 | 4438 | 4611 | 4432 | 4296 | 4199 | 4136 | 4116 | 4114 |
| 3.40 | 13544 | 12878 | 12032 | 11074 | 9875 | 9338 | | 7818 | 5640 | 5159 | 4813 | 4541 | 4344 | 4207 | 4118 | 4067 | 4073 | 4102 |
| 3.30 | 14026 | 13021 | 11968 | 10605 | 8655 | 7858 | | 7872 | 6995 | 5438 | 4819 | 4501 | 4328 | 4231 | 4175 | 4149 | 4168 | 4216 |
| 3.20 | 14350 | 14350 | 13356 | 12709 | 11615 | 8239 | | 10302 | 7895 | 5705 | 5146 | 4883 | 4731 | 4638 | 4581 | 4549 | 4543 | 4565 |
| 3.10 | 13776 | 13361 | 13264 | 13011 | 10590 | 8193 | | 6458 | 6190 | 6141 | 5822 | 5603 | 5443 | 5326 | 5243 | 5188 | 5155 | 5140 |
| 3.00 | 12442 | 12879 | 13067 | 14734 | 17083 | 13658 | | 5111 | 5433 | 5979 | 6044 | 6006 | 5937 | 5867 | 5808 | 5764 | 5746 | 5732 |
| 2.90 | 11893 | 12739 | 13514 | 15402 | 16450 | 13279 | | 4085 | 4534 | 5291 | 5644 | 5856 | 5964 | 6016 | 6037 | 6046 | 6077 | 6095 |
| 2.80 | 12116 | 12831 | 13619 | 14629 | 15080 | 14612 | | 5460 | 4266 | 4904 | 5269 | 5552 | 5756 | 5896 | 5988 | 6050 | 6125 | 6172 |
| 2.70 | 12166 | 12509 | 12934 | 13971 | 14216 | 16263 | | 4301 | 4481 | 4839 | 5124 | 5378 | 5581 | 5738 | 5852 | 5935 | 6025 | 6083 |
| 2.60 | 11966 | 12212 | 12544 | 12909 | 13362 | 17525 | | 4615 | 4762 | 5053 | 5234 | 5400 | 5547 | 5671 | 5769 | 5843 | 5922 | 5976 |
| 2.50 | 11551 | 11801 | 12112 | 12469 | 12882 | 12963 | | 5331 | 5245 | 5350 | 5449 | 5550 | 5644 | 5726 | 5792 | 5844 | 5900 | 5941 |
| 2.40 | 11011 | 11311 | 11622 | 11934 | 14262 | 22292 | | 5857 | 5818 | 5783 | 5798 | 5831 | 5868 | 5901 | 5929 | 5952 | 5982 | 6009 |
| 2.30 | 10445 | 10813 | 11172 | 11550 | 12133 | 12339 | | 6323 | 6300 | 6284 | 6251 | 6221 | 6195 | 6173 | 6156 | 6146 | 6150 | 6162 |
| 2.20 | 9908 | 10324 | 10688 | 11053 | 11674 | 11901 | | 16688 | 6872 | 6813 | 6740 | 6653 | 6567 | 6490 | 6429 | 6386 | 6370 | 6371 |
| 2.10 | 9481 | 9884 | 10166 | 10455 | 11100 | 11348 | | 18334 | 5719 | 7430 | 7275 | 7100 | 6938 | 6808 | 6716 | 6658 | 6638 | 6643 |
| 2.00 | 9338 | 9591 | 9664 | 9731 | 10379 | 10636 | | 20504 | 8434 | 8206 | 7810 | 7482 | 7274 | 7150 | 7079 | 7044 | 7054 | 7087 |
| 1.90 | 9568 | 9561 | 9505 | 9372 | 9315 | 9509 | | 17005 | 10210 | 8502 | 8061 | 7881 | 7803 | 7768 | 7756 | 7761 | 6832 | 7912 |
| 1.80 | 9902 | 9748 | 9954 | 10202 | 10629 | 10261 | | 18926 | 12217 | 9940 | 9407 | 9172 | 9053 | 8988 | 8954 | 8954 | 9099 | 9240 |
| 1.70 | 9580 | 9615 | 10173 | 10962 | 11133 | 11468 | | 10180 | 10627 | 11192 | 11000 | 10765 | 10587 | 10468 | 10397 | 10384 | 10633 | 10865 |
| 1.60 | 8652 | 8962 | 9422 | 10057 | 12325 | 13468 | | 8742 | 9519 | 10787 | 11236 | 11438 | 11515 | 11540 | 11555 | 11606 | 12007 | 12356 |
| 1.50 | 7756 | 8361 | 9155 | 10267 | 12395 | 12990 | | 8753 | 9302 | 10435 | 11101 | 11578 | 11906 | 12129 | 12287 | 12446 | 13008 | 13467 |
| 1.40 | 6945 | 7790 | 8951 | 10323 | 12421 | 13195 | | 9891 | 10198 | 10873 | 11417 | 11902 | 12298 | 12608 | 12850 | 13081 | 13750 | 14283 |
| 1.30 | 5890 | 7297 | 8816 | 10484 | 12879 | 40391 | | 11050 | 11279 | 11829 | 12243 | 12632 | 12975 | 13264 | 13506 | 13748 | 14454 | 15018 |
| 1.20 | 5567 | 7068 | 8801 | 10726 | 13494 | 46560 | | 12264 | 12484 | 13003 | 13343 | 13644 | 13907 | 14134 | 14333 | 14548 | 15238 | 15800 |
| 1.10 | 5808 | 7159 | 9045 | 11255 | 14429 | 48078 | | 13514 | 13799 | 14327 | 14565 | 14773 | 14961 | 15127 | 15277 | 15455 | 16099 | 16635 |
| 1.00 | 6016 | 7511 | 9646 | 12258 | 16003 | 54900 | | 15642 | 15415 | 15580 | 15759 | 15911 | 16041 | 16154 | 16260 | 16399 | 16979 | 17471 |

FIG. 4C

| | | | | | | | | G | H | I | J | K | | | | | |
|---|---|---|---|---|---|---|---|---|---|---|---|---|---|---|---|---|---|
| 4094 | 4097 | 4100 | 4100 | 4095 | 4079 | 4046 | 3988 | 3818 | 3719 | 13891 | 13056 | 13350 | 13551 | 13717 | 13837 |
| 4141 | 4163 | 4203 | 4259 | 4325 | 4392 | 4433 | 4445 | 4403 | 4537 | 11827 | 12075 | 12576 | 12960 | 13284 | 13504 |
| 4116 | 4136 | 4199 | 4296 | 4432 | 4611 | 4438 | 5051 | 4993 | 4857 | 10645 | 11017 | 11814 | 12444 | 12988 | 13372 |
| 4073 | 4067 | 4118 | 4207 | 4344 | 4541 | 4813 | 5159 | 5640 | 7818 | 9338 | 9875 | 11074 | 12032 | 12878 | 13544 |
| 4168 | 4149 | 4175 | 4231 | 4328 | 4501 | 4819 | 5438 | 6995 | 7872 | 7858 | 8655 | 10605 | 11968 | 13021 | 14026 |
| 4543 | 4549 | 4581 | 4638 | 4731 | 4883 | 5146 | 5705 | 7895 | 10302 | 8239 | 11615 | 12709 | 13356 | 14350 | 14350 |
| 5155 | 5188 | 5243 | 5326 | 5443 | 5603 | 5822 | 6141 | 6190 | 6458 | 8193 | 10590 | 13011 | 13264 | 13361 | 13776 |
| 5746 | 5764 | 5808 | 5867 | 5937 | 6006 | 6044 | 5979 | 5433 | 5111 | 13658 | 17083 | 14734 | 13067 | 12879 | 12442 |
| 6077 | 6046 | 6037 | 6016 | 5964 | 5856 | 5644 | 5291 | 4534 | 4085 | 13279 | 16450 | 15402 | 13514 | 12739 | 11893 |
| 6125 | 6050 | 5988 | 5896 | 5756 | 5552 | 5269 | 4904 | 4266 | 5460 | 14612 | 15080 | 14629 | 13619 | 12831 | 12116 |
| 6025 | 5935 | 5852 | 5738 | 5581 | 5378 | 5124 | 4839 | 4481 | 4301 | 16263 | 14216 | 13971 | 12934 | 12509 | 12166 |
| 5922 | 5843 | 5769 | 5671 | 5547 | 5400 | 5234 | 5053 | 4762 | 4615 | 17525 | 13362 | 12909 | 12544 | 12212 | 11966 |
| 5900 | 5844 | 5792 | 5726 | 5644 | 5550 | 5449 | 5350 | 5245 | 5331 | 12963 | 12882 | 12469 | 12112 | 11801 | 11551 |
| 5982 | 5952 | 5929 | 5901 | 5868 | 5831 | 5798 | 5783 | 5818 | 5857 | 22292 | 14262 | 11934 | 11622 | 11311 | 11011 |
| 6150 | 6146 | 6156 | 6173 | 6195 | 6221 | 6251 | 6284 | 6300 | 6323 | 12339 | 12133 | 11550 | 11172 | 10813 | 10445 |
| 6370 | 6386 | 6429 | 6490 | 6567 | 6653 | 6740 | 6813 | 6872 | 16688 | 11901 | 11674 | 11053 | 10688 | 10324 | 9908 |
| 6638 | 6658 | 6716 | 6808 | 6938 | 7100 | 7275 | 7430 | 5719 | 18334 | 11348 | 11100 | 10455 | 10166 | 9884 | 9481 |
| 7054 | 7044 | 7079 | 7150 | 7274 | 7482 | 7810 | 8206 | 8434 | 20504 | 10636 | 10379 | 9731 | 9664 | 9591 | 9338 |
| 6832 | 7761 | 7756 | 7768 | 7803 | 7881 | 8061 | 8502 | 10210 | 17005 | 9509 | 9315 | 9372 | 9505 | 9561 | 9568 |
| 9099 | 8954 | 8954 | 8988 | 9053 | 9172 | 9407 | 9940 | 12217 | 18926 | 10261 | 10629 | 10202 | 9954 | 9748 | 9902 |
| 10633 | 10384 | 10397 | 10468 | 10587 | 10765 | 11000 | 11192 | 10627 | 10180 | 11468 | 11133 | 10962 | 10173 | 9615 | 9580 |
| 12007 | 11606 | 11555 | 11540 | 11515 | 11438 | 11236 | 10787 | 9519 | 8742 | 13468 | 12325 | 10057 | 9422 | 8962 | 8652 |
| 13008 | 12446 | 12287 | 12129 | 11906 | 11578 | 11101 | 10435 | 9302 | 8753 | 12990 | 12395 | 10267 | 9155 | 8361 | 7756 |
| 13750 | 13081 | 12850 | 12608 | 12298 | 11902 | 11417 | 10873 | 10198 | 9891 | 13195 | 12421 | 10323 | 8951 | 7790 | 6945 |
| 14454 | 13748 | 13506 | 13264 | 12975 | 12632 | 12243 | 11829 | 11279 | 11050 | 40391 | 12879 | 10484 | 8816 | 7297 | 5890 |
| 15238 | 14548 | 14333 | 14134 | 13907 | 13644 | 13343 | 13003 | 12484 | 12264 | 46560 | 13494 | 10726 | 8801 | 7068 | 5567 |
| 16099 | 15455 | 15277 | 15127 | 14961 | 14773 | 14565 | 14327 | 13799 | 13514 | 48078 | 14429 | 11255 | 9045 | 7159 | 5808 |
| 16979 | 16399 | 16260 | 16154 | 16041 | 15911 | 15759 | 15580 | 15415 | 15642 | 54900 | 16003 | 12258 | 9646 | 7511 | 6016 |

FIG. 4D

FIBERGLASS SUCKER ROD END FITTING

RELATED APPLICATION

This Application is a continuation of U.S. patent application Ser. No. 08/936,348 filed Sep. 24, 1997.

FIELD OF INVENTION

The present invention relates to an end fitting or connector for connecting rods end-to-end, and particularly fiberglass or composite sucker rods for use in an oil well.

BACKGROUND OF THE INVENTION

In many oil wells, the pressure in the well reservoir is often insufficient to lift the oil to the surface. In such cases, it is conventional to use a sub-surface pump to force the oil out of the well. The sub-surface pump is driven by a pumping unit located at the surface. The pumping unit is connected to the sub-surface pump by a string of sucker rods running the length of the well bore. The pumping unit moves the sucker rod string up and down in the well bore to drive the sub-surface pump.

For many years sucker rods were generally made of steel. Due to the heavy weight of the steel rods, large pumping units were required and pumping depths were limited. It is now preferable to use sucker rods made of fiberglass or composite material with steel connectors joining the rods together to make a string of the required length. Fiberglass rods provide sufficient strength to tolerate the mechanical stresses of pumping, and yet weigh substantially less than steel rods. Another advantage of fiberglass or composite sucker rods ("FSR") over steel is their improved resistance to the chemical stresses encountered in corrosive environments. Fiberglass rods have been used successfully in the field since 1973, and have proven to be of particular value in corrosive environments where steel rods have an unacceptable failure rate due to weakening of the steel from corrosion and high load levels.

Fiberglass sucker rods ("FSR") are usually about 37½ feet long and approximately ⅞ inches in diameter. Each rod is composed of bundles of glass filaments (rovings) approximately 15 microns in diameter that have been wetted with a resin and formed into a rod. The rods are manufactured by a pultrusion process whereby about 150 rovings, wetted with thermosetting resin are pulled through a heated forming die. The heat catalyzes a chemical reaction causing the resin to harden and bonding the rovings and the resin together into a composite solid which is formed into a rod by the die. It is critical that the rods be manufactured so as to prevent looping of the rovings or other imperfections which introduce flaws in the rod body greatly increasing the odds of rod failure in the field.

Sucker rods are connected together in a string by steel connectors attached to the ends of each rod. With the solving of rod manufacturing problems such as looping, the steel connectors or end fittings between rods have proven to be the source of most composite rod failures or end fitting pullouts. Therefore, the sucker rod connectors have been the focus of recent efforts to improve the reliability of fiberglass or composite sucker rod construction.

The end fittings comprise a rod receptacle at one end to receive the rod end, and a threaded coupling at the other end to threadedly connect to the end fitting of the next successive rod. The space between the interior wall of the rod receptacle and the external surface of the rod defines a space or annulus which is filled with epoxy or some other initially flowable adhesive such as epoxy. The epoxy cures into a solid which bonds to the rod. Typically, the adhesive is heat activated and heat is applied to the rod as a curing agent. Early experiments with such connectors resulted in rod pullouts, where the rod is pulled out of the connector rod receptacle causing failure of the string. Such string failure can be catastrophic, requiring expensive repairs or even well closure.

Current end fittings are formed such that the epoxy cures into a series of wedges that cooperatively engage complimentary surfaces in the rod receptacle to prevent rod pullouts.

FSRs were developed to improve the operation characteristics of artificial lift rod pumping systems in crude oil production.

The use of FSR in rod pumping systems is indicated when analysis of the down hole pumping system(s) reveals a need for the particular performance characteristics offered by FSRs, which characteristics comprise resistance to corrosion, light rod string weight, lower pumping unit gearbox loads, and the "rubber band" effect due to the elastic properties and geometric shape memory after elongation of the fiberglass (or composite) component of the system. Fiberglass sucker rod pumping systems have become an accepted ingredient in artificial lift design, and are used extensively throughout the range of crude oil production.

Among the mechanical forces acting on the rod/adhesive/metal interface, are compressive forces, such as during a stroke of the pump either up or down, and negative load forces. Negative load refers to forces acting on the side of the wedge opposite from the gripping side of the wedge. Negative load is very destructive to the wedges of prior art designs, causing catastrophic shear failure of the wedge. In the present invention, however, when a shock load occurs that creates a negative load, the wedge has the ability to absorb the negative load forces and to thereby resist failure of the rod connection.

Early rod designs were plagued with early time to first failure. Failure analysis of early FSR designs revealed the following:

A. Failure, while exhibiting itself catastrophically, is rarely a result of a catastrophic evens. The exhibition of catastrophic failure is usually a result of improper maintenance and materials handling procedures.

B. Failure, regardless of its manifestation, can be linked to the interface between the fiberglass rod and the metal end fitting.

C. End fitting designs that distribute applied stresses more fully along the length of the interface are more successful in reducing failure.

The design of the metal end fitting has consistently comprised a wedge shaped pocket (receptacle) to accept the fiberglass rod. The following procedure applies to various diameters of rod sizes, and the principles and practices remain the same regardless of rod size. Current production practices involve the preheating of an end fitting, filling the end fitting with a one part heat activated adhesive, installing an end fitting onto both ends of a fiberglass rod of some length, and heating the area(s) to include all of the interface between the metal and fiberglass. It is important that in such a system, the adhesive layer serves to adhere to the fiberglass only, and not the end fitting pocket. The adhesive layer thus acts as a plug being wedged by force to the end fitting pocket socket. After proper time intervals and heat application, the assembly is then tested by application of force directed coaxially in opposing directions to test the wedge strength and to "set" the end fitting wedge receptacle with the hardened adhesive. The pocket or pockets in the end fitting serve as both the mold to form the wedge or wedges from the fluid adhesive, and as receptacles to capture the hardened adhesive wedges.

Wedges transmit the compressive and tensing forces of pumping from the steel connector to the fiberglass rod and vice-versa. The metal end fitting is harder than the hardened adhesive, and deforms the shape of the hardened adhesive wedge. Essentially, the metal end fitting squeezes the deformations in the adhesive when compressive and back travel forces are applied to the construction. Ideally, the deformations are squeezed by the end fitting out toward the end of the rod, transmitting the forces, at least to some extent, into the metal end fitting for optimum dispersal of destructive forces.

Axial forces applied to a rod cause deformations of the rod material. The deformations are transmitted throughout the rod body and vary depending on the magnitude of the force and the cross-sectional area of the rod. Abrupt changes in the cross-sectional area of the rod concentrate stress forces in certain areas of the rod. The wedges of sucker rod connections change the cross-sectional area of the rod in comparison to the rod body in such a way as to concentrate stress forces on the rod. The concentrated forces may exceed the structural strength of the composite material of the rod, resulting in rod failure from cracking or splintering.

Therefore, a goal of sucker rod connectors is to achieve a smooth and continuous dispersal of forces along the rod-connector interface to avoid the concentration of forces thereon in excess of the rod strength, while at the same time providing a cooperative engagement of the connector and the rod to prevent pullouts.

In order to make the attachment of the steel end fitting to the fiberglass rod, an initially flowable adhesive is placed in the receptacle of the connector. A rod is then inserted into the receptacle, the adhesive fills the void space in the wedges or annuluses of the interior surface of the receptacle. The initially flowable adhesive cures or hardens becoming a solid and adhering to the rod. The adhesive bonds to the rod and not to the inside of the metal receptacle.

When the assembled rod is pulled in tension in its connector, the solid adhesive wedges bonded to the rod press against the complimentary form of the interior of the end fitting and force the end fitting against the annular wedges of the solid adhesive. A compressive force is imparted to the rod itself as the metal connector and the adhesive wedge press against each other to resist any further slippage. This force of compression is applied across the entire surface where the adhesive wedge and the metal surface contact. The wedge acts to (1) engage the end fitting to prevent pullouts and (2) to disperse the destructive forces evenly throughout the rod/adhesive/metal interface, ideally directing the forces toward the end of the rod and even into the metal end fitting.

Experience has shown that any abrupt discontinuity in the angle of the wedges of the end fittings can result in the compressive forces being concentrated at the area of discontinuity. The force can exceed the strength of the fiberglass rod at the point of discontinuity, resulting in rod failure.

Failure of FSR in production are most often encountered in one of two scenarios:

A. Pinch-off—wherein the fiberglass/adhesive/metal interface is abruptly sheared, and the rod is sheared away from the end fitting; and B. Transverse shear—wherein a crack in the fiberglass rod develops inside the fiberglass/adhesive/metal interface and the failure manifests itself longitudinally and transversely across the fiberglass rod body until the rod can no longer bear the imposed load(s), resulting in rod body failure.

Due to the concentration of applied forces, the imposed increase in stress is transferred from rod to end fitting, and conversely, end fitting to rod, in localized areas of insufficient area so as to absorb and/or distribute the applied forces. The resulting stress concentration is de-energized by one of two methods:

A. Shear forces spike into the fiberglass rod locally to the is discontinuity of the metal; the shear forces develop perpendicular to the diameter of the glass fibers and the resultant shear beaks the glass fibers causing failure.

B. Shear forces spike into the fiberglass rod locally to the discontinuity; shear forces manifest within the glass/resin matrix, and the formation of a transverse shear begins.

The contours of the wedges on the interior surface of the end fitting affect the shape of the distortion in the shape of the adhesive material. The distortion travels through the adhesive, impelled by the mechanical stress and strain forces acting on the end fitting. Specifically, the shape of the distortion approximates the shape of the wedges. If the wedges have an abrupt change of cross sectional area such as a point of transition from one wedge to the next successive wedge, the shape of the abrupt change will be echoed in the shape of the distortion, with the result that the distortion takes on a "spiked" shape. The spike is a manifestation of the concentration of force caused by the abrupt discontinuity in the wedges. Such concentrated forces may exceed the material strength of the rod, particularly where the spike is impelled into the rod at the interface of the rod and the adhesive.

Inadequacies in the stress distribution dynamic lead to localized and intense stress risers that can overcome the properties of the rod/adhesive/metal interface to adequately distribute the applied load(s), resulting in the loss of integrity of the interface system. Additionally, the cumulative effect of repetitive stress risers aggravate the loss of integrity, thus accelerating the erosion of the affected area. Thus, any attempt to minimize the destructive forces leading to catastrophic failure must be focused on the fiberglass/adhesive/metal interface.

In any end fitting design, the principle of the wedge is employed to provide capture of the fiberglass rod and distribution of the applied forces encountered in field use. The wedge is formed by a rod receptacle having an interior surface shaped to form at least one generally wedge-shaped annulus between the interior surface of the receptacle and the end of the rod received by the receptacle. The wedge-shaped annulus has an annularly thin portion and an annularly thick portion distal to the thin portion.

Examples of end fitting designs include from five wedges (being the earliest designs) to one wedge. In each design, the shape (or shapes) of the wedge (or wedges) is/are determined by the diameter of the fiberglass rod, the diameter of the pocket (receptacle) of the end fitting, and the length of each wedge section. In all cases, areas of discontinuity and abrupt changes in the shape of the pocket lead to high stress levels, as revealed by stress analysis of the particular system. Examination of the stress distribution, or lack thereof, reveals that these areas of high stress concentration are a product of the shape and size of the discontinuity of the end fitting pocket. These areas lead to destruction of the rod/adhesive layer, leading to catastrophic failure as described above.

There is a need, therefore, for a sucker rod end fitting in which compressive forces are transmitted to the fiberglass rod without excessive concentration of compressive forces in any portion of the rod.

There is a further need for a sucker rod end fitting wherein the internal wedges have no area of abrupt discontinuity.

Therefore, it is an object of the present invention to provide a sucker rod end fitting in which compressive forces are not excessive in any portion of the rod.

Another object of the present invention is to provide a connector for connecting rods end to end, wherein the connector distributes stress forces acting on the rods from the connector equally across the diameter of the rods.

It is a further object of the present invention to provide a sucker rod end fitting wherein the transition from one wedge to the next contains no abrupt discontinuities. That is, the transition from one tapered annulus to the next tapered annulus is a continuous curve in the shape of a wave.

SUMMARY OF THE INVENTION

In the present invention, the shape of the annular wedge or wedges (formed by the cooperation of the rod receptacle or end fitting and the rod received therein) is wave-shaped where the thick portion of the annulus or wedge approaches the rod body distal to the thin portion of the annulus or wedge. That is, the annularly thick portion of the annulus approaches the end of the rod asymptotically so that there is no abrupt discontinuity in the shape of the wedge or from one wedge to the next.

Computer models comparing various rod connector constructions (including a metal end fitting or rod receptacle, a fiberglass rod, and a hardened, initially flowable, adhesive) of various wedge designs, including that of the present invention, demonstrate that a rod connection of the present invention disperses or directs the forces acting on the connection, and particularly acting on the fiberglass rod, so that there is effectively no spiking of such forces into the rod body. Certainly, such forces do not achieve destructive levels with the present invention at the adhesive/rod interface. Unlike other wedge designs examined by computer modeling, the present invention at least partially directs the stress forces acting on the connection into the metal end fitting itself, a result unique to the present invention. The computer modeling is discussed more fully later in this disclosure.

The present invention is directed to a sucker rod end fitting comprising: a rod receptacle having a closed axially inner end and an open axially outer end, wherein the rod receptacle comprises a plurality of integrally formed, outwardly converging, axially aligned annuluses, each annulus being tapered to be of decreasing diameter toward the open end and defining a plurality of transition surfaces between each of the annuluses, wherein each of the transition surfaces comprises a wave-shaped cross-section. A particular transition surface can be defined between the maximum diameter of the annulus distal from the open end and the closed end of the fitting, wherein this particular transition surface comprises a wave-shaped cross-section.

For purposes of the present disclosure, the term "wave," "wave-shaped," "sine-wave" or "S-shaped" refers to the asymptotic character of the curvature of the present transition surfaces. Asymptotic curvature may be understood by distinguishing it from tangential or arcuate curvature. A tangential or arcuate curve retains the potential to intersect with or contact the outer surface of the rod if the curve is sufficiently extrapolated. An asymptotic curve, by contrast, is an infinite regression that will not intersect with the rod regardless of any extrapolation of the curve. Any curvature of an annular transition surface that is not asymptotic will create an abrupt discontinuity in the wedge formed thereby, possibly resulting in the spiking of destructive forces into the rod body.

The end fittings are attached to the fiberglass rod by filling the receptacle of each fitting with an initially flowable adhesive, inserting the rod into the receptacle, and allowing the adhesive to cure into a solid, bonded to the rod. Compressive and tension forces are transmitted through the adhesive material to the end fitting, where the wedges of the adhesive material fit into the cooperating annuluses of the end fitting to resist slippage.

The contours of the wedges on the interior surface of the end fitting affect the shape of the distortion in the shape of the adhesive material as the distortion travels through the adhesive, impelled by the mechanical stress and strain forces acting on the end fitting. Specifically, the shape of the distortion approximates the shape of the wedges. If the wedges have an abrupt change of cross sectional area such as a point of transition from one wedge to the next successive wedge, the shape of the abrupt change will focus the shape of the distortion, with the result that the distortion takes on a "spiked" shape. The spike is a manifestation of the concentration of force caused by the abrupt discontinuity in the wedges and such concentrated forces may exceed the material strength of the rod, particularly where the spike is impelled into the rod at the interface of the rod and the adhesive.

The end fitting of the present invention, however, comprises a wave-shaped transition from one wedge to the next wedge. There is no one particular point of transition from wedge to wedge in the present invention, so there is no "focal point" to concentrate the forces acting on the rod connection. The wave shape of the present invention eliminates any spiking of forces. The distortion of the adhesive material in the present invention approximates the shape of the wave of the present invention, dispersing the forces acting on the rod equally across the diameter of the rod, at the rod/adhesive interface, so that such forces do not exceed the material strength of the rod.

The wave-shaped transition surfaces of the present end fitting avoid any abrupt discontinuity in the curvature of the fittings internal surface to avoid any excessive concentration of mechanical forces upon the rod that would otherwise result in rod failure, and yet still provide sufficient wedge-capture upon the application of forces to assure a reliable cooperating grip between the end fitting and the adhesive wedge (or wedges).

The present invention is further directed to a sucker rod construction comprising: an end fitting comprising a rod receptacle formed to define an internal surface having a closed axially inner end and an open axially outer end, wherein said rod receptacle comprises a plurality of integrally formed, outwardly converging, axially aligned annuluses, each annulus being tapered to be of decreasing diameter toward said open end and defining plurality of transition surfaces between each of said annuluses, wherein each of said transition surfaces comprises a wave shaped cross-section, and wherein said end fitting further comprises a particular transition surface between said closed end and the maximum diameter of the annulus distal from said open end, wherein said particular transition surface comprises a wave-shaped cross-section; a cylindrical fiberglass rod having an end having a cylindrical outer surface being received within said rod receptacle through said open outer end and cooperating therewith to define an annular chamber between said outer surface of said end of said rod and said outwardly converging annuluses of said rod receptacle; and a body of initially flowable adhesive that cures to bond to said outer surface of said end of said rod and to solidify to form a plurality of wedges to cooperate with said annuluses.

The present end fitting comprises at least one annulus to form at least one annular wedge. The rod receptacle of the end fitting has an interior wall defining an annulus for housing a sucker rod, said interior wall having a first section converging axially inward and away from said rod, a second section converging outward toward said rod, a third section converging axially inward and away from said rod, and a fourth section converging outward toward said rod and approaching said rod asymptotically and terminating at an annulus base.

Additionally, the present invention comprises a rod receptacle having an interior wall defining a plurality of axially aligned annuluses for housing a sucker rod, wherein each annulus comprises a first section of said interior wall converging axially inward and away from said rod, a second section of said interior wall converging outward toward said rod, a third section of said interior wall converging axially inward and away from said rod, and a fourth section of said interior wall converging outward toward said rod and approaching said rod asymptotically; and wherein said fourth section of a terminal annulus terminates at an annulus base.

The present invention is useful for rods of any diameter.

BRIEF DESCRIPTION OF THE DRAWINGS

Other objects and advantages of the invention will become apparent upon reading the following detailed description and upon reference to the drawing in which:

FIGS. 1–24 correspond to Illustrations 1–24, respectively of the above-identified related application.

DETAILED DESCRIPTION OF THE PREFERRED EMBODIMENT

Figure 25:
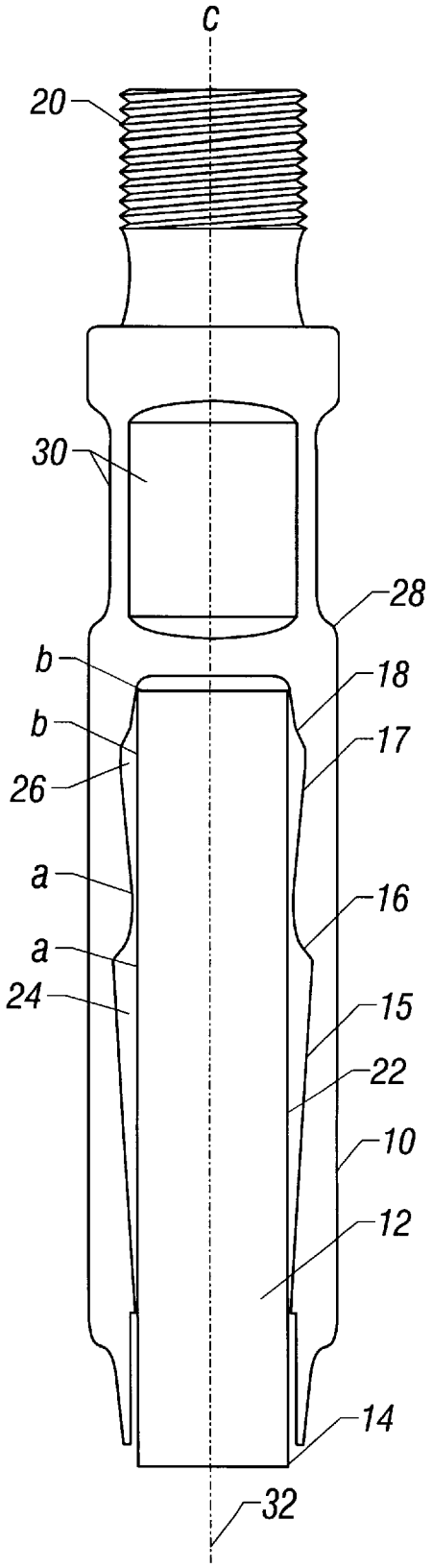
FIG. 25 is a horizontal cross-sectional view of an exemplary sucker rod construction.

Referring now to FIG. 25, a sucker rod construction of the present invention is shown. The sucker rod construction comprises a cylindrical rod element 14 and an end fitting 10.

As shown in FIG. 25, the connector member 10 is formed to define an axial receptacle 12 for receiving an end of the sucker rod element 14. The axial receptacle 12 is defined by a series of outwardly converging tapered surfaces 15, 17 which cooperate with the external cylindrical surface 22 of the rod element 14 to further define a plurality of a wedge shaped or tapered annuluses 24, 26 about the rod element 14 when the rod element is in position. The end fitting 10 includes an external substantially cylindrical surface 28 terminating in an externally threaded end 20 or threadedly engaging the next successive sucker rod end fitting to define a string of sucker rods for lowering into a wellbore. Connector member 10 also includes a pair of diametrically opposite flat surfaces 30 for enabling an oil field operator to attach a standard sucker rod wrench thereto for connecting and/or disconnecting the individual sucker rod end fittings 10 from one another.

Wedges transmit the stress and strain forces of pumping from the steel connector to the fiberglass rod causing the rod to deform. The deformations are transmitted throughout the rod body by the forces. One objective of wedge design is to direct the deformations away from the body of the rod and toward the end of the rod. The metal end fitting is harder than the hardened adhesive, and essentially squeezes the deformations in the adhesive when compressive and back travel forces are applied to the construction. Ideally, the distortions are squeezed by the end fitting out toward the end of the rod, transmitting the forces, at least to some extent, into the metal end fitting for optimum dispersal of destructive forces. The wedges change the cross-sectional area of the rod in comparison to the rod body. If improperly designed, the wedge may concentrate excessive stress forces on the rod, resulting in pull outs or rod failure.

The sucker rod construction of the present invention includes a sufficient quantity of adhesive material to completely fill the annuluses 24, 26 defined by the first connector member outwardly converging tapered surfaces 15, 17 and the outer cylindrical surface of the rod element 22 for adhering or otherwise interconnecting the fiberglass cylindrical rod element 14 to the steel connector member 10. Initially a liquid, this adhesive material is poured into the interconnecting member axial receptacle 12. Next, the fiberglass rod 14 is inserted into the receptacle, displacing much of the liquid adhesive and forcing it into the annulus 24, 26 surrounding the rod, where it subsequently cures, forming an angular wedge which is bonded to the rod and the receptacle tapered surface 15, 17.

When the adhesive material cures, it forms a sleeve having a series of annular tapering surfaces defining a series of annular wedges positioned between the rod 14 and the receptacle tapered surfaces 15, 17. This hardened adhesive sleeve forms a bond with the fiberglass rod 14 to resist the shear force resulting when tension is applied to the rod, as if to withdraw it from the connector member. Additionally, tension applied to the rod 14 causes the annular wedges of cured adhesive material to be forced into compressive engagement with the rod outer cylindrical surface 28 and with the connector member tapered surfaces 15, 17. This results in a compression force directed radially inwardly to the center line axis c—c of the rod 10 to compress the annular wedges of adhesive material against the rod to retain the rod 14 in position within the connector member 10 against the action of such tension applied to the rod.

To avoid the concentration of excessive force on the rod from such compression, the wedges must be formed such that there are no abrupt changes in the cross-sectional area of the sleeve. The desired effect of the wedges on the stress forces acting on them is to disperse the forces, not to concentrate them. The cross-sectional area of the sleeve must change as smoothly as possible so that compressive forces are dispersed equally along the end of the rod, and not concentrated excessively at any portion of the rod.

The sucker rod end fitting 10 of the present invention has an open axially outer end 32 and a closed axially inner end 34. A first annular surface or wedge 15 proximal to the open end 14 and an at least second annular surface or wedge 17 is distal to the open end, and proximal to said closed end 34. The transition surface 16 from said first annular surface 15 and said second annular surface 17 is defined by the region between lines a—a. Transition surface 16 of the receptacle 12 is formed in the shape of a wave having an outward tapered portion nearer said open end 32 and inward tapered portion nearer said closed end 34. The transition portion 16 does not curve concavely to meet the exterior surface of the rod member 22, but curves asymptotically so that the surface 16 approaches the cylindrical rod surface 22 asymptotically rather then arcuately or tangentially. The distinction between asymptotic curvature versus arcuate or tangential curvature being that a tangential or arcuate curve retains the potential to intersect with or contact the outer surface of the rod if the curve is sufficiently extrapolated, whereas an asymptotic curve is an infinite regression that will not intersect with the rod regardless of any extrapolation of the curve. Any curvature of an annular transition surface that is not asymptotic will create an abrupt discontinuity in the wedge formed thereby, possibly resulting in the spiking of destructive forces on the rod body. Thus, the cross-section of surface 16 is S-shaped, sine-waved shaped, or simply wave-shaped, in reference to the asymptotic character of the curvature of the transition surface.

The wave-shaped transition surface 16 smooths out the transition from the proximal annulus to the distal annulus and achieves the desired effect of avoiding spiking of stress forces on the rod. As the distortion of the cured adhesive is transmitted through the transition surface of the sleeve, the wave shape of the surface acts to smooth out the distortion of the adhesive material. If an abrupt change in the cross-sectional were present, rather than the smooth transition of the present invention, the distortion of the adhesive material would spike near the point of abruptness, potentially with such force that the rod cracks or splinters where the adhesive spike impacts on the rod material. The wave shape of the present invention obviates such spiking of the adhesive by rounding off and smoothing the distortion of the adhesive as it is transmitted though the rod connection. The force, therefore, is never concentrated at any particular point of the rod in excess of the material strength of the rod at such a point.

Similarly, a transition surface 18 is defined between the annulus or wedge nearest to the closed end 34 between line b—b. Transitional surface 18 is similarity waved shaped, and approaches the outer surface 22 of the distal end of rod 14 asymptotically. Surface 18 is present in the present invention even for an embodiment comprising only a single wedge.

The soft contours of the transition surfaces of the present invention distribute the forces acting on the rod such that said forces do not exceed the material strength of the rod. There are no abrupt changes in curvature to create regions of high stress in the fiberglass sucker rod, possibly resulting in rod failure. The long sought after a goal of a sucker rod end fitting that uniformly distributes compressive forces, which generates no region of concentrated compressive forces, and yet still provides cooperating wedges to assure effective transmission of force, is finally achieved in the end fitting of the present invention.

Computer Modeling

The FSR design of the present invention was subjected to computer modeled testing to evaluate the effectiveness of the present invention in achieving the objects of the invention. The present invention was evaluated with respect to the dispersal and transmission of forces in the end fitting. The evaluation demonstrated that the "wave" design of the present invention effectively eliminates abrupt discontinuities so that there is virtually no spiking of destructive forces into the rod body. In fact, the present invention is so effective at directing said forces that the forces are actually directed to some extent into the metal end fitting (negative force benefits)—achieving the ideal objective of FSR connectors.

Additionally, the effect of abrupt discontinuities on the transmission of forces was demonstrated by subjecting other wedge designs to the same computer modeled testing as was the present invention. These results indicate that FSRs are exquisitely sensitive to discontinuities in the wedge shape, resulting in significant and ultimately destructive spiking of forces even where the discontinuity is slight.

Methodology

The purpose of the testing was to evaluate design characteristics of the present fiberglass sucker rod end fittings in comparison to other possible FSR end fittings. For similarity, sucker rods of nominal 1" diameter of each design were obtained for comparative analysis. Considerable effort was given to consistency of measurement and analysis to avoid bias and withstand scrutiny of results. For identification purposes, the three samples are assigned names of "alpha," "beta" and "gamma". The applied nomenclature remains consistent throughout the test.

Physical measurement was performed on each end fitting. To obtain geometric parameters, repetitive measurement was made to produce data for each landmark site. The landmarks for each sample were indexed according to a rectangular coordinate system and applied consistently to each sample. Measurements were made and recorded to a least readable count of 0.0005" precision. This precision is within the ability of a competent observer, and is consistent with repetitive tooling accuracy found in multiple end fitting production.

Data generated by physical measurement was used in several analysis methods, explained as:

Finite Element Analysis ("FEA") considers stress analysis based on dividing an object into numerous pieces called elements, incorporating a large quantity of 'simple' solutions to reaction of elements to an applied load into one overall solution. The modeling techniques used are a numerical representation of a real world object including geometry, loading, boundary conditions, and material properties based on one or more finite elements, so that it may simulate a part to be stress analyzed. Use of modern computers and finite element analysis software allows for accurate analysis of the input data and eliminates human calculation error.

FEA results may be represented in several forms, and for the purposes of this report, numerical values (as found in Chart of Values), and color dithered drawings (see FEA illustration) were used to compare and contrast the results of the analysis. Narrative discussion of the results of FEA analysis on specific samples is presented in the "Analysis of Results."

Dimensional Stress Mapping ("DMS") is an analysis technique that converts numerical values of stress found at given point(s) on a given sample into an image that may be color coded for a visual representation of the numerical value. The resulting image can be viewed from various perspectives for analysis. For comparison purposes, consideration effort was made to align the dimensional stress mapping grids with the corresponding grids found in the FEA analysis. Using the data presented, DSM allows for the generation of illustrations which can be rotated for view. Viewing angles are presented in the form of elevation, rotation, perspective, according to the desired view.

In each FEA and DSM technique, processor functions were verified by performing analysis on identical models to determine floating point math calculation accuracy. Results on both Pentium-based and Cyrix 6x86-based processors were found to be identical in all trials.

Modeling Concerns

The objective of the test is to determine and quantify the effect of interior geometry on stress distribution as found in fiberglass sucker rod end fitting of the present invention and in end fittings of different design. For purposes of this test, samples of three model end fittings are examined.

The samples obtained for this test each consist of three components: steel for the end fitting, fiberglass for the rod body and adhesive to join the other two components. For each component group, the materials are identical, or correspondingly similar as to be considered identical. Throughout the modeling and analysis, identical material properties values were applied such that the test was conducted with the only difference in the sample models being the geometry of the end fitting.

For purposes of the finite element analysis, each model is presented in axisymmetrical form, represented in a two dimensional drawing of a three dimensional bilaterally symmetrical physical shape. Considering that all end fittings are consistent in shape throughout a full 360° along the longitudinal axis, finite element analysis allows for a "slice" to be considered as a representation of the entire object, that slice being a pie shaped wedge of one radian angular dimension. (360°/2π). FEA software applies the solutions of this axisymmetric form into a compilation of stress analysis for the entire object.

Application of loads are applied to each model in consistent fashion. Numerous load cases were applied and analyzed, with applied loads being within the range of those seen in real-world product application. For purposes of this report, analysis of the 20,000 pound load case is presented.

Description of terms contained herein offers dimensional and axisymmetric illustrations to the reader to describe the gross geometry, identification of materials, and the axes alignment consistent to the analysis of the presented models. Illustration 1 offers a generic model, and is presented for illustration purposes. Particular geometry of the individual models is considered throughout the analysis.

The models presented herein contain several areas that are common to all models. For purposes of commonality and clarity, those common areas are not included in the finite element analysis report. The areas contained above the point, z=7.30, are found to be API wrench flat and pin standards. These areas are found to equal in reaction in all models, and are not included in this report.

Comparison of Designs

Element Data

The results of stress analysis using the von Mises-Hencky calculations are presented in tabular form for each model, Illustrations 2–4 (FIGS. 2–4, respectively).

For the Alpha design, Illus. 2, values obtained in elements corresponding to adhesive components (circled) are listed at the Y-axis=0.60, Z-axis=3.30 to 2.70; Y=0.55, Z=4.60 to 4.20, and Z=3.30 to 2.10; Y=0.50, Z=4.90 to 1.00; Y=−0.50, Z=4.90 to 1.00; Y=−0.55, Z=4.60 to 4.20 and Z=3.30 to 2.10; Y=0.60, Z=3.20 to 2.70, elements corresponding to fiberglass (bracket) are listed at Y-axis=−0.40 to 0.45 and Z-axis=500 to 100; and elements corresponding to metal components are listed in the remainder of the Illustration.

For the Beta design, Illus. 3, values obtained in elements corresponding to adhesive components (circled) are listed at the Y-axis=0.60, Z-axis=3.30 to 3.10; Y=0.55, Z=4.60 to 3.90, and Z=3.40 to 1.20; Y=0.50, Z=5.00 to 100; Y=−0.50, Z=5.00 to 1.00; Y=−0.55, Z=4.60 to 3.90 and Z=3.40 to 1.20; Y=−0.60, Z=3.30 to 3.10, elements corresponding to fiberglass (bracket) are listed at Y-axis=−0.45 to 0.45 and Z-axis=5.00 to 1.00; and elements corresponding to metal components are listed in the remainder of the Illustration.

For the Gamma design, Illus. 4, values obtained in elements corresponding to adhesive components (circled) are listed at the Y-axis=0.60, Z-axis=4.30 and 3.00 to 2.90; Y=0.55, Z=4.40 to 3.40, and 3.00 to 2.30 and 1.70 to 1.00; Y=0.50, Z=4.70 to 1.00; Y=−0.50, Z=4.70 to 1.00; Y=−0.55, Z=4.40 to 3.40 and 3.00 to 2.30 and 1.70 to 1.00; Y=−0.60, Z=4.30 and 3.00 to 2.90; elements corresponding to fiberglass (bracket) are listed at Y-axis=−0.05 to 0.50, Z-axis=4.60; Y=−0.35 to 0.35, Z-axis=4.80, and Y=−0.45 to 0.45 and Z-axis=4.70 to 1.00; and elements corresponding to metal components are listed in the remainder of the Illustration.

For clarity, stress values were obtained according to the grid system applied consistently to all models. Thus, each element of a model can be located in the same coordinate location throughout all models. Geometric differences are then compared and contrasted according to the element location in table form.

Finite Element Analysis ("FEA") Reference is made to illustrations 5–7, "Z axis=0.000 to 7.300", "Z axis=0.000 to 5.000", "Z axis=1.000 to 5.000", respectively.

Figure 1:
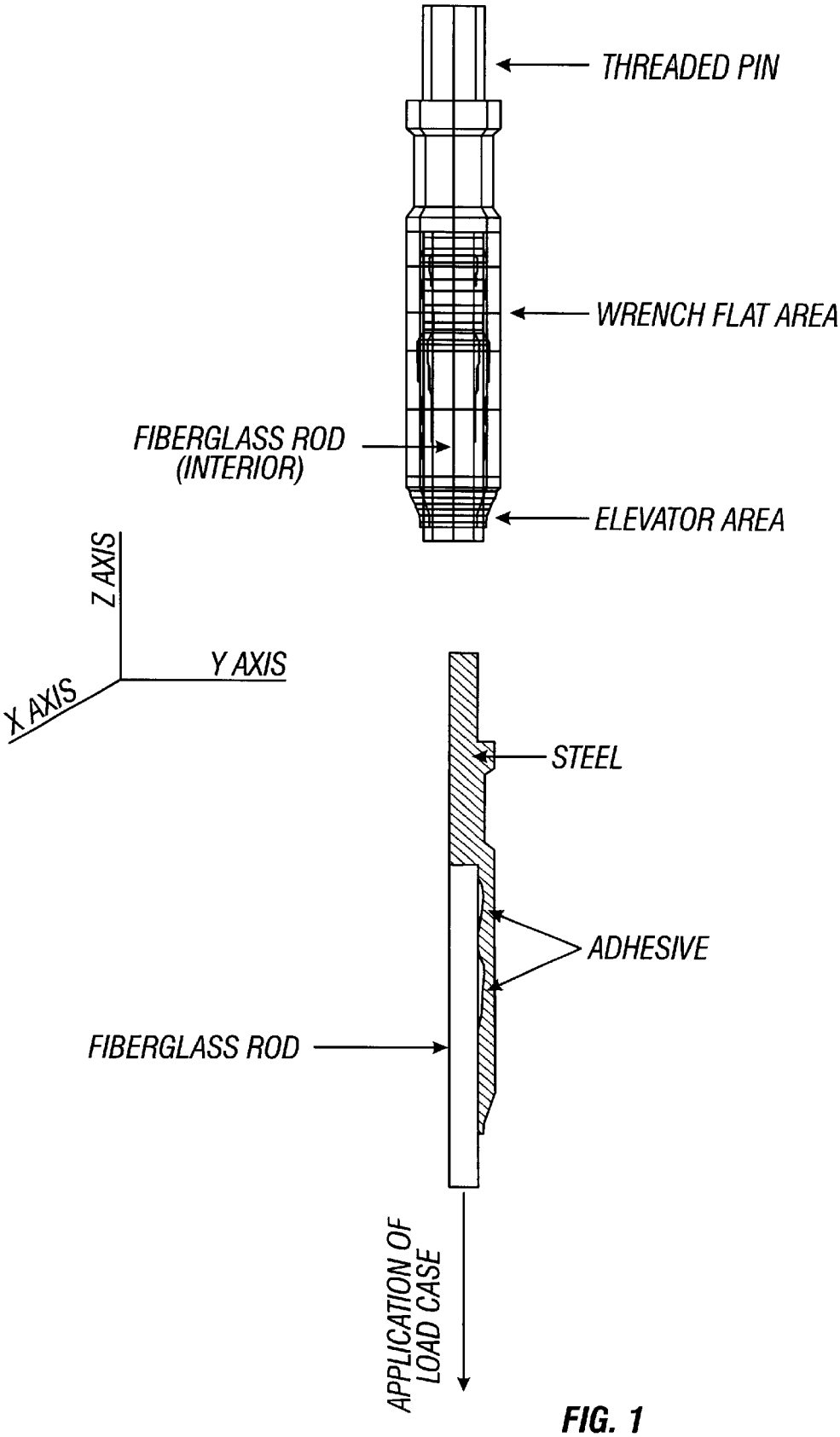
Figure 5:
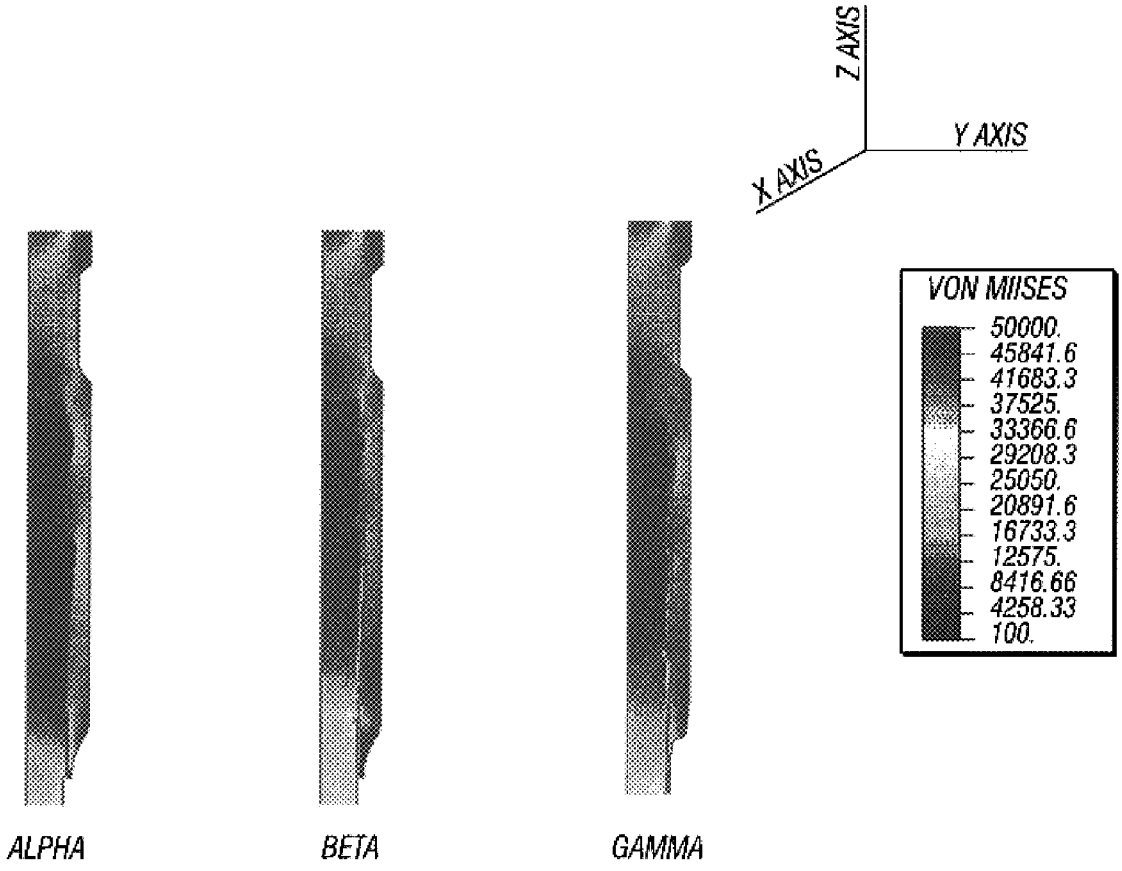
Figure 6:
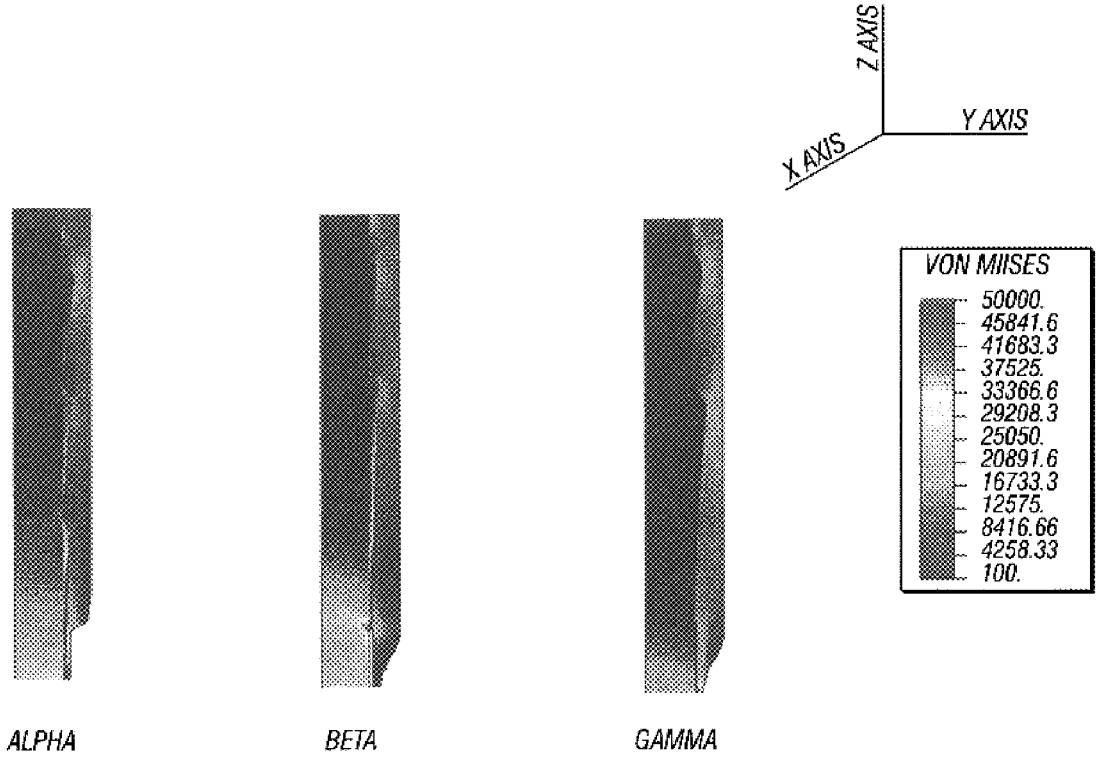
Figure 7:
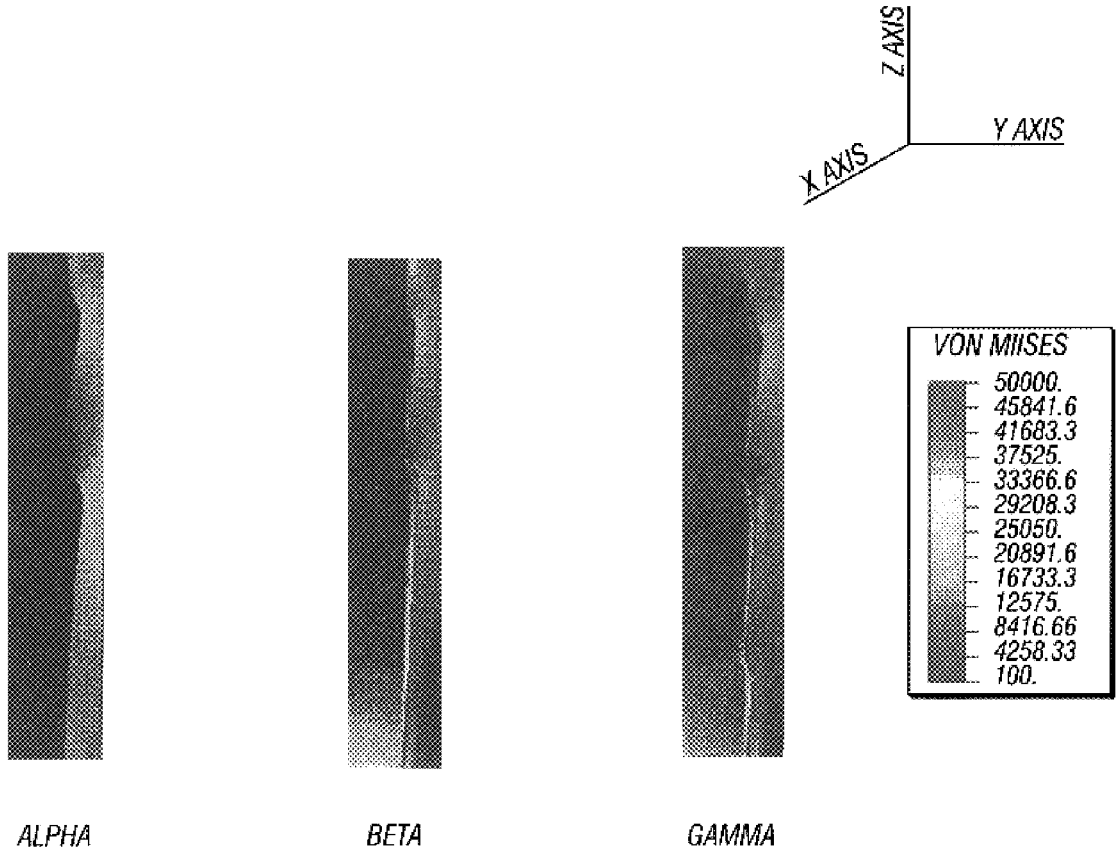

The illustrations 5–7, (FIGS. 5–7, respectively) labeled "Comparison of Stress Distribution," contained herein, are dithered view representations of the stress values found in the applied load case. By software default, a line (shown here in white) is inserted along materials separation for clarity. As mentioned, the areas along Z axis=7.30 have been omitted for reader simplification.

Comparison of Designs

Observations of the comparison illustrations indicate:

Alpha Design

The Alpha Design, Illus. 5, corresponds to the present invention. The model reflects a two pocket interior design in which the internal section is described by a curved perimeter beginning at the open end of the end fitting and following a curved path upward to a reduction in diameter being accomplished by the application of a curved section facing inward—the "wave" design of the present invention. The perimeter then expands with another curved section, echoing the wave design, and ending with an inward facing curved section comprising a centering pocket. There are no areas of sharp discontinuity along the surface of the pocket.

Stress distribution is general and uniform both laterally and longitudinally along the rod section, with resolution of the stress distribution being imparted into the metal component of the end fitting. Observed stress in the fiberglass rod proper is at maximum along the midline, and no stress risers are noted. Distribution of stress across the adhesive layer is smooth and uniform.

Beta Design

The model shown in Illus. 6 reflects a two pocket interior design in which the internal section is described by a straight line beginning at the open end of the end fitting and continuing upward to the beginning of an elongated ellipse. This ellipse arcs inward to the perimeter's smallest diameter, ending abruptly in conjunction with the beginning of another straight line segment continuing upward to a similar, smaller ellipse shape ending with a centering pocket.

Stress distribution in this model is highlighted by the following:

There exists a sharp and distinguishable stress riser found at the conjunction of the beginning of the wedge section and the fiberglass rod, beginning at the adhesive layer and radiating inward and upward in the rod section.

Additionally, there is a significant increase in observed stress found in the rod exterior and the adhesive layer along the rod-adhesive-metal interface from the open end of the end fitting continuing upward toward the first ellipse continuity.

Gamma Design

The model shown in Illus. 7 reflects a three pocket design in which the internal section is described by a straight line beginning at the open end of the end fitting and continuing to the juncture of another inward and upward pointing line which narrows the diameter of pocket to the juncture of another straight line segment outward and upward to the juncture of another inwardly pointing straight line for pocket #2. The perimeter then continues upward and outward to a third inwardly pointing line for pocket #3. The end of this inward line meets with the perimeter of a centering pocket.

Stress distribution in this model exhibits:

There is a significant increase in observed stress in the rod exterior and the adhesive layer along the rod-adhesive-metal interface from the open end of the end fitting continuing upward through the entirety of pocket #1. There is a stress riser at the apex of pocket #1, and there exists an area of stress concentration at the beginning of pocket #2 continuing upward. The pocket formed by the uppermost wedge contains very small values of stress both in absolute terms and in relation to the lower pocket.

Dimensional Stress Mapping ("DSM")

Using data gathered in stress analysis, DSM illustrations are generated and presented to compare/contrast the differences in stress values according to the individual geometry of each model. To achieve commonality for comparative analysis, it is a requisite in DSM that any illustration include verifiable landmarks to properly identify critical areas. In the presented illustrations, each contains sufficient landmark information for proper identification of such areas.

Figure 8:
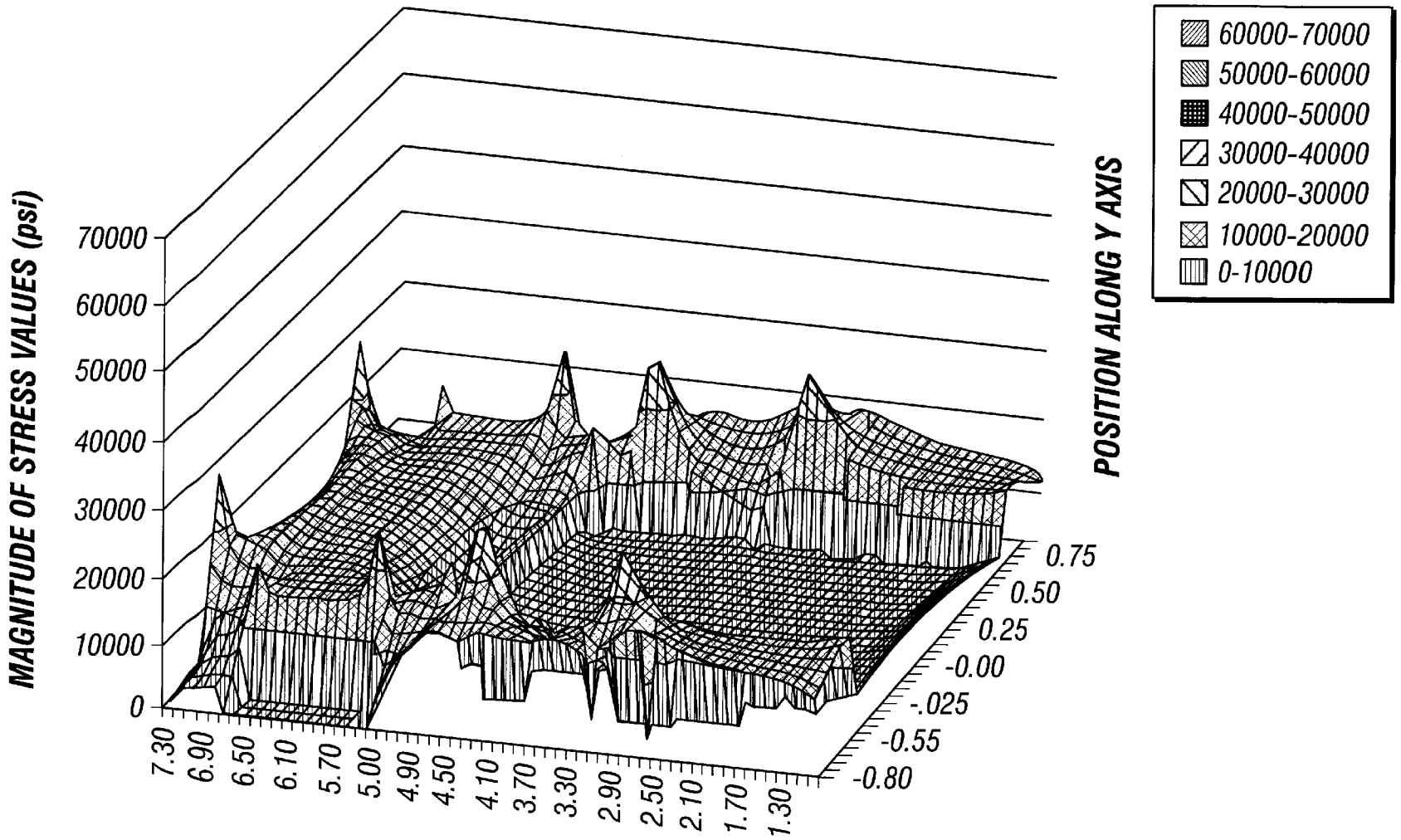
Figure 9:
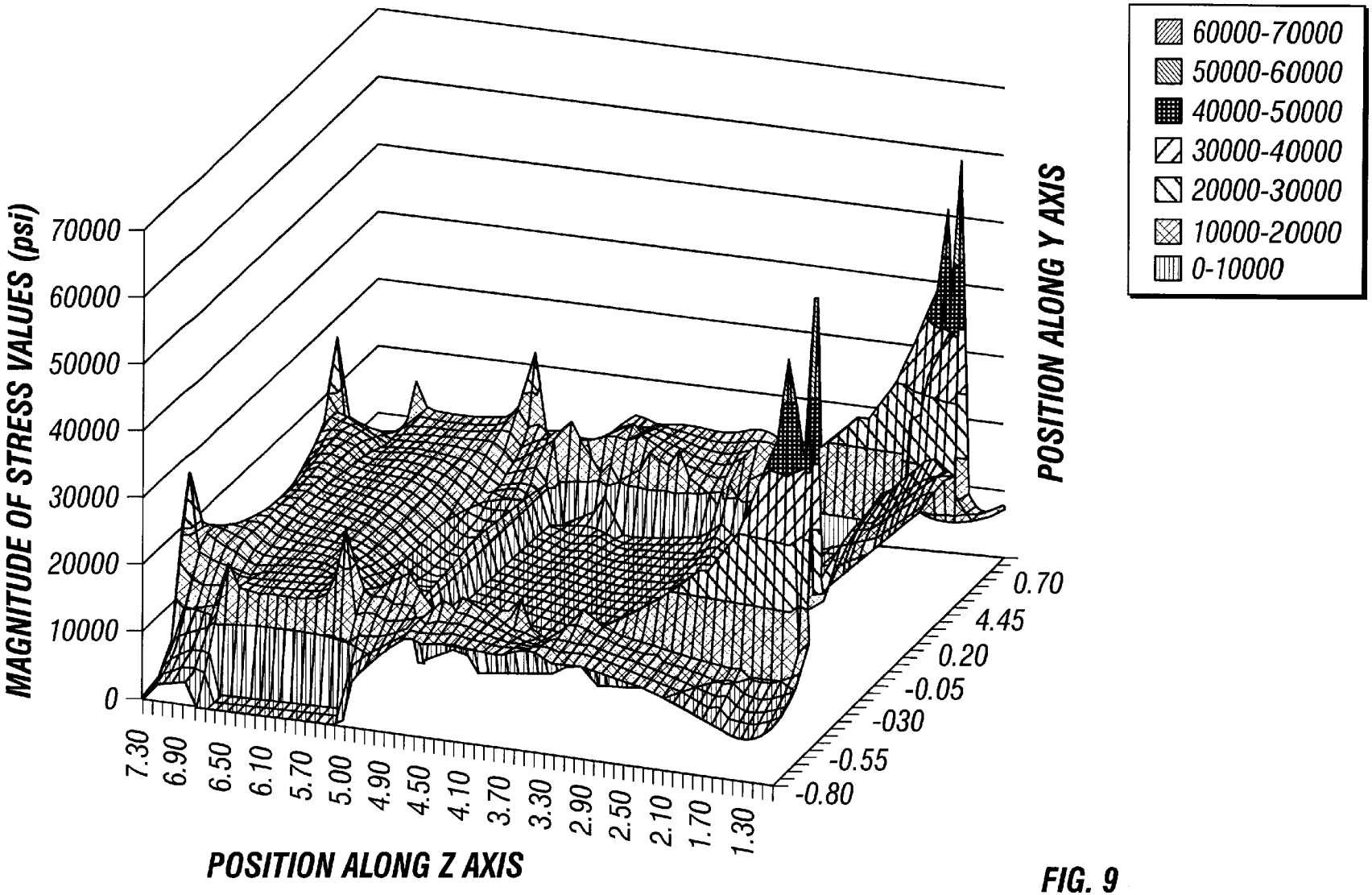
Figure 10:
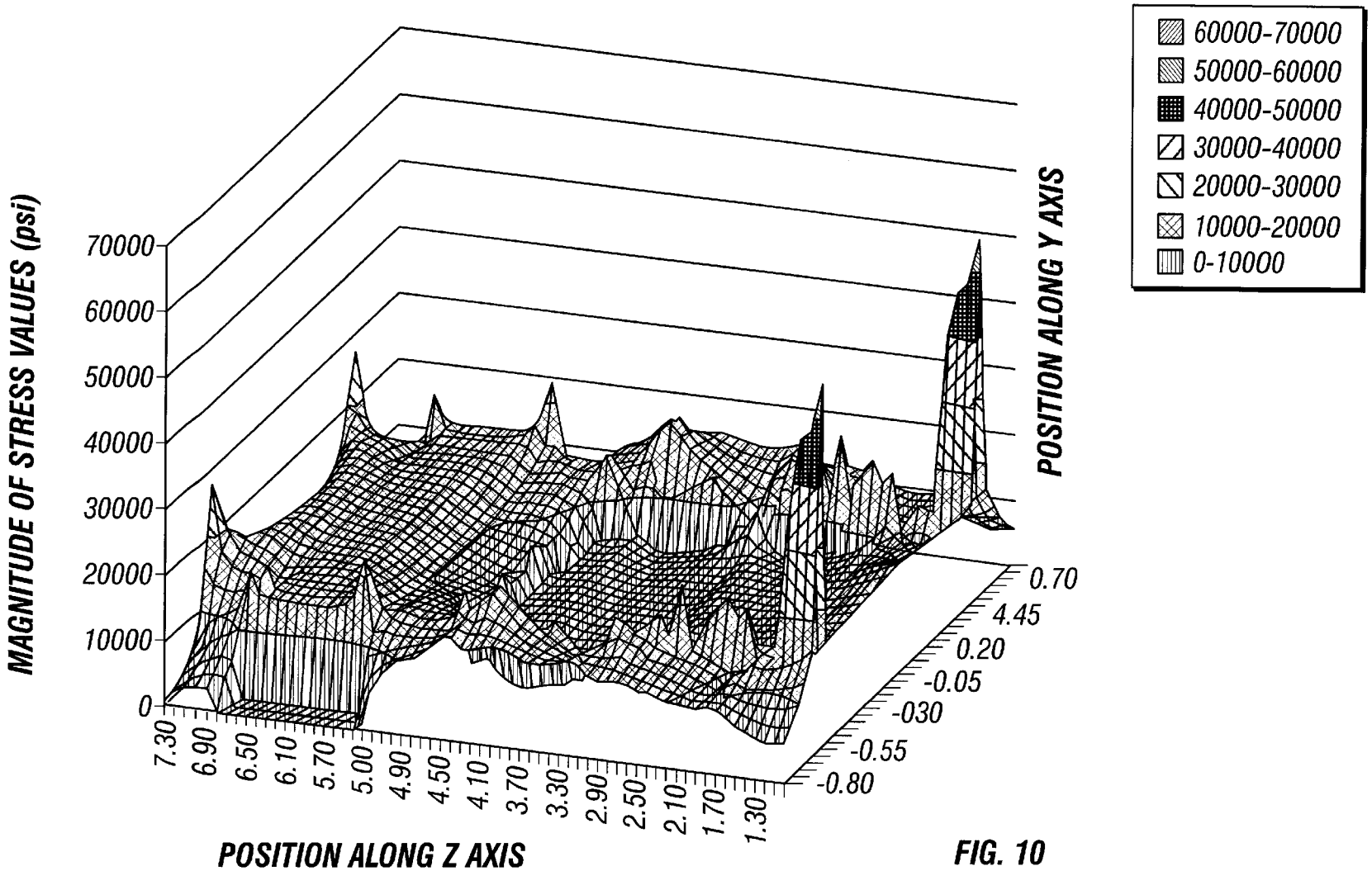
Figure 11:
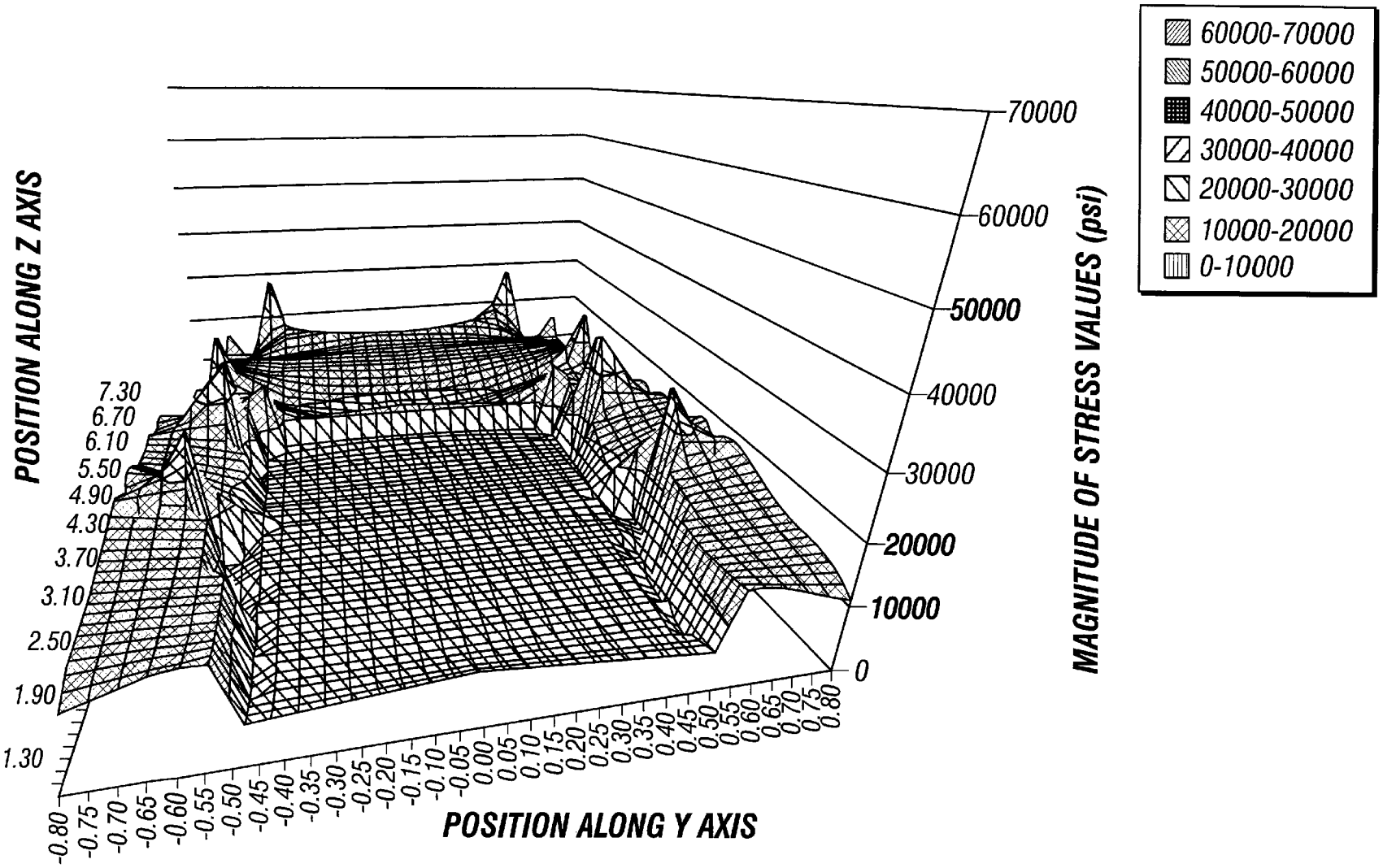
Figure 12:
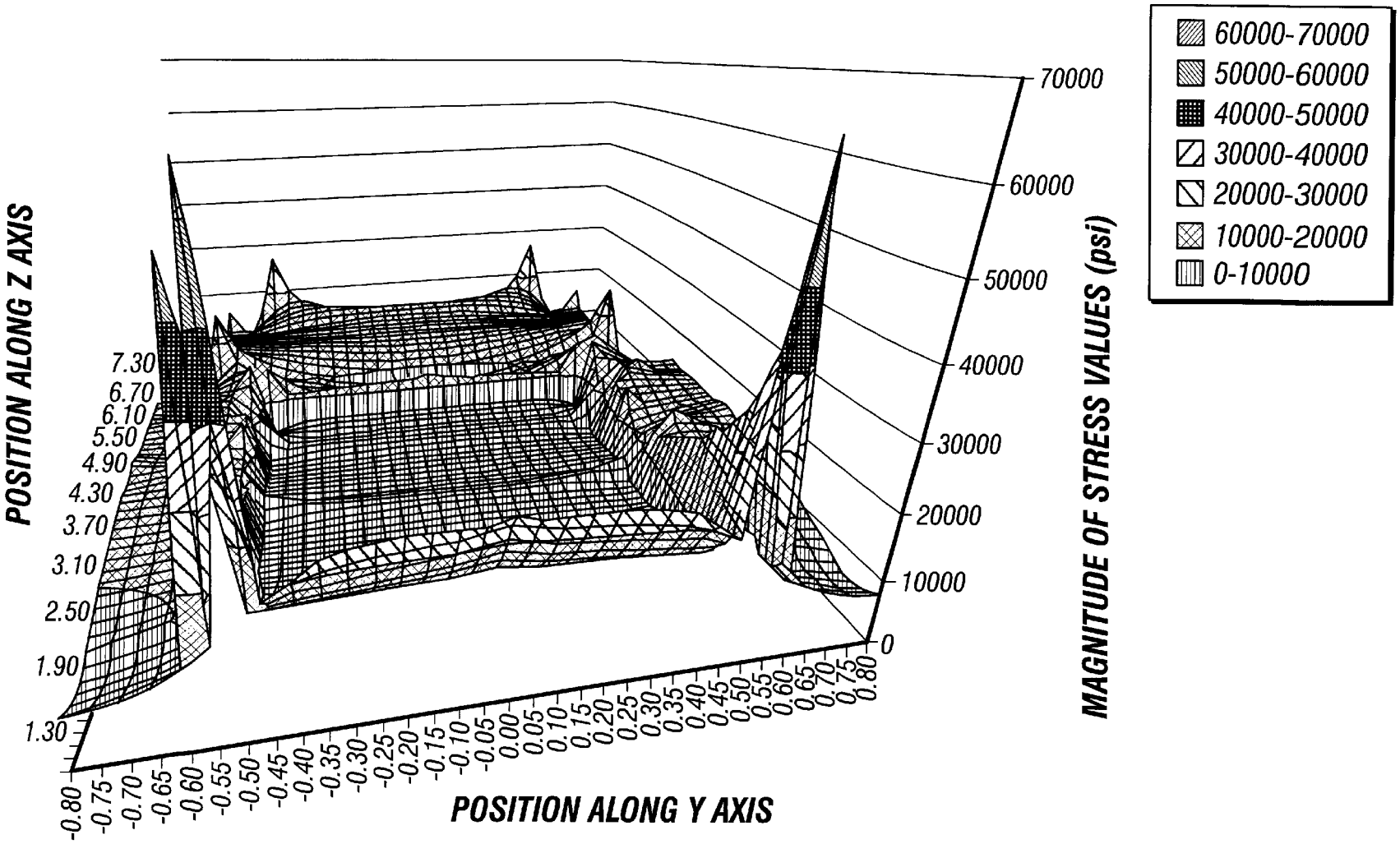
Figure 13:
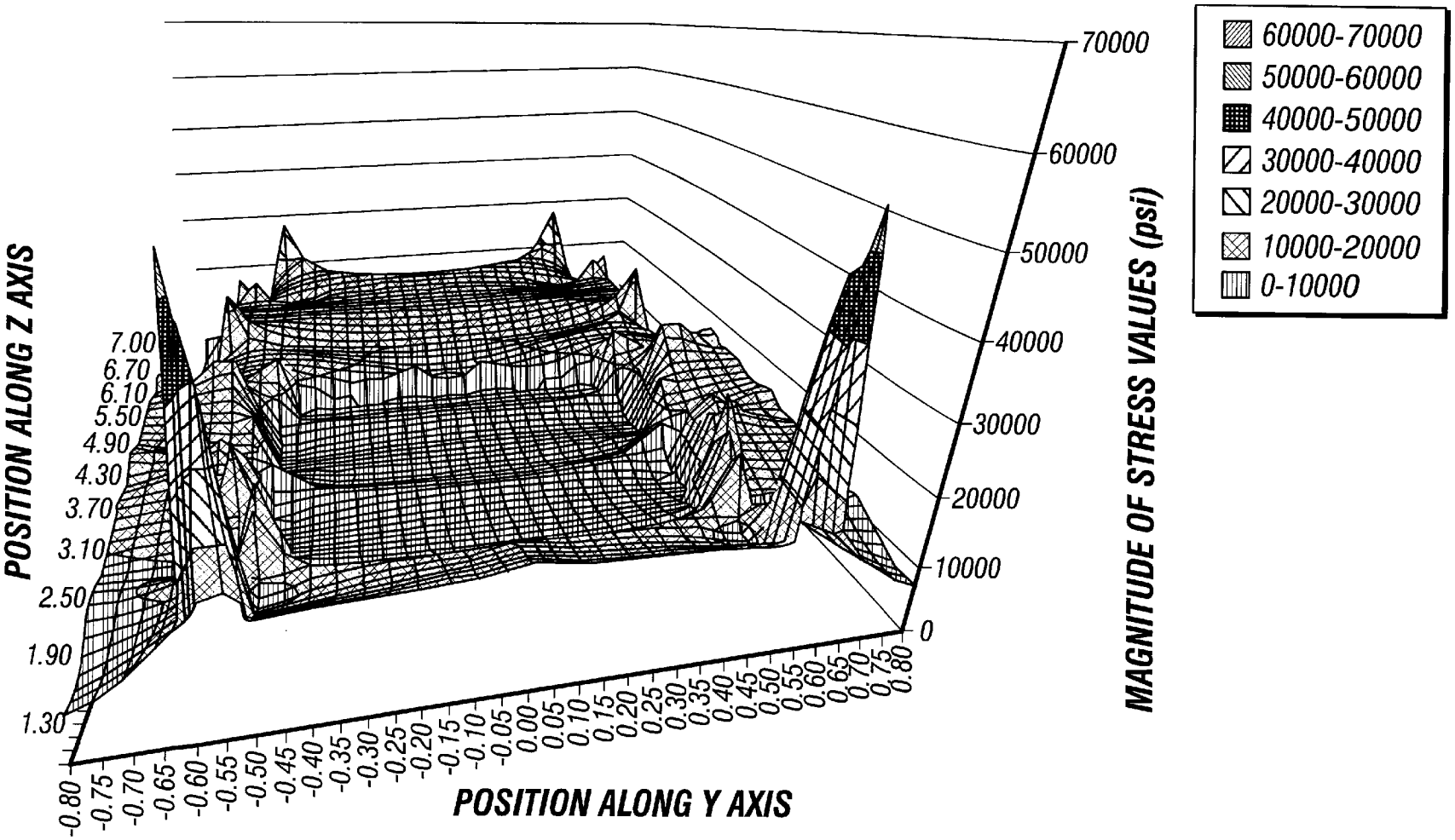

DSM of models, viewed from 20, 20, 0 (20° elevation, 20° rotation, 0° perspective), shown in illus. 8–10, (FIGS. 8–10, respectively) identify the following landmarks: Z axis=7.30 demarcates the area where the fitting shoulder meets the pin and at Z axis~6.80–5.40 outlines the wrench flat area in all illustrations. DSM viewed from 20, 80, 80, shown in illus. 11–13, (FIGS. 11–13, respectively) views the same illustration rotated anti-clockwise to view the stress mapping as it appears from the open end of the end fitting.

Analysis of Results

In viewing the illustrations, the following comparisons can be made:

The Alpha design, illus. 8, is capable of equal distribution of stress across the diameter of the rod body, and is able to distribute more of the stress into the metal component of the assembly.

The Beta design, illus. 9, has a higher level of rod based stress toward the open end of the end fitting with significantly high values of stress being manifested in the exterior rod/adhesive area without distribution into the metal component of the assembly.

The Gamma design, illus. 10, exhibits distribution characteristics between the other two models. While rod stress values are less than those found in Beta, the values are higher then those found in Alpha. Additionally, the rod exterior/adhesive area stress levels lie between those found in the other two models.

Figure 14:
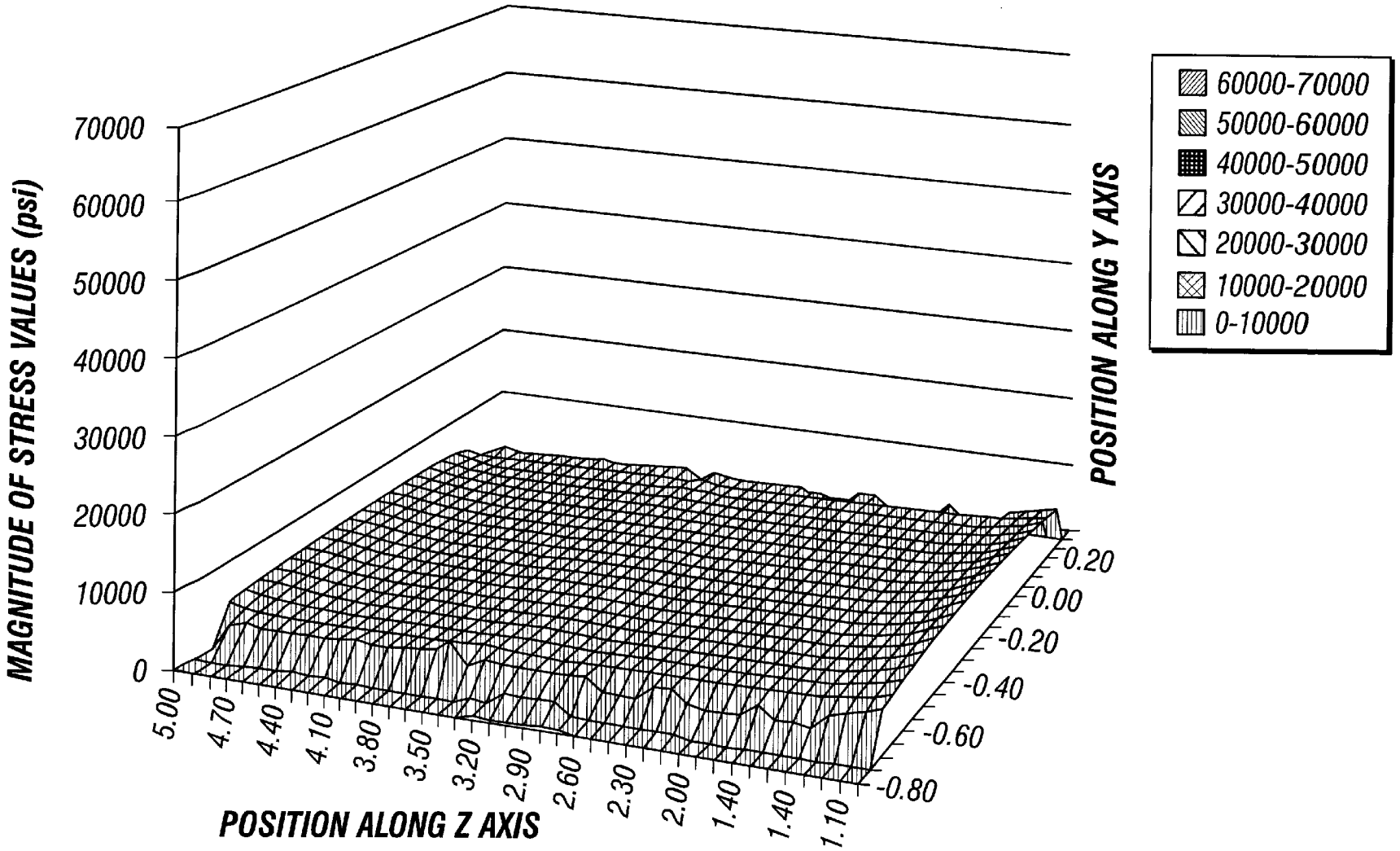
Figure 15:
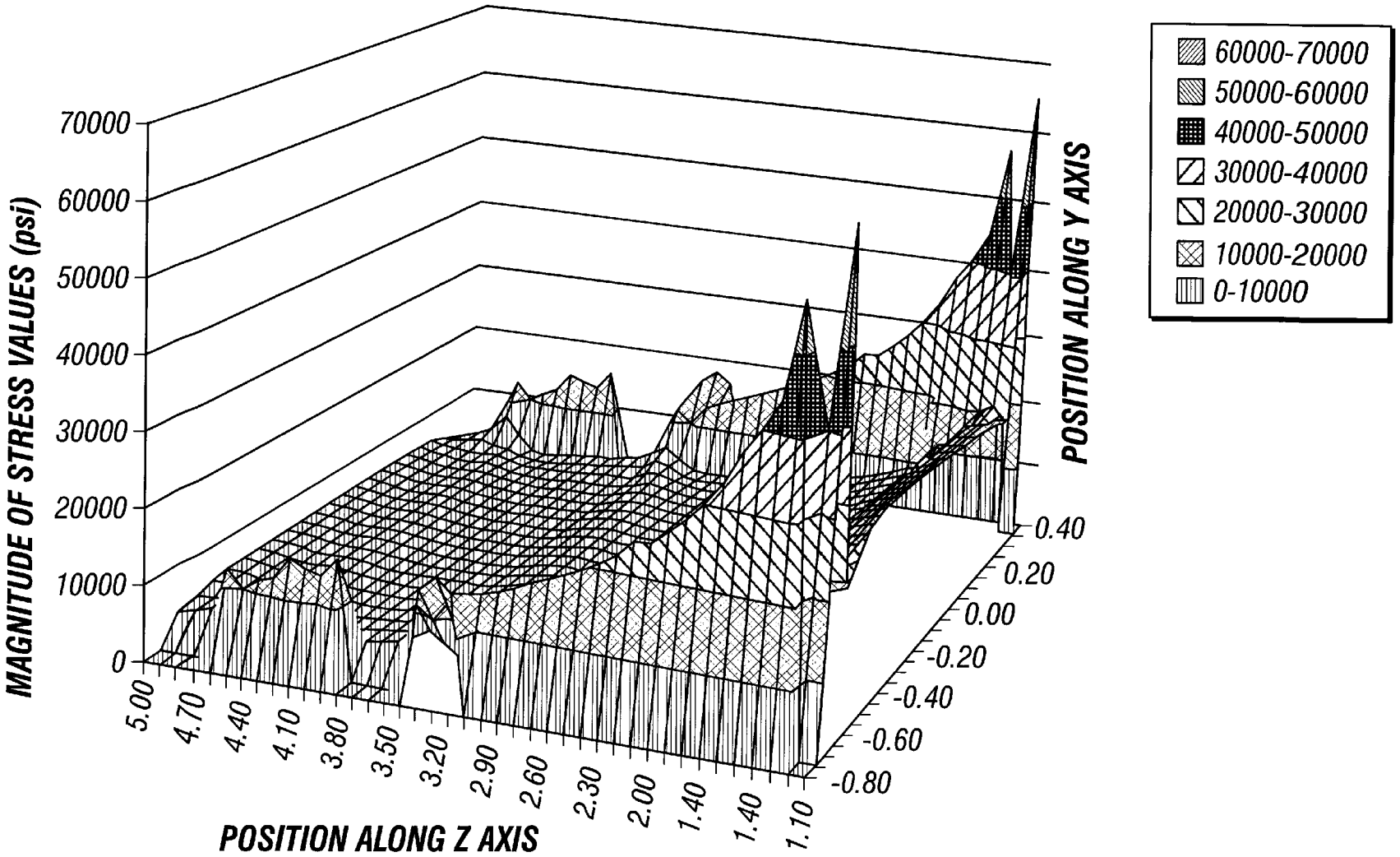
Figure 16:
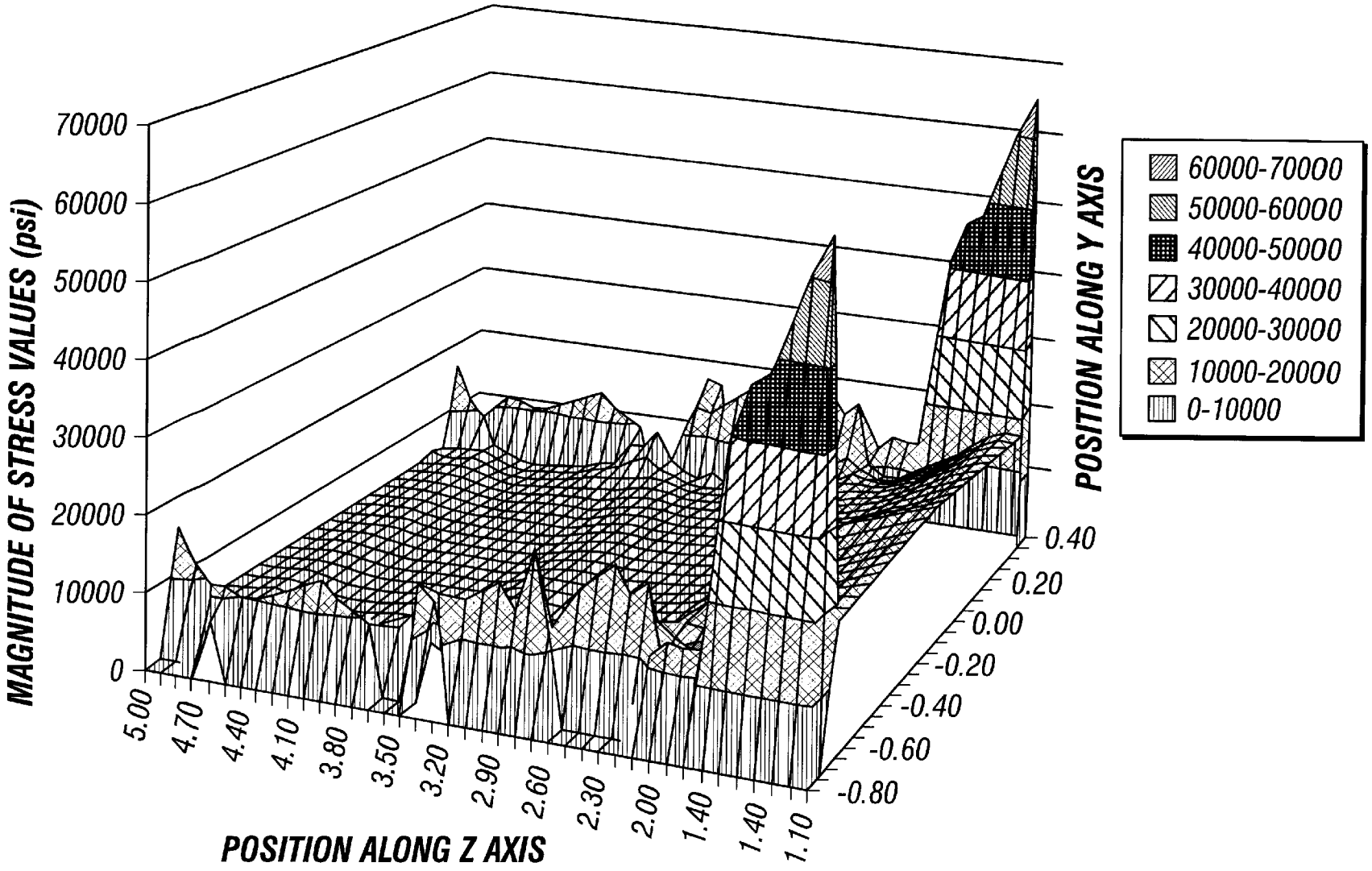

Examination of the illustrations 14–16, (FIGS. 14–16, respectively) " . . . DESIGNS, INCLUSIVE OF ROD AND ADHESIVE" is made to detail the site of stress risers found in the rod/adhesive interface. The Alpha design, illus. 14, allows for equal stress distribution across the rod/adhesive area. The Beta and Gamma illustrations, illus. 15 and 16 respectively, detail significantly high levels of imposed stress in the adhesive layer, possibly to destructive levels.

Figure 17:
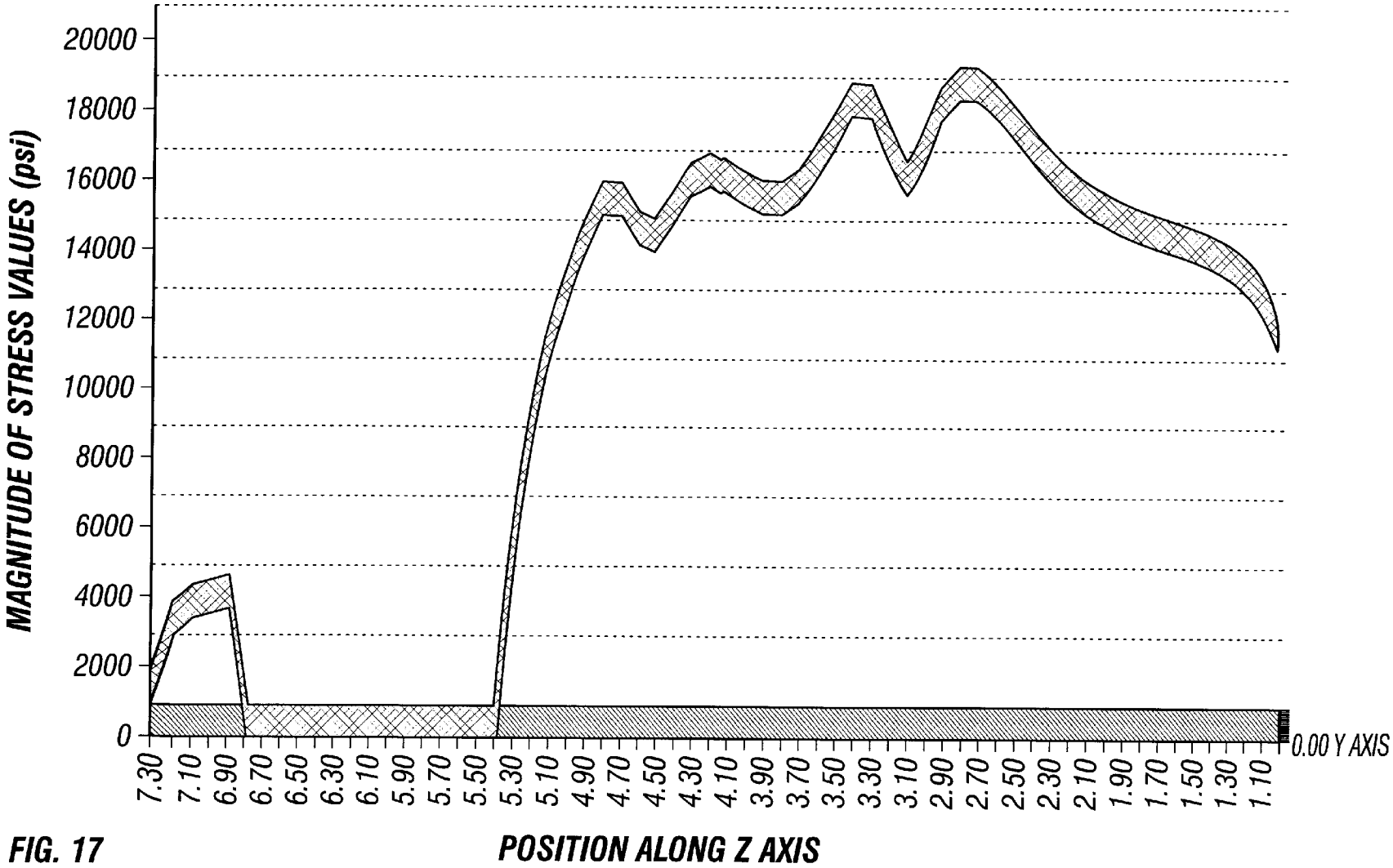
Figure 18:
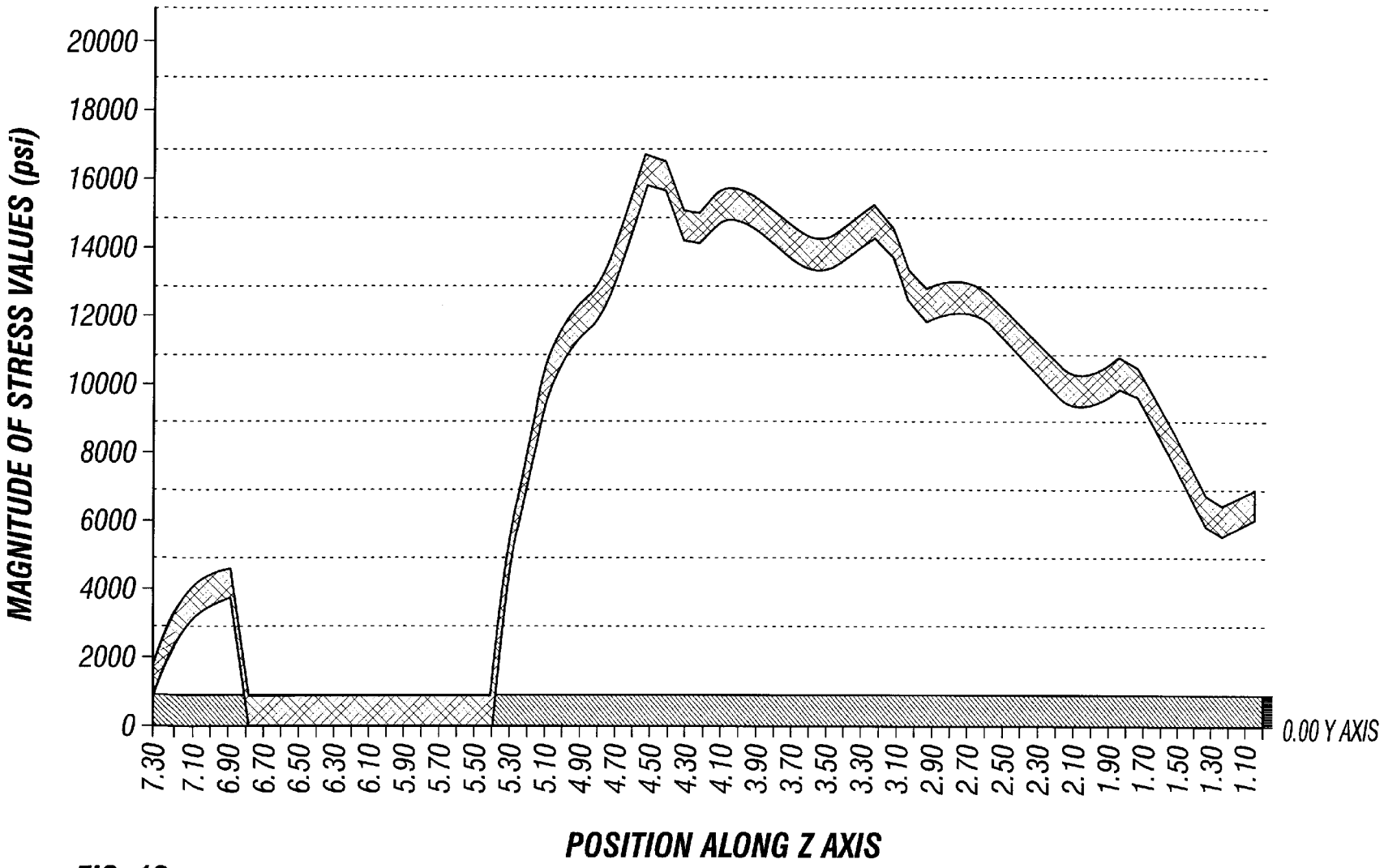
Figure 19:
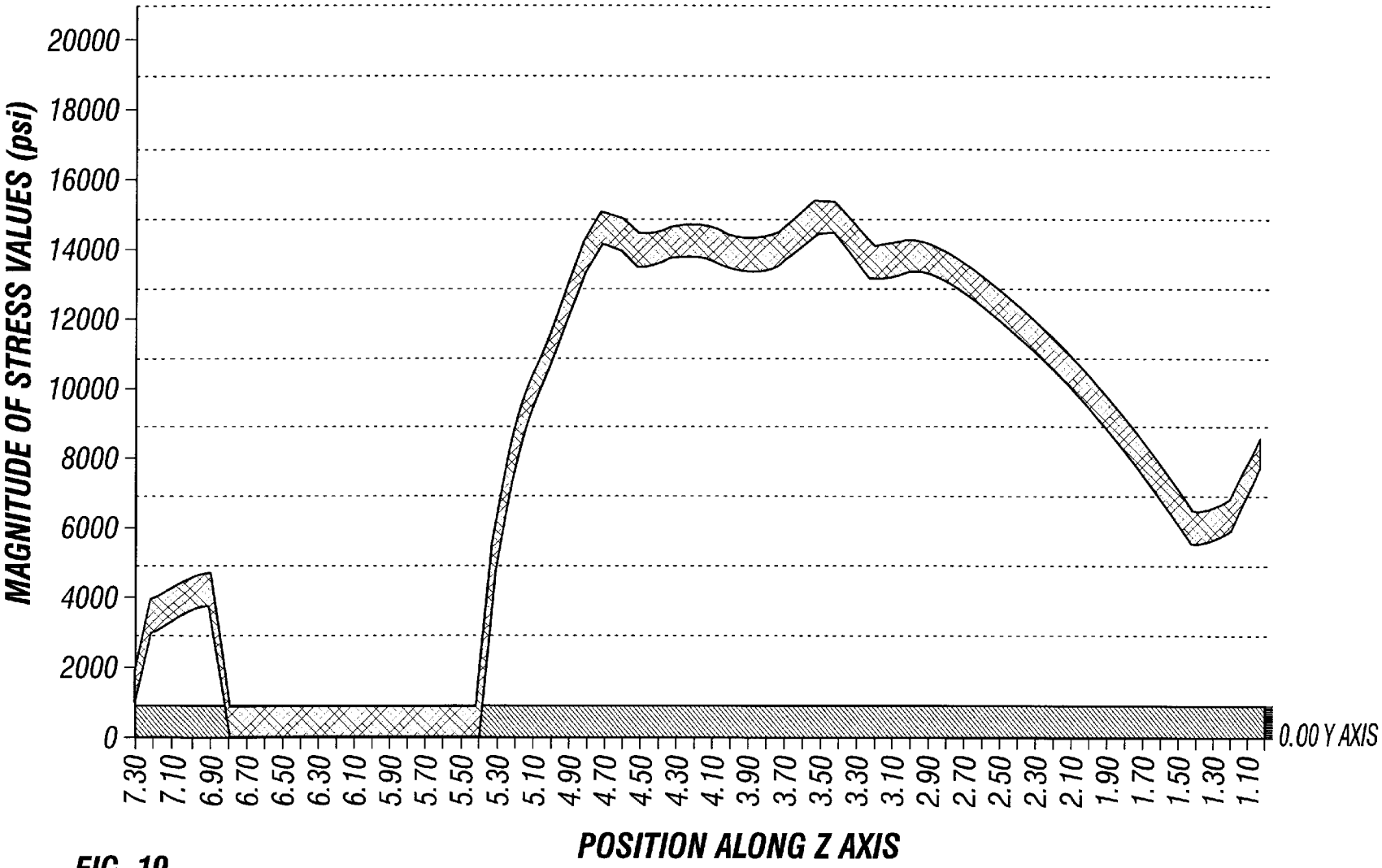

Given the conditions of equal load case applications, and that each model has singular stress distribution patterns, there remains some value of imposed stress that is not yet accounted. Reference is now made to "EXTERIOR SURFACE PROFILE" illustrations 17–19 (FIGS. 17–19, respectively):

The exterior surface profile is an illustration of the stress levels found in the outermost sampled metal component. Comparing these views with the rod/adhesive profiles, a direct correlation between the stresses found in these components are confirmed. As stress values in the metal component are increased, the stress values in the rod are decreased, and vice versa.

Comparing "EXTERIOR SURFACE PROFILE" illustrations 17–19, it becomes apparent that the Alpha model, illus. 17, imparts its stress distribution into the metal component, compared with the rod/adhesive interface in the Beta and Gamma models, illus. 18 and 19, respectively.

Figure 20:
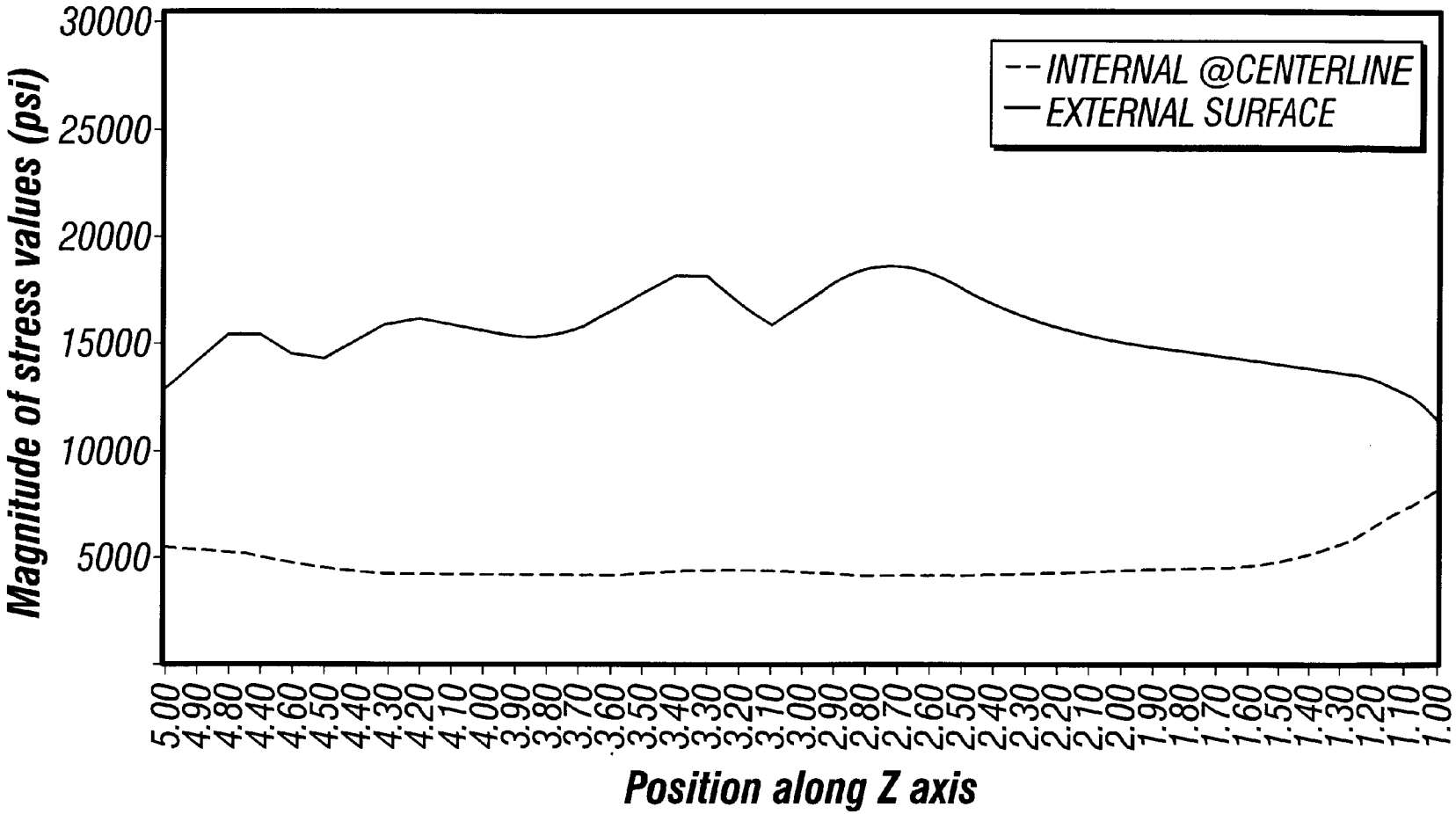
Figure 21:
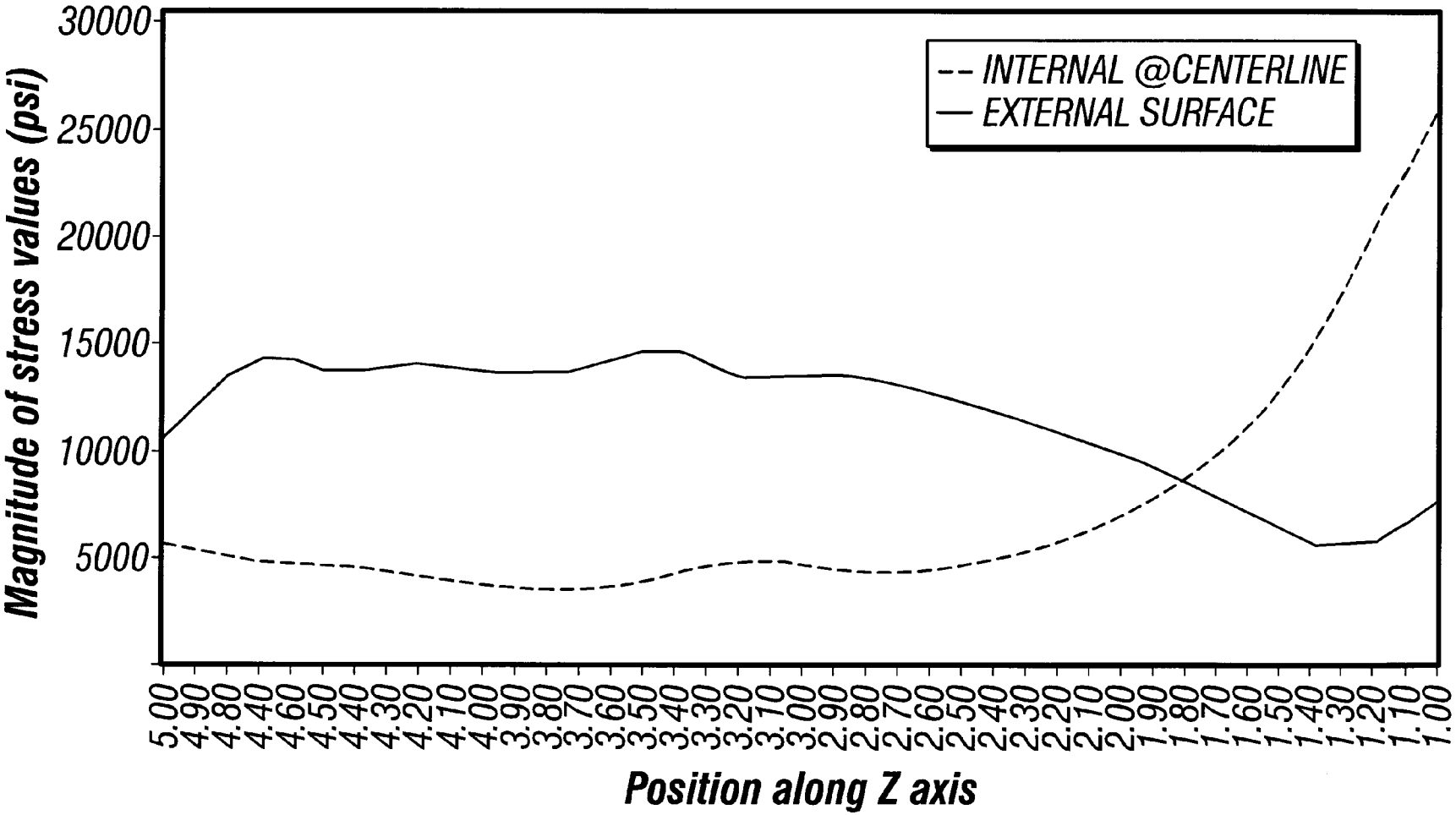
Figure 22:
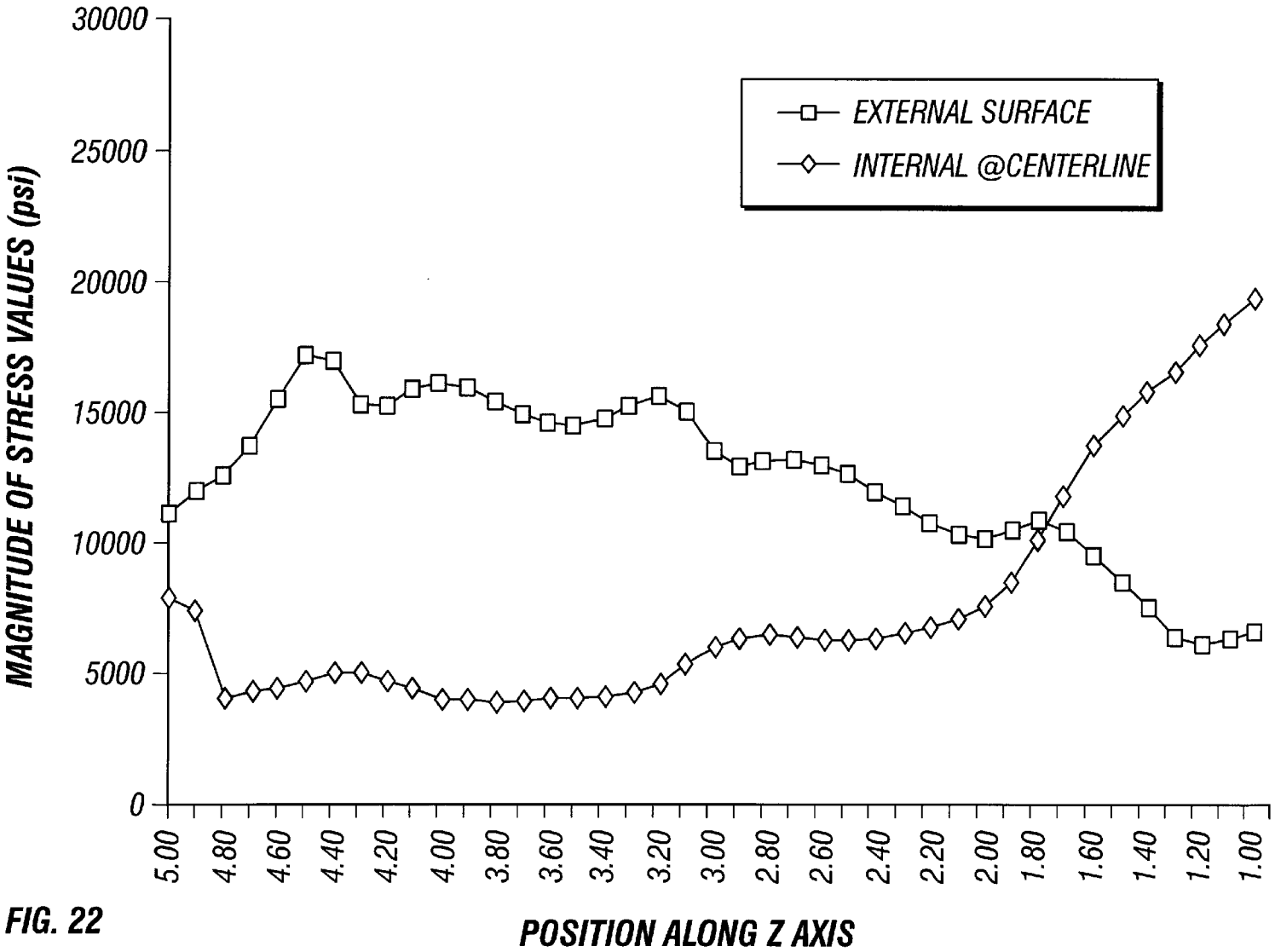

To confirm that the stress distribution profile is accurate in each model, a comparison of observed stresses are detailed is "INTERNAL CENTERLINE AND EXTERIOR SURFACE," as illustrated in illus. 20–22 (FIGS. 20–22, respectively). The Alpha design, illus. 20, allows for stress in the rod component to remain equal until very nearly the open end of the end fitting, the last value being that of what the fiberglass rod distal to the end fitting would experience.

The fiberglass rods in the Beta and Gamma designs, illus. 21 and 22, respectively, see increasing stress toward the open end of the end fitting as the metal component experiences decreasing stress levels. The rod stress value levels increase as metal stress values decrease until those values cross on the graph, and the rod begins to "re-absorb" stresses imparted form the system.

Figure 23:
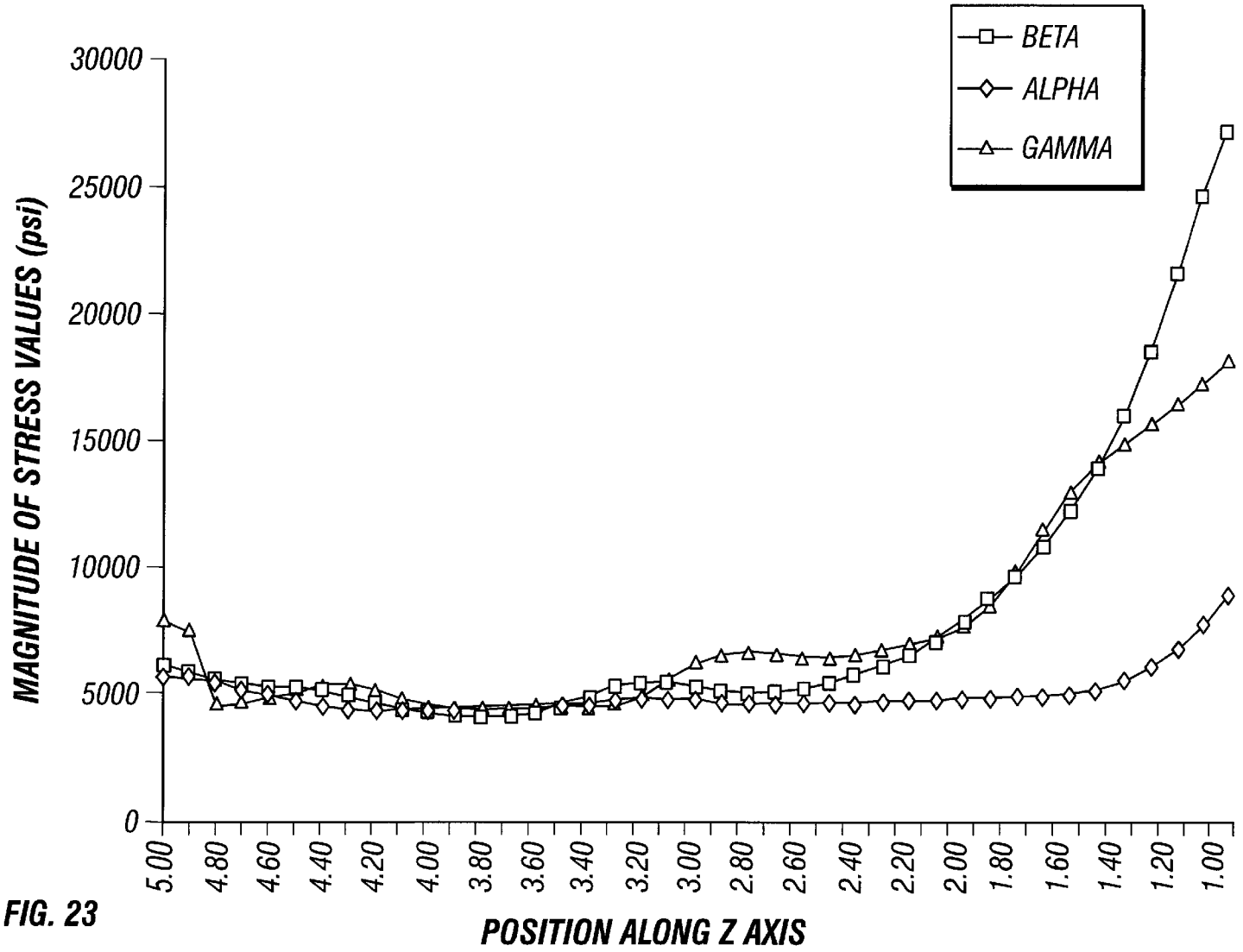
Figure 24:
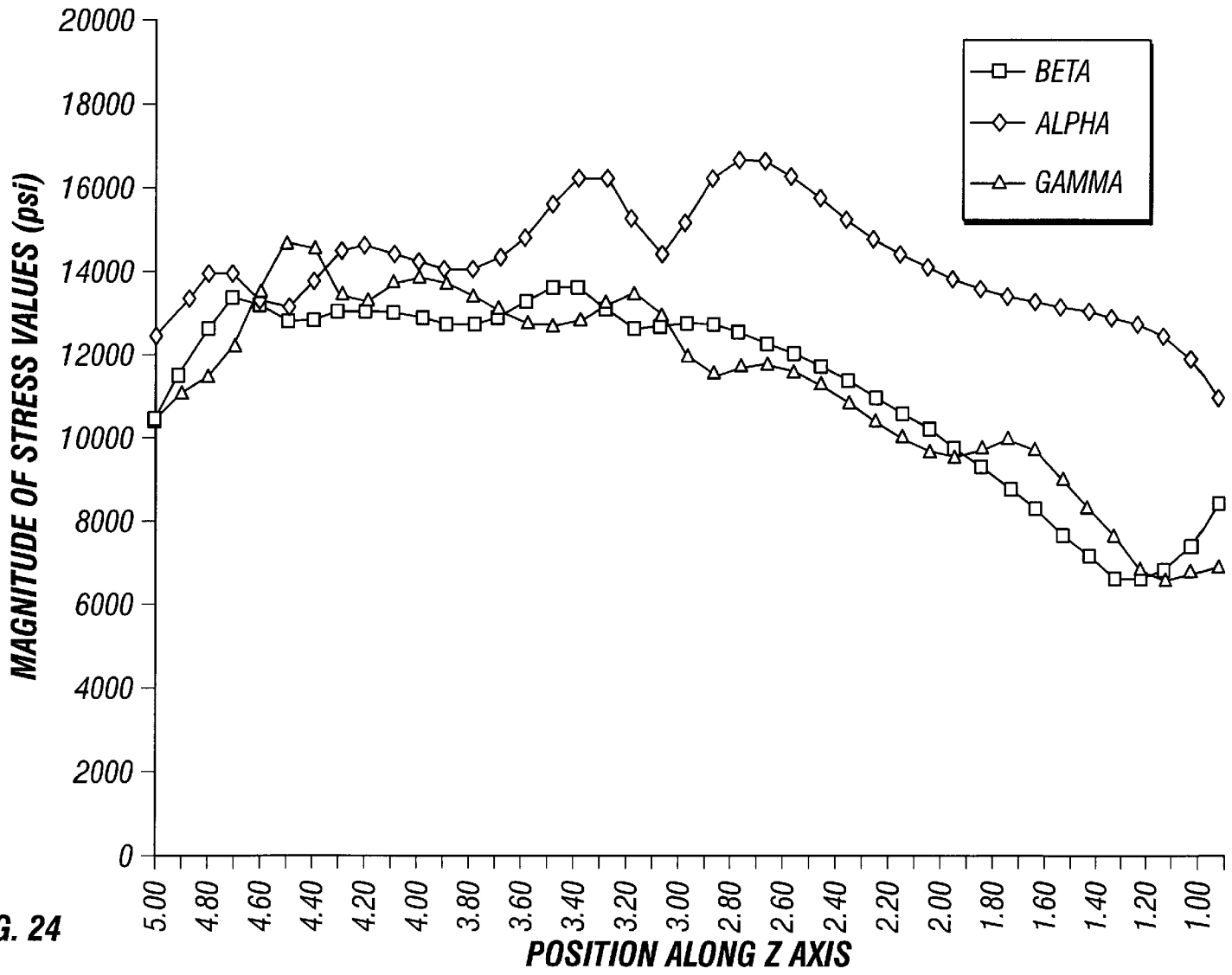

Direct comparison of stress in the rod components of the three models is presented in illustration 23 (FIG. 23), "STRESS VALUES IN ROD", indicating the level of stress values found at the centerline of the models' rods under testing circumstances. A similar comparison is made in the metal component of all designs in illustration 24 (FIG. 24), "STRESS VALUES IN EXTERIOR SURFACE", for the outer metal component.

Conclusion

It becomes apparent that the internal geometry of end fitting design is critical in imposed stress distribution. Based on the analysis of data generated for this report, it can be concluded that:

1. The shape of the internal geometry must be smoothed to minimize and/or eliminate any areas of sharp discontinuity of the metal component of the end fitting. Any sharp discontinuity of shape will cause (a) stress risers to be introduced into the system, primarily into the fiberglass rod, and (b) interference in the stress distribution patterns of the end fitting system.

2. Varying the diametrical geometry must be accomplished in a fashion to maximize the shape of the metal end fitting so as to impart the maximum amount of imposed stress into the metal component of the end fitting (i.e., the strongest component of the system).

3. Linear geometry of the pocket along the longitudinal (Z) axis should be maximized. Such lengthening accomplishes (a) an increase in the area of the pocket, and (b) minimizes the interference of the development of stress distribution patterns.

The results of the computer modeling demonstrate that the connector of the present invention, comprising wave shaped transition surfaces from one wedge to the next, virtually eliminates spiking of destructive forces, directs such forces even into the metal end fitting, and provides an FSR connection that is very resistant to rod failure.

While there has been illustrated and described a single embodiment of the present invention, it will be appreciated that numerous changes and modifications will occur to those skilled in the art and it is intended in the appended claims to cover all those changes and modifications which fall within the true spirit and scope of the present invention.

What is claimed is:

1. A sucker rod end fitting comprising:

a rod receptacle having a closed axially inner end and an open axially outer end, wherein said rod receptacle comprises a plurality of integrally formed, outwardly converging, axially aligned annuli, each such anulus approaching the rod asymptotically and being tapered to be of decreasing diameter towards said open end, and defining a separate transition surface between each pair of adjacent annuli included in said plurality of annuli, wherein each such transition surface comprises a continuous function surface having no abrupt change in curvature.

2. The sucker rod end fitting of claim 1, further comprising, a transition surface between said closed end and the maximum diameter of the annulus distal from said open end, wherein said transition surface comprises a wave-shaped cross-section.

3. A sucker rod construction comprising:

an end fitting comprising a rod receptacle formed to define an internal surface having a closed axially inner end and an open axially outer end, wherein said rod receptacle comprises a plurality of integrally formed, outwardly converging, axially aligned annuli, each such annulus approaching the rod asymptotically and being tapered to be of decreasing diameter towards said open end and defining a separate transition surface between each pair of adjacent annuli included in said plurality of annuli, wherein each such transition surface comprises a continuous function surface having no abrupt change in curvature;

a cylindrical fiberglass rod having an end having a cylindrical outer surface being received within said rod receptacle through said open outer end and cooperating therewith to define an annular chamber between said outer surface of said end of said rod and said outwardly converging annuli of said rod receptacle; and a body of initially flowable adhesive that cures to bond said outer surface of said end of said rod and to solidify to form a plurality of wedges to cooperate with said annuli.

4. The sucker rod construction of claim 3, wherein said end fitting further comprises a transition surface between said closed end and the maximum diameter of the annulus distal from said open end, wherein said transition surface comprises a wave-shaped cross-section.

5. A sucker rod end fitting comprising:

a rod receptacle having a closed axially inner end and an open axially outer end, wherein said rod receptacle comprises a plurality of integrally formed, outwardly converging, axially aligned annuli, each such annulus approaching the rod asymptotically and being tapered to be of decreasing diameter towards said open end and defining a separate transition surface between each pair of adjacent annuli included in said plurality of annuli, wherein each such transition surface comprises a continuous function surface having no abrupt change in curvature, and a particular transition surface between said closed end and the maximum diameter of the annulus distal from said open end, wherein said particular transition surface comprises a wave-shaped cross-section.

6. A sucker rod construction comprising:

an end fitting comprising a rod receptacle formed to define an internal surface having a closed axially inner end and an open axially outer end, wherein said rod receptacle comprises a plurality of integrally formed, outwardly converging, axially aligned annuli, each such annulus approaching the rod asymptotically and being tapered to be of decreasing diameter towards said open end and defining a separate transition surface between each pair of adjacent annuli included in said plurality of annuli, wherein each such transition surface comprises a continuous function surface having no abrupt change in curvature, and a particular transition surface between said closed end and the maximum diameter of the annulus distal from said open end, wherein said particular transition surface comprises a wave-shaped, cross-section;

a cylindrical fiberglass rod having an end having a cylindrical outer surface being received within said rod receptacle through said open outer end and cooperating therewith to define an annular chamber between said outer surface of said end of said rod and said outwardly converging annuli of said rod receptacle; and a body of initially flowable adhesive that curves to bond said outer surface of said end of said rod and to solidify to form a plurality of wedges to cooperate with said annuli.

7. A sucker rod end fitting comprising:

an end fitting, said end fitting comprising a rod receptacle to receive said sucker rod to define an internal surface having a closed axially inner end and an open axially outer end, wherein said rod receptacle comprises a plurality of integrally formed, outwardly converging, axially aligned annuli, each such annulus approaching the rod asymptotically and being tapered to be of decreasing diameter towards said open end and defining a separate transition surface between each pair of adjacent annuli included in said plurality of annuli, wherein each such transition surface comprises a continuous function surface having no abrupt change in curvature, and a particular transition surface between said closed end and the maximum diameter of the annulus distal front said open end, wherein said particular transition surface comprises a wave-shaped cross-section; and a body of initially flowable adhesive that cures to bond said outer surface of said end of said rod and to solidify to form a plurality of wedges to cooperate with said annuli.

8. The sucker rod of claim 7, wherein said sucker rod comprises fiberglass.

9. The sucker rod of claim 7, wherein said sucker road comprises a composite material.

10. A sucker rod string for use in an oil well, said string comprising a plurality of sucker rods connected end to end by end fittings, wherein at least one of said end fittings comprises a rod receptacle to receive a sucker rod and formed to define an internal surface having a closed axially inner end and an open axially outer end, wherein said rod receptacle comprises a plurality of integrally formed, outwardly converging, axially aligned annuli, each such annulus approaching the rod asymptotically and being tapered to be of decreasing diameter towards said open end and defining a separate transition surface between each pair of adjacent annuli included in said plurality of annuli, wherein each such transition surface comprises a continuous function surface having no abrupt change in curvature, and a particular transition surface between said closed end and the maximum diameter of the annulus distal from said open end, wherein said particular transition surface comprises a wave-shaped cross-section.

11. The sucker rod string of claim 10, wherein at least one of said sucker rods comprises fiberglass.

12. The sucker rod string of claim 10, wherein at least one of said sucker rods comprises a composite material.

13. A sucker rod end fitting comprising:

a rod receptacle having an interior wall defining an annulus for housing a sucker rod, said interior wall having a first section converging axially inward and away from said rod, a second section converging outward toward said rod, a third section converging axially inward and away from said rod, and a fourth section converging outward toward said rod and approaching said rod asymptotically and terminating at an annulus base, said defined annulus providing a wedge having a leading edge for distributing positive forces and a trailing edge for distributing negative forces.

14. A sucker rod construction comprising:

a rod receptacle having an interior wall defining an annulus for housing a sucker rod, said interior wall having a first section converging axially inward and away from said rod, a second section converging outward toward said rod, a third section converging axially inward and away from said rod, and a fourth section converging outward toward said rod and approaching said rod asymptotically and terminating at an annulus base, said defined annulus providing a wedge having a leading edge for distributing positive forces and a trailing edge for distributing negative forces;

a cylindrical rod received within said annulus and cooperating therewith to define an annular chamber between said rod and said interior wall; and a body of initially flowable adhesive that cures to bond to said rod and to solidify to form a wedge to cooperate with said annulus.

15. The sucker rod of claim 14, wherein said sucker rod comprises fiberglass.

16. The sucker rod of claim 14, wherein said sucker rod comprises a composite material.

17. A sucker rod string for use in an oil well, said string comprising a plurality of sucker rods connected end to end by end fittings, wherein at least one of said end fittings comprises a rod receptacle having an interior wall defining an annulus for housing a sucker rod, said interior wall having a first section converging axially inward and away from said rod, a second section converging outward toward said rod, a third section converging axially inward and away from said rod, and a fourth section converging outward toward said rod and approaching said rod asymptotically and terminating at an annulus base, said defined annulus providing a wedge having a leading edge for distributing positive forces and a trailing edge for distributing negative forces.

18. The sucker rod string of claim 17, wherein at least one of said sucker rods comprises fiberglass.

19. The sucker rod string of claim 17, wherein at least one of said sucker rods comprises a composite material.

20. A sucker rod end fitting comprising:

a rod receptacle having an interior wall defining a plurality of axially aligned annuli for housing a sucker rod, wherein each annulus comprises a first section of said interior wall converging axially inward and away from said rod, a second section of said interior wall converging outward toward said rod, a third section of said interior wall converging axially inward and away from said rod, and a fourth section of said interior wall converging outward toward said rod and approaching said rod asymptotically; and wherein said fourth section terminates at an annulus base, each said defined annulus providing a wedge having a leading edge for distributing positive forces and a trailing edge for distributing negative forces.

21. A sucker rod construction comprising:

a rod receptacle having an interior wall defining a plurality of axially aligned annuli for housing a sucker rod, wherein each annulus comprises a first section of said interior wall converging axially inward and away from said rod, a second section of said interior wall converging outward toward said rod, a third section of said interior wall converging axially inward and away from said rod, and a fourth section of said interior wall converging outward toward said rod and approaching said rod asymptotically; and wherein said fourth section terminates at an annulus base, each said defined annulus providing a wedge having a leading edge for distributing positive forces and a trailing edge for distributing negative forces, a cylindrical rod received within said rod receptacle and cooperating therewith to define an annular chamber between said rod and said interior wall; and a body of initially flowable adhesive that cures to bond to said rod and to solidify to form a plurality of wedges to cooperate with said annulus.

22. The sucker rod of claim 21, wherein at least one of said sucker rods comprises fiberglass.

23. The sucker rod of claim 21, wherein at least one of said sucker rods comprises a composite material.

24. A sucker rod string for use in an oil well, said string comprising a plurality of sucker rods connected end to end by end fittings, wherein at least one of said end fittings comprises a rod receptacle having an interior wall defining a plurality of axially aligned annuli for housing a sucker rod, wherein each annulus comprises a first section of said interior wall converging axially inward and away from said rod, a second section of said interior wall converging outward toward said rod, a third section of said interior wall converging axially inward and away from said rod, and a fourth section of said interior wall converging outward toward said rod and approaching said rod asymptotically; and wherein said fourth section terminates at an annulus base, each said defined annulus providing a wedge having a leading edge for distributing positive forces and a trailing edge for distributing negative forces.

25. The sucker rod string of claim 24, wherein at least one of said sucker rods comprises fiberglass.

26. The sucker rod string of claim 24, wherein at least one of said sucker rods comprises a composite material.

27. A sucker rod end fitting comprising:

a rod receptacle having an interior wall defining an annulus for housing a sucker rod, said interior wall having a first section converging axially inward and away from said rod, and a second section converging outward toward said rod, said defined annulus approaching the rod asymptotically and providing a wedge having a leading edge for distributing positive forces and a trailing edge for distributing negative forces.

28. A sucker rod construction comprising:

a rod receptacle having an interior wall defining an annulus for housing a sucker rod, said interior wall having a first section converging axially inward and away from said rod, and a second section converging outward toward said rod, said defined annulus approaching the rod asymptotically and providing a wedge having a leading edge for distributing positive forces and a trailing edge for distributing negative forces;

a cylindrical rod received within said annulus and cooperating therewith to define an annular chamber between said rod and said interior wall; and a body of initially flowable adhesive that cures to bond to said rod and to solidify to form a wedge to cooperate with said annulus.

29. A sucker rod end fitting comprising:

a rod receptacle having an interior wall defining an annulus for housing a sucker rod, said interior wall having a first section converging axially inward and away from said rod, a second section converging outward for a given distance toward said rod at a given angle, a third section converging axially inward and away from said rod, and a fourth section converging outward for a distance less than said given distance toward said rod and approaching said rod at an angle larger than said given angle, said defined annulus providing a pair of wedges, each having a leading edge for distributing positive forces and a trailing edge for distributing negative forces.

30. A sucker rod construction comprising:

a rod receptacle having an interior wall defining an annulus for housing a sucker rod, said interior wall having a first section converging axially inward and away from said rod, a second section converging outward for a given distance at a given angle, a third section converging axially inward and away from said rod, and a fourth section converging outward for a distance less than said given distance toward said rod and approaching said rod at an angle larger than said given angle, said defined annulus providing a pair of wedges, each wedge having a leading edge for distributing positive forces and a trailing edge for distributing negative forces;

a cylindrical rod received within said annulus and cooperating therewith to define an annular chamber between said rod and said interior wall; and a body of initially flowable adhesive that cures to bond to said rod and to solidify to form said pair of wedges to cooperate with said annulus.

* * * * *